US007647013B2

(12) United States Patent
Hazeyama

(10) Patent No.: US 7,647,013 B2
(45) Date of Patent: Jan. 12, 2010

(54) IMAGE FORMING APPARATUS INCLUDING DEVELOPER ELECTRIC FIELD TRANSPORT APPARATUS

(75) Inventor: Tomoaki Hazeyama, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/408,163

(22) Filed: Mar. 20, 2009

(65) Prior Publication Data

US 2009/0232562 A1 Sep. 17, 2009

Related U.S. Application Data

(63) Continuation of application No. PCT/JP2007/068913, filed on Sep. 20, 2007.

(30) Foreign Application Priority Data

Sep. 20, 2006 (JP) ..... 2006-254962
Sep. 26, 2006 (JP) ..... 2006-261334

(51) Int. Cl.
*G03G 15/08* (2006.01)

(52) U.S. Cl. ..... 399/265

(58) Field of Classification Search ..... 399/252, 399/265, 266, 289–291; 347/55
See application file for complete search history.

(56) References Cited

U.S. PATENT DOCUMENTS 4,558,941 A * 12/1985 Nosaki et al. ..... 399/266
4,598,991 A 7/1986 Hosoya et al.
6,597,884 B2 7/2003 Miyaguchi et al.
6,708,014 B2 * 3/2004 Miyaguchi et al. ..... 399/266
6,816,694 B2 * 11/2004 Adachi et al. ..... 399/265
6,901,231 B1 * 5/2005 Sakai et al. ..... 399/266
6,901,232 B2 * 5/2005 Sakuma et al. ..... 399/266
6,934,496 B2 8/2005 Sakuma et al.

FOREIGN PATENT DOCUMENTS

JP 59-181371 10/1984
JP 59-189372 10/1984
JP 63-013074 1/1988
JP 04-318575 11/1992
JP 07-163905 6/1995
JP 2002-082524 3/2002
JP 2002-091159 3/2002
JP 2002-307740 10/2002

(Continued)

OTHER PUBLICATIONS

International Search Report dated Jan. 8, 2008; based off PCT/JP2007/068913.

*Primary Examiner*—William J Royer
(74) *Attorney, Agent, or Firm*—Banner & Witcoff, Ltd.

(57) ABSTRACT

A toner supply apparatus 6 is configured to be able to supply a charged toner T to a latent image forming surface LS of a photoconductor drum 3. The toner supply apparatus 6 houses a toner electric field transport body 62. The toner electric field transport body 62 has first portions and second portions which differ in toner T transport force. The first portions and the second portions differ in structural feature, such as relative dielectric constant or thickness. By means of such a structural difference, the state of transport of the toner T on the toner transport surface TTS is appropriately set.

17 Claims, 38 Drawing Sheets

FOREIGN PATENT DOCUMENTS

| | | |
|---|---|---|
| JP | 2002-351218 | 12/2002 |
| JP | 2002-365912 | 12/2002 |
| JP | 2003-015417 | 1/2003 |
| JP | 2003-098826 | 4/2003 |
| JP | 2004-157259 | 6/2004 |
| JP | 2004-333845 | 11/2004 |
| JP | 2004-340996 | 12/2004 |
| JP | 2005-275127 | 10/2005 |
| WO | WO 2008035814 | 3/2008 |

* cited by examiner

IMAGE FORMING APPARATUS INCLUDING DEVELOPER ELECTRIC FIELD TRANSPORT APPARATUS

This application is a continuation application of prior application no. PCT/JP2007/068913, filed Sep. 20, 2007, which claims priority to Japanese patent application no. 2006-254962, filed Sep. 20, 2006 and Japanese patent application no. 2006-261334, filed Sep. 26, 2006. The entire subject matter and contents of these priority applications are incorporated herein by reference.

TECHNICAL FIELD

The present invention relates to an image forming apparatus. More specifically, the present invention relates to a developer electric field transport apparatus provided in the image forming apparatus and configured to be able to transport a charged developer by means of electric fields.

BACKGROUND ART

Conventionally, a large number of apparatus (developer electric field transport apparatus) for transporting a developer (a dry developer or a dry toner) by use of traveling wave electric fields are known for use in image forming apparatus.

In such a developer electric field transport apparatus, a large number of elongated electrodes are disposed on an electrically insulative substrate. The electrodes are arranged in a developer transport direction. The developer is contained in a predetermined casing.

According to the developer electric field transport apparatus having the above-mentioned configuration, polyphase AC voltages are sequentially applied to the electrodes, whereby traveling wave electric fields are formed. By the action of the traveling wave electric fields, the charged developer is transported in the developer transport direction.

DISCLOSURE OF THE INVENTION

[1] In the above-mentioned developer electric field transport apparatus, a state of transporting the developer in the developer transport direction must be set appropriately according to the structure, specifications, etc. of the image forming apparatus.

For example, usually, a kinetic velocity of the developer in a state of being contained in the casing (in a state before being transported in the developer transport direction) hardly has a component along the developer transport direction. Thus, in the vicinity of a transport start position for the developer, large acceleration along the developer transport direction may need to be imposed on the developer. Through imposition of the acceleration, the developer in an amount required for forming a good image is transported quickly and smoothly toward a predetermined object of developer supply (photoconductor drum, etc.).

Also, in the case where the process velocity of the image forming apparatus (circumferential velocity of the photoconductor drum) is high, in order to restrain non-uniform density caused by a pitch between the electrodes, in the vicinity of the developer supply object, the transport velocity of the developer may need to be slowed down.

Also, because of ejection of the developer in the vicinity of the developer supply object, stagnation of the developer in a large amount or a like cause may lead to "white background fogging." "White background fogging" is a phenomenon in which pixels are undesirably formed on a white background where pixels are not supposed to be formed in the developer. In order to restrain occurrence of the "white background fogging," in the vicinity of the developer supply object, the ejection of the developer, the stagnation of the developer in a large amount, or a like cause must be restrained.

In this case, the transport velocity of the developer needs to be slowed down, and the developer which has passed the developer supply object needs to be quickly returned to the casing.

The present invention has been conceived for solving the above-mentioned problems. That is, an object of the invention is to provide a developer electric field transport apparatus in which a state of transporting a developer in a developer transport direction can be appropriately set, as well as an image forming apparatus which can form an image in good condition through provision of the developer electric field transport apparatus.

The developer electric field transport apparatus of the present invention is configured to be able to transport a charged developer along a predetermined developer transport direction by the effect of electric fields. The developer electric field transport apparatus is disposed in such a manner as to face a developer carrying body.

The developer carrying body has a developer carrying surface. The developer carrying surface is a surface of the developer carrying body and can carry the developer thereon. The developer carrying surface is formed in parallel with a predetermined main scanning direction.

The developer carrying surface can move along a predetermined moving direction. The moving direction can be set in parallel with a sub-scanning direction orthogonal to the main scanning direction.

Specifically, for example, an electrostatic latent image carrying body configured to be able to form an electrostatic latent image thereon by means of electric potential distribution can be used as the developer carrying body. In this case, the developer carrying surface assumes the form of a latent image forming surface. The latent image forming surface is a circumferential surface of the electrostatic latent image carrying body. The latent image forming surface is configured to be able to form the electrostatic latent image thereon.

Alternatively, the developer carrying body can be, for example, a recording medium (paper or the like) which is transported along the sub-scanning direction. In this case, the developer carrying surface is implemented by the surface (recording surface) of the recording medium.

Alternatively, the developer carrying body can be, for example, a roller, a sleeve, or a belt member (a developing roller, a developing sleeve, an intermediate transfer belt, etc.). These members are disposed, for example, in such a manner as to face the recording medium or the electrostatic latent image carrying body. These members are configured and disposed so as to be able to transfer the developer onto the recording medium or the electrostatic latent image carrying body.

The developer electric field transport apparatus of the present invention comprises a plurality of transport electrodes.

The transport electrodes are configured to have their longitudinal direction intersecting with the sub-scanning direction. Also, the transport electrodes are arrayed along the sub-scanning direction. The plurality of transport electrodes are configured (and disposed) to generate traveling wave electric fields through application of traveling wave voltages thereto and to be able to transport the developer along a predetermined developer transport direction by the effect of the electric fields.

An image forming apparatus of the present invention comprises an electrostatic latent image carrying body serving as the developer carrying body, and a developer supply apparatus.

The electrostatic latent image carrying body has a latent image forming surface. The latent image forming surface is formed in parallel with a predetermined main scanning direction. The latent image forming surface is configured to be able to form an electrostatic latent image thereon by means of electric potential distribution. The electrostatic latent image carrying body is configured such that the latent image forming surface can move along a sub-scanning direction orthogonal to the main scanning direction.

The developer supply apparatus is disposed in such a manner as to face the electrostatic latent image carrying body. The developer supply apparatus is configured to be able to supply a developer in a charged state to the latent image forming surface. The developer supply apparatus comprises the developer electric field transport apparatus.

To achieve the above-mentioned object of the present invention, a developer electric field transport apparatus of the present invention and an image forming apparatus of the present invention provided with the developer electric field transport apparatus can be configured as follows.

(1) The developer electric field transport apparatus (the developer supply apparatus) comprises an electrode support member and a transport electrode cover member.

The electrode support member is configured to support the transport electrodes. The transport electrodes are supported on the surface of the electrode support member.

The transport electrode cover member is formed in such a manner as to cover the transport electrodes and the surface of the electrode support member. The transport electrode cover member has a developer transport surface. The developer transport surface is in parallel with the main scanning direction and faces the developer carrying surface (the latent image forming surface).

The developer electric field transport apparatus (the developer supply apparatus) further comprises a transport electrode cover intermediate layer. The transport electrode cover intermediate layer is formed between the transport electrode cover member and the transport electrodes.

In the developer electric field transport apparatus (the developer supply apparatus), a counter area where the developer carrying surface and the developer transport surface face each other, and other areas have the following characteristic configurations.

(1-1) The transport electrode cover member can be configured such that relative dielectric constant is lower in those areas which are located upstream of and downstream of the counter area with respect to the developer transport direction, than in the counter area.

In the above-mentioned configuration, when traveling wave voltages are applied to the transport electrodes, electric field strength in a space in the vicinity of the developer transport surface in which the developer can be transported is higher in the upstream area and the downstream area than in the counter area. That is, the electric field strength is lower in the counter area than in the upstream area. Also, the electric field strength is higher in the downstream area than in the counter area.

Thus, for example, at a transport start position of the developer on the developer transport surface (e.g., a portion of the developer transport surface located most upstream with respect to the developer transport direction), a high acceleration can be imposed on the developer which is almost motionless with respect to the developer transport direction.

Also, for example, the developer which has been accelerated in an area located upstream of the counter area can be decelerated in the counter area. Thus, in the counter area, non-uniform presence of the developer along the developer transport direction can be effectively restrained.

Also, for example, the developer which has passed the counter area can be accelerated in a downstream direction along which the developer is transported beyond the counter area. Thus, the stagnation of a large amount of the developer in the counter area can be restrained.

Thus, according to the above-mentioned configuration, the state of transport of the developer in the developer transport direction can be appropriately set. Therefore, according to the above-mentioned configuration, the formation of an image in the developer can be carried out in a better fashion.

(1-2) The transport electrode cover member can comprise an upstream intermediate portion. The upstream intermediate portion is provided between a most upstream area and the counter area with respect to the developer transport direction. The upstream intermediate portion is configured such that its relative dielectric constant falls between that in the most upstream area and that in the counter area.

The transport electrode cover member ranging from the most upstream area to the upstream intermediate portion and then to the counter area may be configured such that relative dielectric constant varies stepwise in the order of the most upstream area, the upstream intermediate portion, and the counter area. Alternatively, the transport electrode cover member ranging from the most upstream area to the upstream intermediate portion and then to the counter area may be configured such that relative dielectric constant varies continuously from the most upstream area to the counter area.

In the above-mentioned configuration, the electric field strength gradually lowers in the order of the most upstream area, the upstream intermediate portion, and the counter area.

Thus, for example, in the course of transport of the developer from the most upstream area toward the counter area, the developer can be smoothly decelerated.

(1-3) The transport electrode cover member can comprise a downstream intermediate portion. The downstream intermediate portion is provided between a most downstream area and the counter area with respect to the developer transport direction. The downstream intermediate portion is configured such that its relative dielectric constant falls between that in the most downstream area and that in the counter area.

The transport electrode cover member ranging from the counter area to the downstream intermediate portion and then to the most downstream area may be configured such that relative dielectric constant varies stepwise in the order of the counter area, the downstream intermediate portion, and the most downstream area. Alternatively, the transport electrode cover member ranging from the counter area to the downstream intermediate portion and then to the most downstream area may be configured such that relative dielectric constant varies continuously from the counter area to the most downstream area.

In the above-mentioned configuration, the electric field strength gradually increases in the order of the counter area, the downstream intermediate portion, and the most downstream area.

Thus, for example, in the course of transport of the developer from the counter area toward the most downstream area, the developer can be smoothly accelerated.

(1-4) The transport electrode cover intermediate layer can be configured such that relative dielectric constant is lower in those areas which are located upstream of and downstream of the counter area with respect to the developer transport direction, than in the counter area.

In the above-mentioned configuration, when traveling wave voltages are applied to the transport electrodes, the electric field strength is higher in the upstream area and the downstream area than in the counter area.

Thus, the state of transport of the developer in the developer transport direction can be appropriately set. Therefore, according to the above-mentioned configuration, the formation of an image in the developer can be carried out in a better fashion.

(1-5) The transport electrode cover intermediate layer can comprise an upstream intermediate portion. The upstream intermediate portion is provided between a most upstream area and the counter area with respect to the developer transport direction. The upstream intermediate portion is configured such that its relative dielectric constant falls between that in the most upstream area and that in the counter area.

The transport electrode cover intermediate layer ranging from the most upstream area to the upstream intermediate portion and then to the counter area may be configured such that relative dielectric constant varies stepwise in the order of the most upstream area, the upstream intermediate portion, and the counter area. Alternatively, the transport electrode cover intermediate layer ranging from the most upstream area to the upstream intermediate portion and then to the counter area may be configured such that relative dielectric constant varies continuously from the most upstream area to the counter area.

In the above-mentioned configuration, the electric field strength gradually lowers in the order of the most upstream area, the upstream intermediate portion, and the counter area.

(1-6) The transport electrode cover intermediate layer can comprise a downstream intermediate portion. The downstream intermediate portion is provided between a most downstream area and the counter area with respect to the developer transport direction. The downstream intermediate portion is configured such that its relative dielectric constant falls between that in the most downstream area and that in the counter area.

The transport electrode cover intermediate layer ranging from the counter area to the downstream intermediate portion and then to the most downstream area may be configured such that relative dielectric constant varies stepwise in the order of the counter area, the downstream intermediate portion, and the most downstream area. Alternatively, the transport electrode cover intermediate layer ranging from the counter area to the downstream intermediate portion and then to the most downstream area may be configured such that relative dielectric constant varies continuously from the counter area to the most downstream area.

In the above-mentioned configuration, the electric field strength gradually increases in the order of the counter area, the downstream intermediate portion, and the most downstream area.

(1-7) The transport electrode cover member can be configured in such a manner as to be thinner in those areas which are located upstream of and downstream of the counter area with respect to the developer transport direction, than in the counter area.

In the above-mentioned configuration, when traveling wave voltages are applied to the transport electrodes, the electric field strength is higher in the upstream area and the downstream area than in the counter area.

Thus, the state of transport of the developer in the developer transport direction can be appropriately set. Therefore, according to the above-mentioned configuration, the formation of an image in the developer can be carried out in a better fashion.

(1-8) The transport electrode cover member can comprise an upstream intermediate portion. The upstream intermediate portion is provided between a most upstream area and the counter area with respect to the developer transport direction. The upstream intermediate portion is configured such that its thickness falls between that in the most upstream area and that in the counter area.

The transport electrode cover member ranging from the most upstream area to the upstream intermediate portion and then to the counter area may be configured such that thickness varies stepwise in the order of the most upstream area, the upstream intermediate portion, and the counter area. Alternatively, the transport electrode cover member ranging from the most upstream area to the upstream intermediate portion and then to the counter area may be configured such that thickness varies continuously from the most upstream area to the counter area.

In the above-mentioned configuration, the electric field strength gradually lowers in the order of the most upstream area, the upstream intermediate portion, and the counter area.

(1-9) The transport electrode cover member can comprise a downstream intermediate portion. The downstream intermediate portion is provided between a most downstream area and the counter area with respect to the developer transport direction. The downstream intermediate portion is configured such that its thickness falls between that in the most downstream area and that in the counter area.

The transport electrode cover member ranging from the counter area to the downstream intermediate portion and then to the most downstream area may be configured such that thickness varies stepwise in the order of the counter area, the downstream intermediate portion, and the most downstream area. Alternatively, the transport electrode cover member ranging from the counter area to the downstream intermediate portion and then to the most downstream area may be configured such that thickness varies continuously from the counter area to the most downstream area.

In the above-mentioned configuration, the electric field strength gradually increases in the order of the counter area, the downstream intermediate portion, and the most downstream area.

(1-10) The transport electrode cover intermediate layer can be configured in such a manner as to be thinner in those areas which are located upstream of and downstream of the counter area with respect to the developer transport direction, than in the counter area.

In the above-mentioned configuration, when traveling wave voltages are applied to the transport electrodes, the electric field strength is higher in the upstream area and the downstream area than in the counter area.

Thus, the state of transport of the developer in the developer transport direction can be appropriately set. Therefore, according to the above-mentioned configuration, the formation of an image in the developer can be carried out in a better fashion.

(1-11) The transport electrode cover intermediate layer can comprise an upstream intermediate portion. The upstream intermediate portion is provided between a most upstream area and the counter area with respect to the developer transport direction. The upstream intermediate portion is configured such that its thickness falls between that in the most upstream area and that in the counter area.

The transport electrode cover intermediate layer ranging from the most upstream area to the upstream intermediate portion and then to the counter area may be configured such that thickness varies stepwise in the order of the most upstream area, the upstream intermediate portion, and the counter area. Alternatively, the transport electrode cover intermediate layer ranging from the most upstream area to the upstream intermediate portion and then to the counter area may be configured such that thickness varies continuously from the most upstream area to the counter area.

In the above-mentioned configuration, the electric field strength gradually lowers in the order of the most upstream area, the upstream intermediate portion, and the counter area.

(1-12) The transport electrode cover intermediate layer can comprise a downstream intermediate portion. The downstream intermediate portion is provided between a most downstream area and the counter area with respect to the developer transport direction. The downstream intermediate portion is configured such that its thickness falls between that in the most downstream area and that in the counter area.

The transport electrode cover intermediate layer ranging from the counter area to the downstream intermediate portion and then to the most downstream area may be configured such that thickness varies stepwise in the order of the counter area, the downstream intermediate portion, and the most downstream area. Alternatively, the transport electrode cover intermediate layer ranging from the counter area to the downstream intermediate portion and then to the most downstream area may be configured such that thickness varies continuously from the counter area to the most downstream area.

In the above-mentioned configuration, the electric field strength gradually increases in the order of the counter area, the downstream intermediate portion, and the most downstream area.

(1-13) In the case where the transport electrode cover intermediate layer is configured in such a manner as to be thinner in those areas which are located upstream of and downstream of the counter area with respect to the developer transport direction, than in the counter area, the transport electrode cover intermediate layer and the transport electrode cover member can be configured such that a laminate of the transport electrode cover intermediate layer and the transport electrode cover member is formed into the form of a flat plate having a substantially fixed thickness and such that the transport electrode cover member is lower in relative dielectric constant than the transport electrode cover intermediate layer.

In the above-mentioned configuration, the (combined) relative dielectric constant of the laminate of the transport electrode cover member and the transport electrode cover intermediate layer is lower in those areas which are located upstream of and downstream of the counter area with respect to the developer transport direction, than in the counter area. Thus, when traveling wave voltages are applied to the transport electrodes, the electric field strength can be higher in the upstream area and the downstream area than in the counter area.

(1-14) The transport electrodes can be formed in such a manner as to be thicker in those areas which are located upstream of and downstream of the counter area with respect to the developer transport direction, than in the counter area.

In the above-mentioned configuration, when traveling wave voltages are applied to the transport electrodes, the electric field strength is higher in the upstream area and the downstream area than in the counter area.

Thus, the state of transport of the developer in the developer transport direction can be appropriately set. Therefore, according to the above-mentioned configuration, the formation of an image in the developer can be carried out in a better fashion.

(1-15) The transport electrodes can be formed such that the transport electrodes in a most upstream area with respect to the developer transport direction are thicker than the transport electrodes in an upstream intermediate area located between the most upstream area and the counter area and such that the transport electrodes in the upstream intermediate area are thicker than the transport electrodes in the counter area.

The transport electrodes may be configured such that thickness varies stepwise in the order of the most upstream area, the upstream intermediate area, and the counter area. Alternatively, the transport electrodes may be configured such that thickness varies continuously from the most upstream area to the counter area.

In the above-mentioned configuration, the electric field strength gradually lowers in the order of the most upstream area, the upstream intermediate area, and the counter area.

(1-16) The transport electrodes can be formed such that the transport electrodes in a most downstream area with respect to the developer transport direction are thicker than the transport electrodes in a downstream intermediate area located between the most downstream area and the counter area and such that the transport electrodes in the downstream intermediate area are thicker than the transport electrodes in the counter area.

The transport electrodes may be configured such that thickness varies stepwise in the order of the counter area, the downstream intermediate area, and the most downstream area. Alternatively, the transport electrodes may be configured such that thickness varies continuously from the counter area to the most downstream area.

In the above-mentioned configuration, the electric field strength gradually increases in the order of the counter area, the downstream intermediate area, and the most downstream area.

(2) The developer electric field transport apparatus (the developer supply apparatus) can comprise a plurality of counter electrodes, a counter electrode support member, and a counter electrode cover member.

The counter electrodes are disposed in such a manner as to face the transport electrodes with a predetermined gap therebetween. The plurality of counter electrodes are arrayed along the sub-scanning direction and are configured to be able to transport the developer in the developer transport direction through application of traveling wave voltages thereto.

The counter electrode support member is configured to support the counter electrodes on its surface. The counter electrode support member is disposed in such a manner as to face the transport electrode support member with the gap therebetween.

The counter electrode cover member is formed in such a manner as to cover the counter electrodes and the surface of the counter electrode support member.

The developer electric field transport apparatus (the developer supply apparatus) can further comprise a counter electrode cover intermediate layer. The counter electrode cover intermediate layer is formed between the counter electrode cover member and the counter electrodes.

In the developer electric field transport apparatus (the developer supply apparatus), a counter area neighboring area in proximity to the counter area, and other areas have the following characteristic configurations.

(2-1) The counter electrode cover member can be configured such that relative dielectric constant is lower in those areas which are located upstream of and downstream of the counter area neighboring area with respect to the developer transport direction, than in the counter area neighboring area.

In the above-mentioned configuration, when traveling wave voltages are applied to the counter electrodes, electric field strength in a space in the vicinity of the developer transport surface in which the developer can be transported is higher in the upstream area and the downstream area than in the counter area neighboring area. That is, the electric field strength is lower in the counter area neighboring area than in the upstream area. Also, the electric field strength is higher in the downstream area than in the counter area neighboring area.

Thus, for example, at a transport start position of the developer on the developer transport surface (e.g., a portion of the developer transport surface located most upstream with respect to the developer transport direction), a high acceleration can be imposed on the developer which is almost motionless with respect to the developer transport direction.

Also, for example, the developer which has been accelerated in an area located upstream of the counter area neighboring area can be decelerated in the counter area neighboring area. Thus, in the counter area, non-uniform presence of the developer along the developer transport direction can be effectively restrained.

Also, for example, the developer which has passed the counter area can be accelerated in a downstream direction along which the developer is transported beyond the counter area, by the effect of electric fields higher in strength than those in the counter area neighboring area. Thus, the stagnation of a large amount of the developer in the counter area can be restrained.

Thus, according to the above-mentioned configuration, the state of transport of the developer in the developer transport direction can be appropriately set. Therefore, according to the above-mentioned configuration, the formation of an image in the developer can be carried out in a better fashion.

(2-2) The counter electrode cover member can comprise an upstream intermediate portion. The upstream intermediate portion is provided between a most upstream area and the counter area neighboring area with respect to the developer transport direction. The upstream intermediate portion is configured such that its relative dielectric constant falls between that in the most upstream area and that in the counter area neighboring area.

The counter electrode cover member ranging from the most upstream area to the upstream intermediate portion and then to the counter area neighboring area may be configured such that relative dielectric constant varies stepwise in the order of the most upstream area, the upstream intermediate portion, and the counter area neighboring area. Alternatively, the counter electrode cover member ranging from the most upstream area to the upstream intermediate portion and then to the counter area neighboring area may be configured such that relative dielectric constant varies continuously from the most upstream area to the counter area neighboring area.

In the above-mentioned configuration, the electric field strength gradually lowers in the order of the most upstream area, the upstream intermediate portion, and the counter area neighboring area.

Thus, for example, in the course of transport of the developer from the most upstream area toward the counter area (the counter area neighboring area), the developer can be smoothly decelerated.

(2-3) The counter electrode cover member can comprise a downstream intermediate portion. The downstream intermediate portion is provided between a most downstream area and the counter area neighboring area with respect to the developer transport direction. The downstream intermediate portion is configured such that its relative dielectric constant falls between that in the most downstream area and that in the counter area neighboring area.

The counter electrode cover member ranging from the counter area neighboring area to the downstream intermediate portion and then to the most downstream area may be configured such that relative dielectric constant varies stepwise in the order of the counter area neighboring area, the downstream intermediate portion, and the most downstream area. Alternatively, the counter electrode cover member ranging from the counter area neighboring area to the downstream intermediate portion and then to the most downstream area may be configured such that relative dielectric constant varies continuously from the counter area neighboring area to the most downstream area.

In the above-mentioned configuration, the electric field strength gradually increases in the order of the counter area neighboring area, the downstream intermediate portion, and the most downstream area.

Thus, for example, in the course of transport of the developer from the counter area (the counter area neighboring area) toward the most downstream area, the developer can be smoothly accelerated.

(2-4) The counter electrode cover intermediate layer can be configured such that relative dielectric constant is lower in those areas which are located upstream of and downstream of the counter area neighboring area with respect to the developer transport direction, than in the counter area neighboring area.

In the above-mentioned configuration, when traveling wave voltages are applied to the counter electrodes, the electric field strength is higher in the upstream area and the downstream area than in the counter area neighboring area.

Thus, the state of transport of the developer in the developer transport direction can be appropriately set. Therefore, according to the above-mentioned configuration, the formation of an image in the developer can be carried out in a better fashion.

(2-5) The counter electrode cover intermediate layer can comprise an upstream intermediate portion. The upstream intermediate portion is provided between a most upstream area and the counter area neighboring area with respect to the developer transport direction. The upstream intermediate portion is configured such that its relative dielectric constant falls between that in the most upstream area and that in the counter area neighboring area.

The counter electrode cover intermediate layer ranging from the most upstream area to the upstream intermediate portion and then to the counter area neighboring area may be configured such that relative dielectric constant varies stepwise in the order of the most upstream area, the upstream intermediate portion, and the counter area neighboring area. Alternatively, the counter electrode cover intermediate layer ranging from the most upstream area to the upstream intermediate portion and then to the counter area neighboring area may be configured such that relative dielectric constant varies continuously from the most upstream area to the counter area neighboring area.

In the above-mentioned configuration, the electric field strength gradually lowers in the order of the most upstream area, the upstream intermediate portion, and the counter area neighboring area.

(2-6) The counter electrode cover intermediate layer can comprise a downstream intermediate portion. The downstream intermediate portion is provided between a most downstream area and the counter area neighboring area with respect to the developer transport direction. The downstream intermediate portion is configured such that its relative dielectric constant falls between that in the most downstream area and that in the counter area neighboring area.

The counter electrode cover intermediate layer ranging from the counter area neighboring area to the downstream intermediate portion and then to the most downstream area may be configured such that relative dielectric constant varies stepwise in the order of the counter area neighboring area, the downstream intermediate portion, and the most downstream area. Alternatively, the counter electrode cover intermediate layer ranging from the counter area neighboring area to the downstream intermediate portion and then to the most downstream area may be configured such that relative dielectric constant varies continuously from the counter area neighboring area to the most downstream area.

In the above-mentioned configuration, the electric field strength gradually increases in the order of the counter area neighboring area, the downstream intermediate portion, and the most downstream area.

(2-7) The counter electrode cover member can be configured in such a manner as to be thinner in those areas which are located upstream of and downstream of the counter area neighboring area with respect to the developer transport direction, than in the counter area neighboring area.

In the above-mentioned configuration, when traveling wave voltages are applied to the counter electrodes, the electric field strength is higher in the upstream area and the downstream area than in the counter area neighboring area.

Thus, the state of transport of the developer in the developer transport direction can be appropriately set. Therefore, according to the above-mentioned configuration, the formation of an image in the developer can be carried out in a better fashion.

(2-8) The counter electrode cover member can comprise an upstream intermediate portion. The upstream intermediate portion is provided between a most upstream area and the counter area neighboring area with respect to the developer transport direction. The upstream intermediate portion is configured such that its thickness falls between that in the most upstream area and that in the counter area neighboring area.

The counter electrode cover member ranging from the most upstream area to the upstream intermediate portion and then to the counter area neighboring area may be configured such that thickness varies stepwise in the order of the most upstream area, the upstream intermediate portion, and the counter area neighboring area. Alternatively, the counter electrode cover member ranging from the most upstream area to the upstream intermediate portion and then to the counter area neighboring area may be configured such that thickness varies continuously from the most upstream area to the counter area neighboring area.

In the above-mentioned configuration, the electric field strength gradually lowers in the order of the most upstream area, the upstream intermediate portion, and the counter area neighboring area.

(2-9) The counter electrode cover member can comprise a downstream intermediate portion. The downstream intermediate portion is provided between a most downstream area and the counter area neighboring area with respect to the developer transport direction. The downstream intermediate portion is configured such that its thickness falls between that in the most downstream area and that in the counter area neighboring area.

The counter electrode cover member ranging from the counter area neighboring area to the downstream intermediate portion and then to the most downstream area may be configured such that thickness varies stepwise in the order of the counter area neighboring area, the downstream intermediate portion, and the most downstream area. Alternatively, the counter electrode cover member ranging from the counter area neighboring area to the downstream intermediate portion and then to the most downstream area may be configured such that thickness varies continuously from the counter area neighboring area to the most downstream area.

In the above-mentioned configuration, the electric field strength gradually increases in the order of the counter area neighboring area, the downstream intermediate portion, and the most downstream area.

(2-10) The counter electrode cover intermediate layer can be configured in such a manner as to be thinner in those areas which are located upstream of and downstream of the counter area neighboring area with respect to the developer transport direction, than in the counter area neighboring area.

In the above-mentioned configuration, when traveling wave voltages are applied to the counter electrodes, the electric field strength is higher in the upstream area and the downstream area than in the counter area neighboring area.

Thus, the state of transport of the developer in the developer transport direction can be appropriately set. Therefore, according to the above-mentioned configuration, the formation of an image in the developer can be carried out in a better fashion.

(2-11) The counter electrode cover intermediate layer can comprise an upstream intermediate portion. The upstream intermediate portion is provided between a most upstream area and the counter area neighboring area with respect to the developer transport direction. The upstream intermediate portion is configured such that its thickness falls between that in the most upstream area and that in the counter area neighboring area.

The counter electrode cover intermediate layer ranging from the most upstream area to the upstream intermediate portion and then to the counter area neighboring area may be configured such that thickness varies stepwise in the order of the most upstream area, the upstream intermediate portion, and the counter area neighboring area. Alternatively, the counter electrode cover intermediate layer ranging from the most upstream area to the upstream intermediate portion and then to the counter area neighboring area may be configured such that thickness varies continuously from the most upstream area to the counter area neighboring area.

In the above-mentioned configuration, the electric field strength gradually lowers in the order of the most upstream area, the upstream intermediate portion, and the counter area neighboring area.

(2-12) The counter electrode cover intermediate layer can comprise a downstream intermediate portion. The downstream intermediate portion is provided between a most downstream area and the counter area neighboring area with respect to the developer transport direction. The downstream intermediate portion is configured such that its thickness falls between that in the most downstream area and that in the counter area neighboring area.

The counter electrode cover intermediate layer ranging from the counter area neighboring area to the downstream intermediate portion and then to the most downstream area may be configured such that thickness varies stepwise in the order of the counter area neighboring area, the downstream intermediate portion, and the most downstream area. Alternatively, the counter electrode cover intermediate layer ranging from the counter area neighboring area to the downstream intermediate portion and then to the most downstream area may be configured such that thickness varies continuously from the counter area neighboring area to the most downstream area.

In the above-mentioned configuration, the electric field strength gradually increases in the order of the counter area neighboring area, the downstream intermediate portion, and the most downstream area.

(2-13) In the case where the counter electrode cover intermediate layer is configured in such a manner as to be thinner in those areas which are located upstream of and downstream of the counter area neighboring area with respect to the developer transport direction, than in the counter area neighboring area, the counter electrode cover intermediate layer and the counter electrode cover member can be configured such that a laminate of the counter electrode cover intermediate layer and the counter electrode cover member is formed into the form of a flat plate having a substantially fixed thickness and such that the counter electrode cover member is lower in relative dielectric constant than the counter electrode cover intermediate layer.

In the above-mentioned configuration, the (combined) relative dielectric constant of the laminate of the counter electrode cover member and the counter electrode cover intermediate layer is lower in those areas which are located upstream of and downstream of the counter area neighboring area with respect to the developer transport direction, than in the counter area neighboring area. Thus, when traveling wave voltages are applied to the counter electrodes, the electric field strength can be higher in the upstream area and the downstream area than in the counter area neighboring area.

(2-14) The counter electrodes can be formed in such a manner as to be thicker in those areas which are located upstream of and downstream of the counter area neighboring area with respect to the developer transport direction, than in the counter area neighboring area.

In the above-mentioned configuration, when traveling wave voltages are applied to the counter electrodes, the electric field strength is higher in the upstream area and the downstream area than in the counter area neighboring area.

Thus, the state of transport of the developer in the developer transport direction can be appropriately set. Therefore, according to the above-mentioned configuration, the formation of an image in the developer can be carried out in a better fashion.

(2-15) The counter electrodes can be formed such that the counter electrodes in a most upstream area with respect to the developer transport direction are thicker than the counter electrodes in an upstream intermediate area located between the most upstream area and the counter area neighboring area and such that the counter electrodes in the upstream intermediate area are thicker than the counter electrodes in the counter area neighboring area.

The counter electrodes may be configured such that thickness varies stepwise in the order of the most upstream area, the upstream intermediate area, and the counter area. Alternatively, the counter electrodes may be configured such that thickness varies continuously from the most upstream area to the counter area neighboring area.

In the above-mentioned configuration, the electric field strength gradually lowers in the order of the most upstream area, the upstream intermediate area, and the counter area.

(2-16) The counter electrodes can be formed such that the counter electrodes in a most downstream area with respect to the developer transport direction are thicker than the transport electrodes in a downstream intermediate area located between the most downstream area and the counter area neighboring area and such that the counter electrodes in the downstream intermediate area are thicker than the counter electrodes in the counter area neighboring area.

The counter electrodes may be configured such that thickness varies stepwise in the order of the counter area neighboring area, the downstream intermediate area, and the most downstream area. Alternatively, the counter electrodes may be configured such that thickness varies continuously from the counter area neighboring area to the most downstream area.

In the above-mentioned configuration, the electric field strength gradually increases in the order of the counter area neighboring area, the downstream intermediate area, and the most downstream area.

(3) As mentioned above, the developer electric field transport apparatus (the developer supply apparatus) is configured such that the electric field strength is higher in those areas which are located upstream of and downstream of, with respect to the developer transport direction, the counter area where the developer carrying surface and the transport electrodes face each other (and the counter area neighboring area in proximity to the counter area), than in the counter area (the counter area neighboring area).

In the above-mentioned configuration, when traveling wave voltages are applied to the transport electrodes (and the counter electrodes), electric field strength in a space in the vicinity of the developer transport surface in which the developer can be transported is higher in the upstream area and the downstream area than in the counter area (and the counter area neighboring area).

Thus, for example, electric field strength in a space in the vicinity of the developer transport surface in which the developer can be transported is higher at a transport start position of the developer on the developer transport surface (e.g., a portion of the developer transport surface located most upstream with respect to the developer transport direction), than in the counter area (and the counter area neighboring area). Therefore, at the transport start position, a high acceleration can be imposed on the developer which is almost motionless with respect to the developer transport direction.

Also, for example, the electric field strength is lower in the counter area (and the counter area neighboring area) than in an area located upstream of the counter area (and the counter area neighboring area). Thus, the developer can be decelerated in the counter area. Thus, in the counter area, non-uniform presence of the developer along the developer transport direction can be effectively restrained.

Also, for example, the electric field strength is higher in an area located downstream of the counter area (and the counter area neighboring area) than in the counter area (and the counter area neighboring area). Thus, the developer which has passed the counter area can be accelerated in a downstream direction along which the developer is transported beyond the counter area. Therefore, the stagnation of a large amount of the developer in the counter area can be restrained.

Thus, according to the configuration of the present invention, the state of transport of the developer in the developer transport direction can be appropriately set. Therefore, according to the configuration of the present invention, the formation of an image in the developer can be carried out in a better fashion.

[2] Further improvement of image quality is required of an above-mentioned image forming apparatus. To meet the requirement, variation in transport amount of developer along a width direction (main scanning direction) perpendicular to a predetermined direction must be restrained.

The present invention has been conceived for solving the above-mentioned problem. That is, an object of the invention is to provide a developer electric field transport apparatus in which variation along the width direction (main scanning direction) in the amount of transport of the developer effected by traveling wave electric fields can be restrained, as well as a developer supply apparatus equipped with the developer electric field transport apparatus, and an image forming apparatus equipped with the developer electric field transport apparatus.

(1) An image forming apparatus of the present invention comprises an electrostatic latent image carrying body and a developer supply apparatus.

The electrostatic latent image carrying body has a latent image forming surface. The latent image forming surface is formed in parallel with a predetermined main scanning direction. The latent image forming surface is configured to be able to form an electrostatic latent image thereon by means of electric potential distribution. The electrostatic latent image carrying body is configured such that the latent image forming surface can move along a sub-scanning direction orthogonal to the main scanning direction.

The developer supply apparatus is disposed in such a manner as to face the electrostatic latent image carrying body. The developer supply apparatus is configured to be able to supply a developer in a charged state to the latent image forming surface.

In the image forming apparatus of the present invention, the developer supply apparatus comprises a plurality of transport electrodes, an electrode support member, and an electrode cover member.

The transport electrodes are configured to have their longitudinal direction intersecting with the sub-scanning direction. The transport electrodes are arrayed along the sub-scanning direction. The transport electrodes are configured and disposed so as to be able to transport the developer in a predetermined developer transport direction through application of traveling wave voltages thereto.

The electrode support member is configured to support the transport electrodes. That is, the transport electrodes are supported on a surface of the electrode support member.

The electrode cover member is formed in such a manner as to cover the transport electrodes and the surface of the electrode support member. The electrode cover member has a developer transport surface. The developer transport surface is in parallel with the main scanning direction and faces the latent image forming surface.

In the developer supply apparatus, first portions and second portions are arrayed along the longitudinal direction of the transport electrodes. The first portions and the second portions are configured to differ from each other in structure between the surface of the electrode support member and the developer transport surface.

Specifically, the electrode cover member can be formed such that its relative dielectric constant differs between the first portions and the second portions.

Alternatively, the electrode cover member can be formed such that its thickness differs between the first portions and the second portions.

Alternatively, the image forming apparatus can further comprise an intermediate layer formed between the electrode cover member and the transport electrodes, and the intermediate layer can be formed such that its relative dielectric constant differs between the first portions and the second portions.

Alternatively, the image forming apparatus can further comprise an intermediate layer formed between the transport electrodes and a thin portion of the electrode cover member, and the intermediate layer can differ from the electrode cover member in relative dielectric constant.

Alternatively, the first portions and the second portions can form stripes which are arrayed along the sub-scanning direction as viewed in plane.

Alternatively, the first portions and the second portions can form polygons which are disposed adjacent to one another as viewed in plane.

Alternatively, the first portions and the second portions can form oblique stripes intersecting with the sub-scanning direction as viewed in plane.

Alternatively, the first portions or the second portions can form first stripes and second stripes which intersect with each other as viewed in plane, and the first portions or the second portions which do not form the first stripes and the second stripes can be portions surrounded by the first stripes and the second stripes as viewed in plane.

Alternatively, the first portions and the second portions can be arrayed at random.

Alternatively, portions of the transport electrodes corresponding to the first portions and portions of the transport electrodes corresponding to the second portions can differ in thickness.

Alternatively, the transport electrodes can have projections at positions corresponding to the first portions.

The image forming apparatus of the present invention having the above-mentioned configuration operates to form an image as described below.

The electrostatic latent image is formed on the latent image forming surface of the electrostatic latent image carrying body by means of electric potential distribution. The latent image forming surface on which the electrostatic latent image is formed moves along the sub-scanning direction.

Predetermined traveling wave voltages are applied to the plurality of transport electrodes of the developer transport body provided in the developer supply apparatus. The voltages generate predetermined traveling wave electric fields on the developer transport surface. By the effect of the electric fields, the charged developer moves on the developer transport surface along the developer transport direction.

The latent image forming surface and the developer transport surface are in parallel with the main scanning direction. Thus, in the vicinity of a closest proximity position where the distance between the latent image forming surface and the developer transport surface is the shortest, the latent image forming surface and the developer transport surface can face in parallel with each other. The electrostatic latent image is developed in the vicinity of the closest proximity position with the charged developer which has been transported on the developer transport body.

In the image forming apparatus of the present invention. The first portions and the second portions, which are arrayed along the longitudinal direction of the transport electrodes, differ from each other in structure between the surface of the electrode support member and the developer transport surface. Thus, on the developer transport surface, the condition (strength and/or direction) of the above-mentioned electric fields differs between the first portions and the second portions.

Thus, in the vicinity of boundaries between the first portions and the second portions, the above-mentioned traveling wave electric fields generated on the developer transport surface can involve components directed along the longitudinal direction. Since the longitudinal direction intersects with the sub-scanning direction, the components intersect with the sub-scanning direction. That is, the components can be along the main scanning direction.

Accordingly, on the developer transport surface, the charged developer can also move along the above-mentioned longitudinal direction (the main scanning direction). In other words, on the developer transport surface, the charged developer can move toward the closest proximity position while meandering.

According to the above-mentioned configuration, for example, even when the amount of supply of the developer to a most upstream portion, with respect to the developer transport direction, of the developer transport surface varies due to aggregation of the developer or the like, the above-mentioned meandering of the developer effectively cancels variation in the amount of transport of the developer along a width direction (orthogonal to the developer transport direction and along the longitudinal direction).

Thus, according to the above-mentioned configuration, there can be restrained variation along the main scanning direction in the amount of transport of the developer effected by traveling wave electric fields on the developer transport surface. Accordingly, the charged developer can be supplied to the latent image forming surface in a state in which variation in supply amount along the main scanning direction is restrained to the greatest possible extent. Therefore, for an image in the developer, non-uniform density along the width direction (the main scanning direction) can be restrained to the greatest possible extent.

(2) A developer supply apparatus of the present invention is configured to be able to supply a developer in a charged state to a developer carrying surface of a developer carrying body.

The developer carrying body can be disposed in such a manner as to face the developer supply apparatus. The developer carrying body has the developer carrying surface.

The developer carrying surface is in parallel with a predetermined main scanning direction and can carry the developer thereon. The developer carrying surface can move along a sub-scanning direction orthogonal to the main scanning direction.

Specifically, for example, an electrostatic latent image carrying body configured to be able to form an electrostatic latent image thereon by means of electric potential distribution can be used as the developer carrying body. In this case, the developer carrying surface assumes the form of a latent image forming surface. The latent image forming surface is a circumferential surface of the electrostatic latent image carrying body. The latent image forming surface is configured to be able to form the electrostatic latent image thereon.

Alternatively, the developer carrying body can be, for example, a recording medium (paper or the like) which is transported along the sub-scanning direction. In this case, the developer carrying surface is implemented by the surface (recording surface) of the recording medium.

Alternatively, the developer carrying body can be, for example, a roller, a sleeve, or a belt member (a developing roller, a developing sleeve, an intermediate transfer belt, etc.). These members are disposed, for example, in such a manner as to face the recording medium or the electrostatic latent image carrying body. These members are configured and disposed so as to be able to transfer the developer onto the recording medium or the electrostatic latent image carrying body.

The developer supply apparatus of the present invention comprises a plurality of transport electrodes, an electrode support member, and an electrode cover member.

The transport electrodes are configured to have their longitudinal direction intersecting with the sub-scanning direction. The transport electrodes are arrayed along the sub-scanning direction. The transport electrodes are configured and disposed so as to be able to transport the developer in a predetermined developer transport direction through application of traveling wave voltages thereto.

The electrode support member is configured to support the transport electrodes. That is, the transport electrodes are supported on a surface of the electrode support member.

The electrode cover member is formed in such a manner as to cover the transport electrodes and the surface of the electrode support member. The electrode cover member has a developer transport surface. The developer transport surface is in parallel with the main scanning direction and faces the developer carrying surface.

In the developer supply apparatus, first portions and second portions are arrayed along the longitudinal direction of the transport electrodes. The first portions and the second portions are configured to differ from each other in structure between the surface of the electrode support member and the developer transport surface.

Specifically, the electrode cover member can be formed such that its relative dielectric constant differs between the first portions and the second portions.

Alternatively, the electrode cover member can be formed such that its thickness differs between the first portions and the second portions.

Alternatively, the developer supply apparatus can further comprise an intermediate layer formed between the electrode cover member and the transport electrodes, and the intermediate layer can be formed such that its relative dielectric constant differs between the first portions and the second portions.

Alternatively, the developer supply apparatus can further comprise an intermediate layer formed between the transport electrodes and a thin portion of the electrode cover member, and the intermediate layer can differ from the electrode cover member in relative dielectric constant.

Alternatively, the first portions and the second portions can form stripes which are arrayed along the sub-scanning direction as viewed in plane.

Alternatively, the first portions and the second portions can form polygons which are disposed adjacent to one another as viewed in plane.

Alternatively, the first portions and the second portions can form oblique stripes intersecting with the sub-scanning direction as viewed in plane.

Alternatively, the first portions or the second portions can form first stripes and second stripes which intersect with each other as viewed in plane, and the first portions or the second portions which do not form the first stripes and the second stripes can be portions surrounded by the first stripes and the second stripes as viewed in plane.

Alternatively, the first portions and the second portions can be arrayed at random.

Alternatively, portions of the transport electrodes corresponding to the first portions and portions of the transport electrodes corresponding to the second portions can differ in thickness.

Alternatively, the transport electrodes can have projections at positions corresponding to the first portions.

The developer supply apparatus of the present invention having the above-mentioned configuration operates as described below in formation of an image.

The developer transport surface of the developer transport body of the developer supply apparatus and the developer carrying surface of the developer carrying body (which is disposed in such a manner as to face the developer supply apparatus) are in parallel with the main scanning direction.

Thus, in the vicinity of a closest proximity position where the distance between the developer carrying surface and the developer transport surface is the shortest, the developer carrying surface and the developer transport surface can face in parallel with each other.

The developer carrying surface of the developer carrying body moves along the sub-scanning direction. Meanwhile, on the developer transport surface of the developer transport body, the charged developer is transported along the developer transport direction.

Thus, in the vicinity of the closest proximity position, the charged developer is supplied onto the developer carrying surface. Accordingly, the charged developer can be carried on the developer carrying surface.

The above-mentioned transport of the charged developer on the developer carrying surface is carried out as follows.

Predetermined traveling wave voltages are applied to the plurality of transport electrodes of the developer transport body. The voltages generate predetermined traveling wave electric fields on the developer transport surface. By the effect of the electric fields, the charged developer moves on the developer transport surface along the developer transport direction.

In the developer supply apparatus of the present invention, the first portions and the second portions, which are arrayed along the longitudinal direction of the transport electrodes, differ from each other in structure between the surface of the electrode support member and the developer transport surface. Thus, on the developer transport surface, the condition (strength and/or direction) of the above-mentioned electric fields differs between the first portions and the second portions.

Thus, in the vicinity of boundaries between the first portions and the second portions, the above-mentioned traveling wave electric fields generated on the developer transport surface can involve components directed along the longitudinal direction; i.e., components directed along the main scanning direction. Accordingly, on the developer transport surface, the charged developer can also move along the above-mentioned longitudinal direction (the main scanning direction). In other words, on the developer transport surface, the charged developer can move toward the closest proximity position while meandering.

According to the above-mentioned configuration, on the developer transport surface, variation in the amount of transport of the developer along the main scanning direction effected by the traveling wave electric fields can be restrained. Accordingly, the charged developer can be supplied to the developer carrying surface in a state in which variation in supply amount along the main scanning direction is restrained to the greatest possible extent.

(3) A developer electric field transport apparatus of the present invention is configured to be able to transport a charged developer along a predetermined developer transport direction by the effect of electric fields. The developer electric field transport apparatus is disposed in such a manner as to face a developer carrying body.

The developer carrying body has a developer carrying surface. The developer carrying surface is a surface of the developer carrying body and can carry the developer thereon. The developer carrying surface is formed in parallel with a predetermined main scanning direction.

The developer carrying surface can move along a predetermined moving direction. The moving direction can be set parallel to a sub-scanning direction orthogonal to the main scanning direction.

Specifically, for example, an electrostatic latent image carrying body configured to be able to form an electrostatic latent image thereon by means of electric potential distribution can be used as the developer carrying body. In this case, the developer carrying surface assumes the form of a latent image forming surface. The latent image forming surface is a circumferential surface of the electrostatic latent image carrying body and is a surface on which the electrostatic latent image is formed.

Alternatively, the developer carrying body can be, for example, a recording medium (paper or the like) which is transported along the sub-scanning direction. In this case, the developer carrying surface is implemented by the surface (recording surface) of the recording medium.

Alternatively, the developer carrying body can be, for example, a roller, a sleeve, or a belt member (a developing roller, a developing sleeve, an intermediate transfer belt, etc.). These members are disposed in such a manner as to face the recording medium, the electrostatic latent image carrying body, or the like. These members are configured and disposed so as to be able to transfer the developer onto the recording medium or the electrostatic latent image carrying body.

The developer electric field transport apparatus of the present invention comprises a plurality of transport electrodes, an electrode support member, and an electrode cover member.

The transport electrodes are configured to have their longitudinal direction intersecting with the sub-scanning direction. The transport electrodes are arrayed along the sub-scanning direction. The transport electrodes are configured and disposed so as to be able to transport the developer in a predetermined developer transport direction through application of traveling wave voltages thereto.

The electrode support member is configured to support the transport electrodes. That is, the transport electrodes are supported on a surface of the electrode support member.

The electrode cover member is formed in such a manner as to cover the transport electrodes and the surface of the electrode support member. The electrode cover member has a developer transport surface. The developer transport surface is in parallel with the main scanning direction and faces the developer carrying surface.

In the developer electric field transport apparatus, first portions and second portions are arrayed along the longitudinal direction of the transport electrodes. The first portions and the second portions are configured to differ from each other in structure between the surface of the electrode support member and the developer transport surface.

Specifically, the electrode cover member can be formed such that its relative dielectric constant differs between the first portions and the second portions.

Alternatively, the electrode cover member can be formed such that its thickness differs between the first portions and the second portions.

Alternatively, the developer electric field transport apparatus can further comprise an intermediate layer formed between the electrode cover member and the transport electrodes, and the intermediate layer can be formed such that its relative dielectric constant differs between the first portions and the second portions.

Alternatively, the developer electric field transport apparatus can further comprise an intermediate layer formed between the transport electrodes and a thin portion of the electrode cover member, and the intermediate layer can differ from the electrode cover member in relative dielectric constant.

Alternatively, the first portions and the second portions can form stripes which are arrayed along the sub-scanning direction as viewed in plane.

Alternatively, the first portions and the second portions can form polygons which are disposed adjacent to one another as viewed in plane.

Alternatively, the first portions and the second portions can form oblique stripes intersecting with the sub-scanning direction as viewed in plane.

Alternatively, the first portions or the second portions can form first stripes and second stripes which intersect with each other as viewed in plane, and the first portions or the second portions which do not form the first stripes and the second stripes can be portions surrounded by the first stripes and the second stripes as viewed in plane.

Alternatively, the first portions and the second portions can be arrayed at random.

Alternatively, portions of the transport electrodes corresponding to the first portions and portions of the transport electrodes corresponding to the second portions can differ in thickness.

Alternatively, the transport electrodes can have projections at positions corresponding to the first portions.

The developer electric field transport apparatus of the present invention having the above-mentioned configuration operates as described below in formation of an image.

The developer transport surface of the developer electric field transport apparatus and the developer carrying surface of the developer carrying body, which is disposed in such a manner as to face the developer electric field transport apparatus, are in parallel with the main scanning direction.

Thus, in the vicinity of a closest proximity position where the distance between the developer electric field transport apparatus and the developer carrying body (the distance between the developer carrying surface and the developer transport surface) is the shortest, the developer carrying surface and the developer transport surface can face in parallel with each other.

The developer carrying surface of the developer carrying body moves along the sub-scanning direction. Meanwhile, on the developer transport surface of the developer transport body of the developer electric field transport body, the charged developer is transported along the developer transport direction.

Thus, in the vicinity of the closest proximity position, the charged developer is supplied onto the developer carrying surface of the developer carrying body from the developer transport surface of the developer electric field transport apparatus. Accordingly, the charged developer can be carried on the developer carrying surface.

The above-mentioned transport of the charged developer on the developer carrying surface is carried out as follows.

Predetermined traveling wave voltages are applied to the plurality of transport electrodes of the developer transport body. The voltages generate predetermined traveling wave electric fields on the developer transport surface. By the effect of the electric fields, the charged developer moves on the developer transport surface along the developer transport direction.

In the developer electric field transport apparatus of the present invention, the first portions and the second portions, which are arrayed along the longitudinal direction of the transport electrodes, differ from each other in structure between the surface of the electrode support member and the developer transport surface. Thus, on the developer transport surface, the condition (strength and/or direction) of the above-mentioned electric fields differs between the first portions and the second portions.

Thus, in the vicinity of boundaries between the first portions and the second portions, the above-mentioned traveling wave electric fields generated on the developer transport surface can involve components directed along the longitudinal direction; i.e., components directed along the main scanning direction. Accordingly, on the developer transport surface, the charged developer can move also along the developer transport direction (toward the closest proximity position) while meandering.

According to the above-mentioned configuration, on the developer transport surface, variation in the amount of transport of the developer along the main scanning direction effected by the traveling wave electric fields can be restrained.

BEST MODE FOR CARRYING OUT THE INVENTION

Modes for carrying out the present invention (modes which the applicant contemplated as the best at the time of filing the present application) will next be described with reference to the drawings.

[1] First, a first mode for carrying out the present invention will be described.

<Overall Configuration of Laser Printer>

Figure 1:
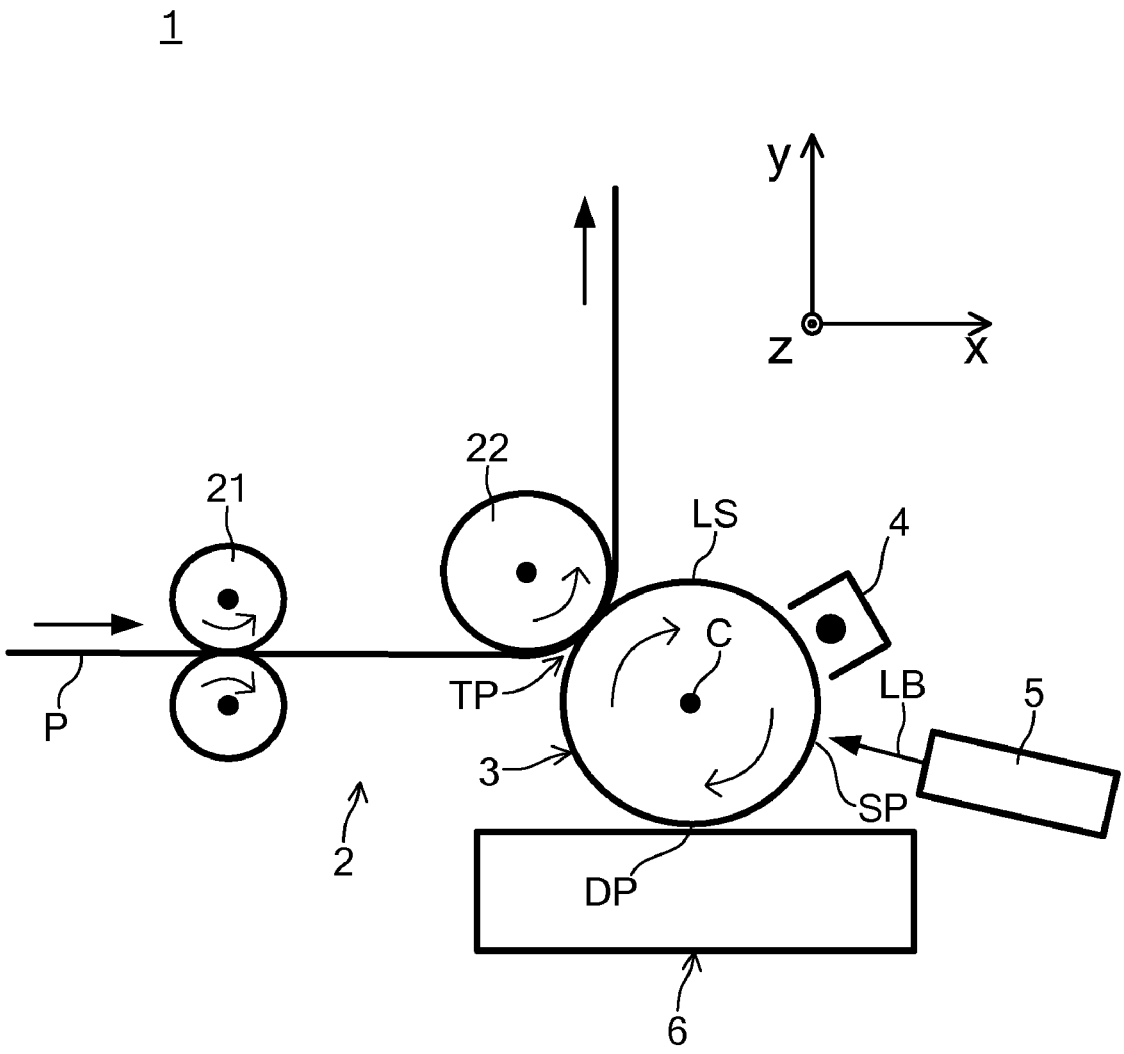
FIG. 1 is a side sectional view showing the schematic configuration of a laser printer which is an image forming apparatus according to a mode for carrying out the present invention.

FIG. 1 is a side sectional view showing the schematic configuration of a laser printer 1, which is an image forming apparatus according to a mode for carrying out the present invention.

Referring to FIG. 1, the laser printer 1 includes a paper transport mechanism 2, a photoconductor drum 3, a charger 4, a scanner unit 5, and a toner supply apparatus 6.

An unillustrated paper feed tray provided in the laser printer 1 contains sheets of paper P in a stacked state. The paper transport mechanism 2 is configured to be able to transport the paper P along a predetermined paper transport path.

A latent image forming surface LS, which serves as a latent image forming surface (developer carrying surface) of the present invention, is formed on the circumferential surface of the photoconductor drum 3, which serves as an electrostatic latent image carrying body (developer carrying body) of the present invention.

The latent image forming surface LS assumes the form of a cylindrical surface parallel to a main scanning direction (z-axis direction in FIG. 1). The latent image forming surface LS is configured to be able to form an electrostatic latent image thereon by means of electric potential distribution.

The photoconductor drum 3 is configured to be able to be rotatably driven about a center axis C in a direction indicated by the arrow of FIG. 1 (clockwise in FIG. 1). That is, the photoconductor drum 3 is configured such that the latent image forming surface LS can move along a predetermined moving direction; i.e., along a sub-scanning direction orthogonal to the main scanning direction.

Notably, the "sub-scanning direction" is an arbitrary direction orthogonal to the main scanning direction. Usually, the sub-scanning direction can be a direction which intersects with a vertical direction. That is, the sub-scanning direction can be a direction along a front-rear direction of the laser printer 1 (a direction orthogonal to a paper width direction and to a height direction; i.e., x-axis direction in FIG. 1).

The charger 4 is disposed in such a manner as to face the latent image forming surface LS. The charger 4 is a corotron-type or scorotron-type charger and is configured to be able to uniformly, positively charge the latent image forming surface LS.

The scanner unit 5 is configured to generate a laser beam LB which is modulated according to image data. That is, the scanner unit 5 is configured to generate the laser beam LB of a predetermined wavelength band such that light emission goes ON/OFF according to presence/absence of a pixel.

Also, the scanner unit 5 is configured to focus the generated laser beam LB to a scanning position SP on the latent image forming surface LS (to expose the scanning position SP to the laser beam LB). The scanning position SP is located downstream of the charger 4 with respect to the rotational direction of the photoconductor drum 3 (a direction indicated by the arrow of FIG. 1; i.e., clockwise in FIG. 1).

Furthermore, the scanner unit 5 is configured to be able to form an electrostatic latent image on the latent image forming surface LS by means of moving a position on the latent image forming surface LS where the laser beam LB is focused, at a uniform velocity along the main scanning direction (by means of scanning).

The toner supply apparatus 6, which serves as a developer supply apparatus of the present invention, is disposed in such a manner as to face the photoconductor drum 3. The toner supply apparatus 6 is configured to be able to supply the latent image forming surface LS a toner, which serves as a dry developer to be described later, at a developing position DP. A detailed configuration of the toner supply apparatus 6 will be described later.

<Configurations of Component Sections of Laser Printer>

Next, specific configurations of component sections of the laser printer 1 will be described.

<<Paper Transport Mechanism>>

The paper transport mechanism 2 includes a pair of resist rollers 21 and a transfer roller 22.

The resist rollers 21 are configured to be able to send out the paper P at a predetermined timing toward a gap between the photoconductor drum 3 and the transfer roller 22.

The transfer roller 22 is disposed in such a manner as to face the latent image forming surface LS, which is the outer circumferential surface of the photoconductor drum 3, in a transfer position TP with the paper P nipped therebetween. Also, the transfer roller 22 is configured to be able to be rotatably driven in a direction indicated by the arrow of FIG. 1 (counterclockwise).

The transfer roller 22 is connected to an unillustrated bias power circuit. That is, a predetermined transfer bias voltage is applied between the transfer roller 22 and the photoconductor drum 3 for transferring the toner (developer) adhering to the latent image forming surface LS, onto the paper P.

$20

<<Photoconductor Drum>>

Figure 2:
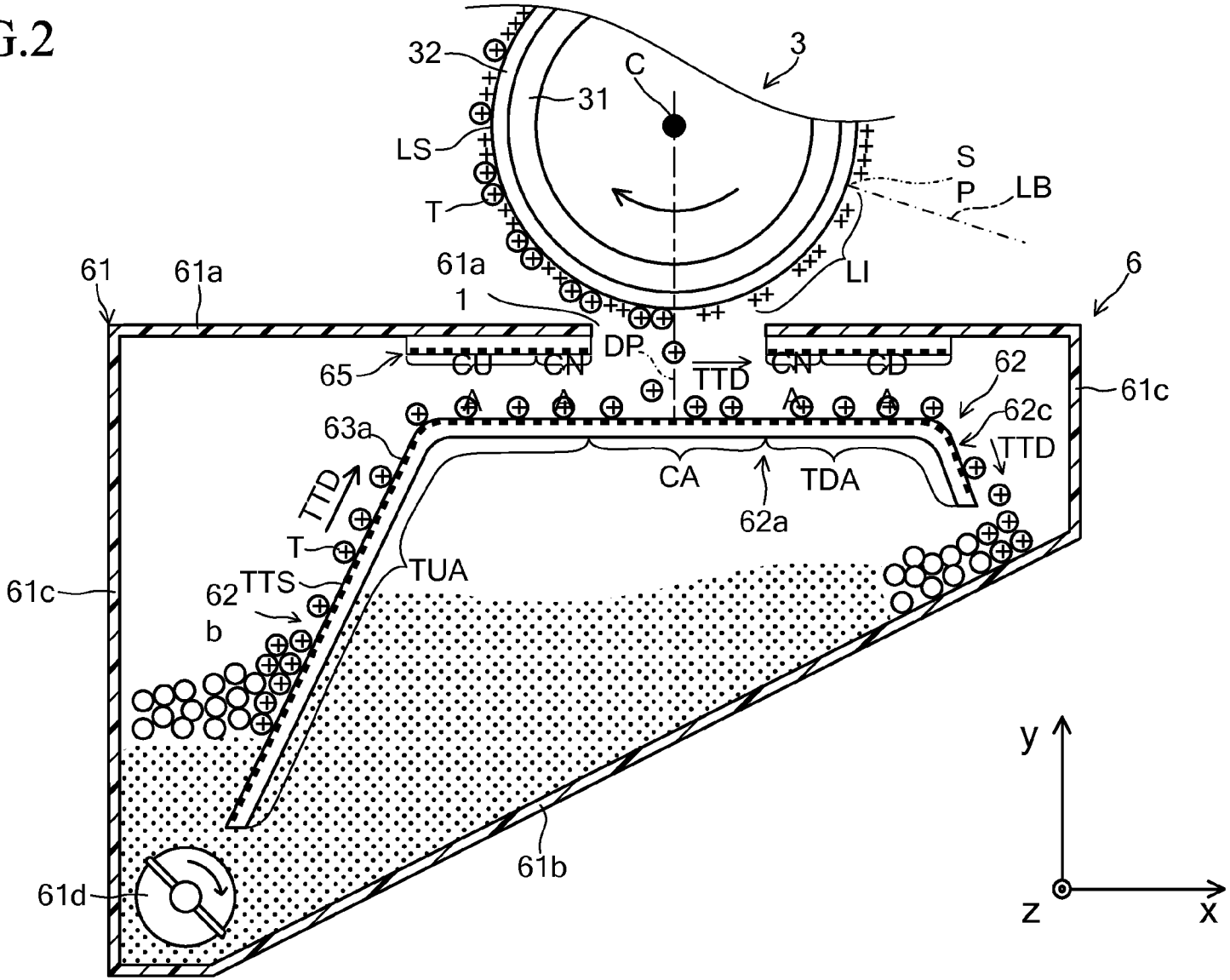
FIG. 2 is a side sectional view showing, on an enlarged scale, a region where a photoconductor drum and a toner supply apparatus in the first mode of the laser printer shown in FIG. 1 face each other.

FIG. 2 is a side sectional view showing, on an enlarged scale, a region where the photoconductor drum 3 and the toner supply apparatus 6 shown in FIG. 1 face each other.

Referring to FIG. 2, the photoconductor drum 3 includes a drum body 31 and a photoconductive layer 32.

The drum body 31 is a cylindrical member having the center axis C parallel to the z-axis and is formed of aluminum or the like. The drum body 31 is grounded.

The photoconductive layer 32 is provided in such a manner as to cover the outer circumferential surface of the drum body 31. The photoconductive layer 32 is a positively chargeable photoconductive layer which becomes photoconductive upon exposure to a laser beam having a predetermined wavelength.

The latent image forming surface LS is formed of the outer circumferential surface of the photoconductive layer 32. That is, the latent image forming surface LS (photoconductive layer 32) is configured such that, after being uniformly, positively charged by the charger 4 (see FIG. 1), the latent image forming surface LS is subjected to scanning by the laser beam LB at the scanning position SP, whereby an electrostatic latent image LI in the form of a pattern of positive charges is formed thereon.

<<Schematic Configuration of Toner Supply Apparatus>>

Referring to FIG. 2, a toner box 61, which serves as the casing of the toner supply apparatus 6, is a box-like member and is configured to be able to contain therein a toner T, which is a particulate dry developer. In the present mode, the toner T is a positively chargeable, non-magnetic one-component, black toner.

A top plate 61*a* of the toner box 61 is disposed in the vicinity of the photoconductor drum 3. The top plate 61*a* is a rectangular plate-like member as viewed in plane and is disposed in parallel with a horizontal plane.

The top plate 61*a* has a toner passage hole 61*a*1, which is a through-hole for allowing the toner T to move from the inside of the toner box 61 toward the photoconductive layer 32 along a y-axis direction in FIG. 2. As viewed in plane, the toner passage hole 61*a*1 assumes the form of a rectangle whose long sides have substantially the same length as the width of the photoconductive layer 32 along the main scanning direction (z-axis direction in FIG. 2) and whose short sides are in parallel with the sub-scanning direction (x-axis direction in FIG. 2).

The toner passage hole 61*a*1 is provided in the vicinity of a position where the top plate 61*a* and the photoconductive layer 32 are in the closest proximity to each other. The toner passage hole 61*a*1 is formed such that its center with respect to the sub-scanning direction (x-axis direction in FIG. 2) substantially coincides with the developing position DP.

A bottom plate 61*b* of the toner box 61 is a rectangular plate-like member as viewed in plane and is disposed under the top plate 61*a*. The bottom plate 61*b* is disposed in such an inclined manner as to rise in the y-axis direction with distance along the x-axis direction in FIG. 2.

Four side edges of each of the top plate 61*a* and the bottom plate 61*b* are surrounded by four side plates 61*c* (FIG. 2 shows only two side plates 61*c*). Upper ends and lower ends of the four side plates 61*c* are integrally connected to the top plate 61*a* and the bottom plate 61*b*, respectively, whereby the toner box 61 can contain the toner T in such a manner as not to allow leakage of the toner T to the exterior thereof.

A toner stirrer 61*d* is provided in a deepest portion of the toner box 61. The toner stirrer 61*d* is configured to be able to impart fluidity like that of fluid to aggregates of the toner T stored within the toner box 61 by means of stirring the toner T (the toner T before being transported in a predetermined toner transport direction TTD to be described later).

In the present mode, the toner stirrer 61*d* is formed of a rotary member resembling a vane wheel and rotatably supported by the pair of side plates 61*c* of the toner box 61.

<<Configuration of Toner Electric Field Transport Body>>

The toner box 61 houses a toner electric field transport body 62, which serves as a developer electric field transport apparatus provided in a developer supply apparatus of the present invention.

The toner electric field transport body 62 has a toner transport surface TTS. The toner transport surface TTS, which serves as a developer transport surface of the present invention, is formed in parallel with the main scanning direction (z-axis direction in FIG. 2).

The toner electric field transport body 62 is disposed such that the toner transport surface TTS and the latent image forming surface LS face in the closest proximity to each other at the developing position DP. That is, the toner electric field transport body 62 is disposed such that a closest proximity position where the toner transport surface TTS and the latent image forming surface LS are in the closest proximity to each other coincides with the developing position DP.

The toner electric field transport body 62 is a plate-like member having a predetermined thickness. The toner electric field transport body 62 is configured to be able to transport the positively charged toner T on the toner transport surface TTS in the predetermined toner transport direction TTD. The toner transport direction TTD is parallel to the toner transport surface TTS and is perpendicular to the main scanning direction (z-axis direction in FIG. 2). That is, the toner transport direction TTD is a direction along the sub-scanning direction (x-axis direction in FIG. 2).

The toner electric field transport body 62 includes a central component portion 62*a*, an upstream component portion 62*b*, and a downstream component portion 62*c*.

As viewed in plane, the central component portion 62*a* assumes substantially the form of a rectangle whose long sides is substantially the same as the width of the photoconductor drum 3 along the main scanning direction and whose short sides are longer than the diameter of the photoconductor drum 3. The central component portion 62*a* is provided at a position where its center with respect to the sub-scanning direction (x-axis direction in FIG. 2) coincides with the center of the toner passage hole 61*a*1 with respect to the sub-scanning direction. That is, the central component portion 62*a* is disposed substantially in parallel with the top plate 61*a* in such a manner as to face the latent image forming surface LS with the toner passage hole 61*a*1 therebetween.

The upstream component portion 62*b* extends upstream and obliquely downward with respect to the toner transport direction TTD from an upstream end portion of the central component portion 62*a* with respect to the toner transport direction TTD. That is, the upstream component portion 62*b* is a plate-like member disposed in such a manner as to obliquely rise toward the central component portion 62*a*.

A lower end portion of the upstream component portion 62*b* is provided in the vicinity of the toner stirrer 61*d*. That is, the upstream component portion 62*b* is provided such that its most upstream end portion with respect to the toner transport direction TTD reaches the vicinity of a deepest portion of the toner box 61, whereby, even in the case of a small amount of the toner T, a portion (a lower end portion) of the upstream component portion 62*b* is buried in the toner T.

The downstream component portion 62*c* extends downstream and obliquely downward from a downstream end portion of the central component portion 62*a* with respect to the toner transport direction TTD. That is, the downstream component portion 62*c* is a plate-like member disposed in such a manner as to obliquely lower with distance from the central component portion 62*a*.

A lower end portion of the downstream component portion 62*c* is provided in the proximity of the bottom plate 61*b* of the toner box 61. That is, the downstream component portion 62*c* is provided such that its most downstream end portion with respect to the toner transport direction TTD reaches the vicinity of the bottom plate 61*b* of the toner box 61, whereby the toner T can smoothly return to the bottom plate 61*b*.

First Embodiment of Toner Supply Apparatus

The configuration of a first embodiment of the present invention will next be described with reference to FIGS. 3 to 12.

Figure 3:
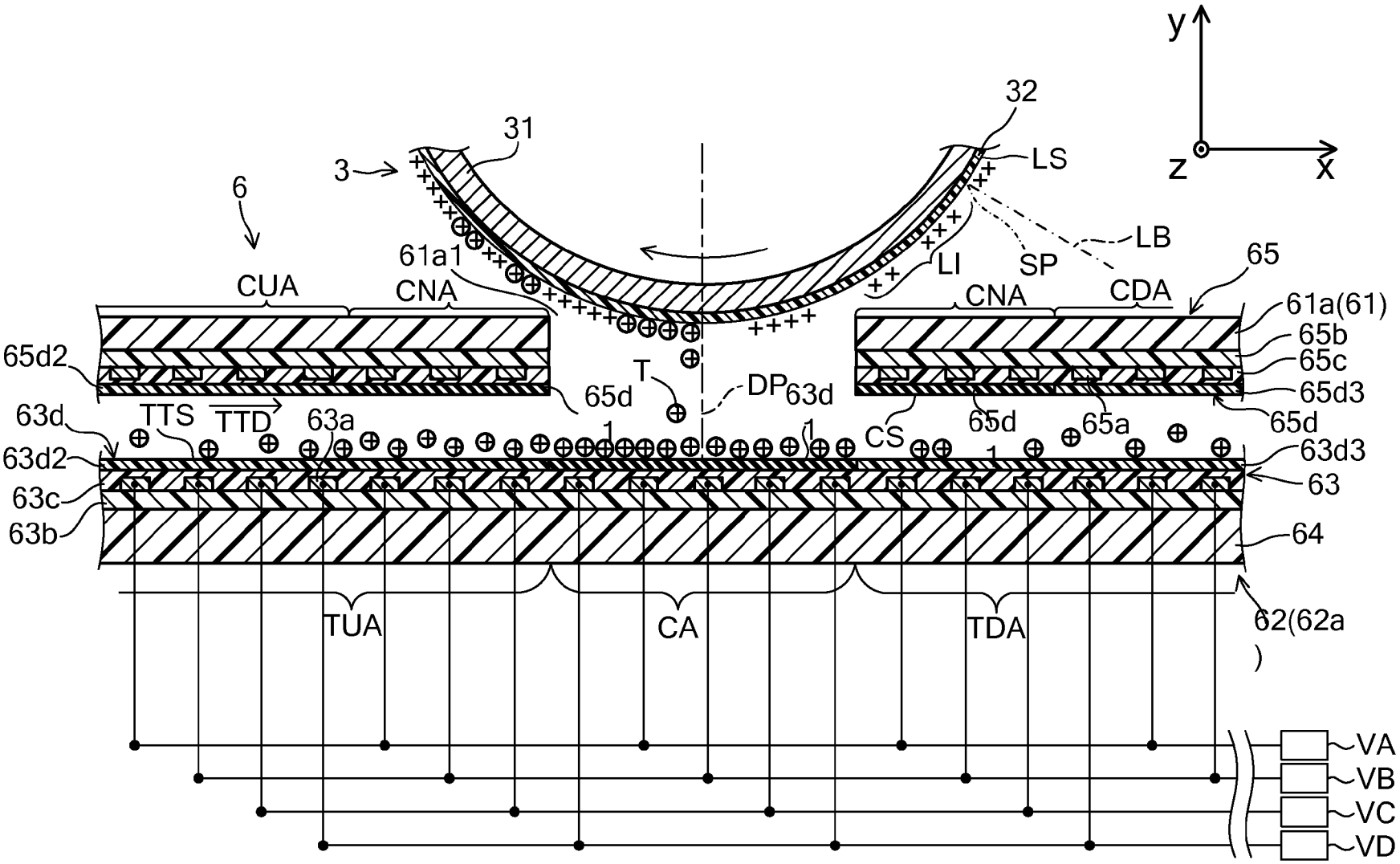
FIG. 3 is a side sectional view showing, on an enlarged scale, the periphery of a developing position in a first embodiment of the toner supply apparatus shown in FIG. 2.

FIG. 3 is a side sectional view showing, on an enlarged scale, the periphery of the developing position DP in the first embodiment of the toner supply apparatus 6 shown in FIG. 2.

<<Transport Wiring Substrate>>

Referring to FIG. 3, the toner electric field transport body 62 includes a transport wiring substrate 63. The transport wiring substrate 63 is disposed in such a manner as to face the latent image forming surface LS with the top plate 61*a* and the toner passage hole 61*a*1 of the toner box 61 therebetween.

As described below, the transport wiring substrate 63 has a configuration similar to that of a flexible printed wiring substrate.

A plurality of transport electrodes 63*a* are in the form of a linear wiring pattern whose longitudinal direction is in parallel with the main scanning direction (the longitudinal direction is orthogonal to the sub-scanning direction). Specifically, the transport electrodes 63*a* are formed of a copper foil having a thickness of several tens of micrometers. The plurality of transport electrodes 63*a* are disposed in parallel with one another. The transport electrodes 63*a* are arrayed along the sub-scanning direction.

Also, the transport electrodes 63*a* are disposed along the toner transport surface TTS. That is, the transport electrodes 63*a* are disposed in the vicinity of the toner transport surface TTS.

A large number of the transport electrodes 63*a* arrayed along the sub-scanning direction are connected to power circuits such that every fourth transport electrode 63*a* is connected to the same power circuit.

Specifically, the transport electrode 63*a* connected to a power circuit VA, the transport electrode 63*a* connected to a power circuit VB, the transport electrode 63*a* connected to a power circuit VC, the transport electrode 63*a* connected to a power circuit VD, the transport electrode 63*a* connected to the power circuit VA, the transport electrode 63*a* connected to the power circuit VB, the transport electrode 63*a* connected to the power circuit VC . . . are sequentially arrayed along the sub-scanning direction.

The power circuits VA to VD are configured to be able to output AC voltages (transport voltages) of substantially the same waveform. Also, the power circuits VA to VD are configured such that the waveforms of voltages generated by the power circuits VA to VD shift 90° in phase from one another. That is, in the sequence of the power circuits VA to VD, the phase of voltage delays in increments of 90°.

The transport electrodes 63*a* are formed on the surface of a transport electrode support film 63*b*, which serves as a transport electrode support member of the present invention. The transport electrode support film 63*b* is a flexible film and is formed of an electrically insulative synthetic resin, such as polyimide resin.

A transport electrode coating layer 63*c*, which serves as a transport electrode cover intermediate layer of the present invention, is formed of an electrically insulative synthetic resin. The transport electrode coating layer 63*c* is provided in such a manner as to cover the transport electrodes 63*a* and the surface of the transport electrode support film 63*b* on which the transport electrodes 63*a* are provided.

A transport electrode overcoating layer 63*d*, which serves as a transport electrode cover member of the present invention, is provided on the transport electrode coating layer 63*c*. In other words, the above-mentioned transport electrode coating layer 63*c* is formed between the transport electrode overcoating layer 63*d* and the transport electrodes 63*a*.

The above-mentioned toner transport surface TTS is implemented by the surface of the transport electrode overcoating layer 63*d* and is formed as a smooth surface with much less pits and projections.

In the present embodiment, the transport electrode overcoating layer 63*d* includes a high relative dielectric constant portion 63*d*1, an upstream low relative dielectric constant portion 63*d*2, and a downstream low relative dielectric constant portion 63*d*3.

The high relative dielectric constant portion 63*d*1 is provided at a position corresponding to a counter area CA. The counter area CA is an area of the toner electric field transport body 62 where the latent image forming surface LS and the toner transport surface TTS face each other with the toner passage hole 61*a*1 therebetween. That is, the counter area CA is an area corresponding to the toner passage hole 61*a*1 (an area located just under the toner passage hole 61*a*1).

The upstream low relative dielectric constant portion 63*d*2 is provided at a position corresponding to an upstream area TUA. The upstream area TUA is an area of the toner electric field transport body 62 located upstream of the counter area CA with respect to the toner transport direction TTD. The upstream low relative dielectric constant portion 63*d*2 is formed of a material lower in relative dielectric constant than the high relative dielectric constant portion 63*d*1.

The downstream low relative dielectric constant portion 63*d*3 is provided at a position corresponding to a downstream area TDA. The downstream area TDA is an area of the toner electric field transport body 62 located downstream of the counter area CA with respect to the toner transport direction TTD. The downstream low relative dielectric constant portion 63*d*3 is formed of a material lower in relative dielectric constant than the high relative dielectric constant portion 63*d*1.

That is, the transport electrode overcoating layer 63*d* is formed such that the upstream area TUA and the downstream area TDA are lower in relative dielectric constant than the counter area CA.

The toner electric field transport body 62 also includes a transport substrate support member 64. The transport substrate support member 64 is formed of a plate material of a synthetic resin and is provided so as to support the transport wiring substrate 63 from underneath.

In summary, the toner electric field transport body 62 is configured as follows: the above-mentioned transport voltages are applied to the transport electrodes 63*a* of the transport wiring substrate 63 so as to generate traveling wave electric fields along the sub-scanning direction, whereby the positively charged toner T can be transported in the toner transport direction TTD.

<<Counter Wiring Substrate>>

Referring to FIG. 3, a counter wiring substrate 65 is attached to the inner surface (a surface which faces a space where the toner T is contained) of the top plate 61*a* of the toner box 61. The counter wiring substrate 65 is disposed in such a manner as to face the toner transport surface TTS with a predetermined gap therebetween.

The counter wiring substrate 65 has a configuration similar to that of the above-mentioned transport wiring substrate 63.

Specifically, the counter wiring substrate 65 has a counter wiring substrate surface CS parallel to the main scanning direction. The counter wiring substrate surface CS is provided in such a manner as to face the toner transport surface TTS with a predetermined gap therebetween.

A large number of counter electrodes 65*a* are provided along the counter wiring substrate surface CS. That is, the counter electrodes 65*a* are disposed in the vicinity of the counter wiring substrate surface CS.

The plurality of counter electrodes 65*a* are in the form of a linear wiring pattern whose longitudinal direction is in parallel with the main scanning direction (the longitudinal direction is orthogonal to the sub-scanning direction). Specifically, the counter electrodes 65*a* are formed of a copper foil having a thickness of several tens of micrometers. The plurality of counter electrodes 65*a* are disposed in parallel with one another. The counter electrodes 65*a* are arrayed along the sub-scanning direction.

A large number of the counter electrodes 65*a* arrayed along the sub-scanning direction are connected to power circuits such that every fourth counter electrode 65*a* is connected to the same power circuit.

The counter electrodes 65*a* are formed on the surface of a counter electrode support film 65*b*, which serves as a counter electrode support member of the present invention. The counter electrode support film 65*b* is a flexible film and is formed of an electrically insulative synthetic resin, such as polyimide resin.

A counter electrode coating layer 65*c*, which serves as a counter electrode cover intermediate layer of the present invention, is formed of an electrically insulative synthetic resin. The counter electrode coating layer 65*c* is provided in such a manner as to cover the counter electrodes 65*a* and the surface of the counter electrode support film 65*b* on which the counter electrodes 65*a* are provided.

A counter electrode overcoating layer 65*d*, which serves as a counter electrode cover member of the present invention, is provided on the counter electrode coating layer 65*c*. In other words, the above-mentioned counter electrode coating layer 65*c* is formed between the counter electrode overcoating layer 65*d* and the counter electrodes 65*a*.

The above-mentioned counter wiring substrate surface CS is implemented by the surface of the counter electrode overcoating layer 65*d* and is formed as a smooth surface with much less pits and projections.

In the present embodiment, the counter electrode overcoating layer 65*d* includes a high relative dielectric constant portion 65*d*1, an upstream low relative dielectric constant portion 65*d*2, and a downstream low relative dielectric constant portion 65*d*3.

The high relative dielectric constant portion 65*d*1 is provided at a position corresponding to a counter area neighboring area CNA. The counter area neighboring area CNA is an area of the counter wiring substrate 65 in the vicinity of the toner passage hole 61*a*1. That is, the counter area neighboring area CNA is an area of the counter wiring substrate 65 in the vicinity of the counter area CA of the toner electric field transport body 62 (transport wiring substrate 63).

The upstream low relative dielectric constant portion 65*d*2 is provided at a position corresponding to an upstream area CUA. The upstream area CUA is an area of the counter wiring substrate 65 located upstream of the counter area neighboring area CNA with respect to the toner transport direction TTD.

The upstream low relative dielectric constant portion 65*d*2 is formed of a material lower in relative dielectric constant than the counter area neighboring area CNA.

The downstream low relative dielectric constant portion 65*d*3 is provided at a position corresponding to a downstream area CDA. The downstream area CDA is an area of the counter wiring substrate 65 located downstream of the counter area neighboring area CNA with respect to the toner transport direction TTD. The downstream low relative dielectric constant portion 65*d*3 is formed of a material lower in relative dielectric constant than the counter area neighboring area CNA.

That is, the counter electrode overcoating layer 65*d* is formed such that the upstream area CUA and the downstream area CDA are lower in relative dielectric constant than the counter area neighboring area CNA.

<Operation of Laser Printer>

Next, the operation of the laser printer 1 having the above-described configuration will be described with reference to the relevant drawings.

<<Paper Feed Operation>>

First, referring to FIG. 1, the leading end of the paper P stacked on an unillustrated paper feed tray is sent to the resist rollers 21. The resist rollers 21 correct a skew of the paper P and adjust transport timing. Subsequently, the paper P is transported to the transfer position TP.

<<Carrying Toner Image on Latent Image Forming Surface>>

While the paper P is being transported toward the transfer position TP as described above, an image in the toner T is formed as described below on the latent image forming surface LS, which is the circumferential surface of the photoconductor drum 3.

<<Formation of Electrostatic Latent Image>>

First, the charger 4 uniformly charges a portion of the latent image forming surface LS of the photoconductor drum 3 to positive polarity.

In association with the rotation of the photoconductor drum 3 in the direction (clockwise) indicated by the arrow of FIG. 1, the portion of the latent image forming surface LS which has been charged by the charger 4 moves along the sub-scanning direction to the scanning position SP, where the portion of the latent image forming surface LS faces (faces straight toward) the scanner unit 5.

Referring to FIG. 2, at the scanning position SP, the charged portion of the latent image forming surface LS is irradiated with the laser beam LB which has been modulated on the basis of image information, while the laser beam LB sweeps along the main scanning direction. Certain positive charges are lost from the charged portion of the latent image forming surface LS according to a state of modulation of the laser beam LB. By this procedure, an electrostatic latent image LI in the form of a pattern (an imagewise distribution) of positive charges is formed on the latent image forming surface LS.

In association with the rotation of the photoconductor drum 3 in the direction (clockwise) indicated by the arrow of FIG. 2, the electrostatic latent image LI formed on the latent image forming surface LS moves toward the developing position DP, where the electrostatic latent image LI faces the toner supply apparatus 6.

<<<Transport and Supply of Charged Toner>>>

Referring to FIG. 2, the toner stirrer 61*d* fluidizes the toner T contained in the toner box 61. Specifically, the vane wheel of the toner stirrer 61*d* rotates in the direction (clockwise) indicated by the illustrated arrow.

The operation of the toner stirrer 61*d* causes friction between the toner T and the toner transport surface TTS (surface of the transport electrode overcoating layer 63*d* made of a synthetic resin in FIG. 3) of the upstream component portion 62*b*.

As mentioned previously, an upstream (left in FIG. 2) end portion of the toner electric field transport body 62 (upstream component portion 62*b*) with respect to the toner transport direction TTD is buried in the toner T. Thus, the toner T contained in the toner box 61 is supplied at all times onto the toner transport surface TTS in the upstream area TUA.

Also, traveling wave transport voltages are applied to the plurality of transport electrodes 63*a* of the toner electric field transport body 62. Accordingly, predetermined traveling wave electric fields are formed on the toner transport surface TTS. By the effect of the traveling wave electric fields, the positively charged toner T is transported on the toner transport surface TTS along the toner transport direction TTD.

Figure 4:
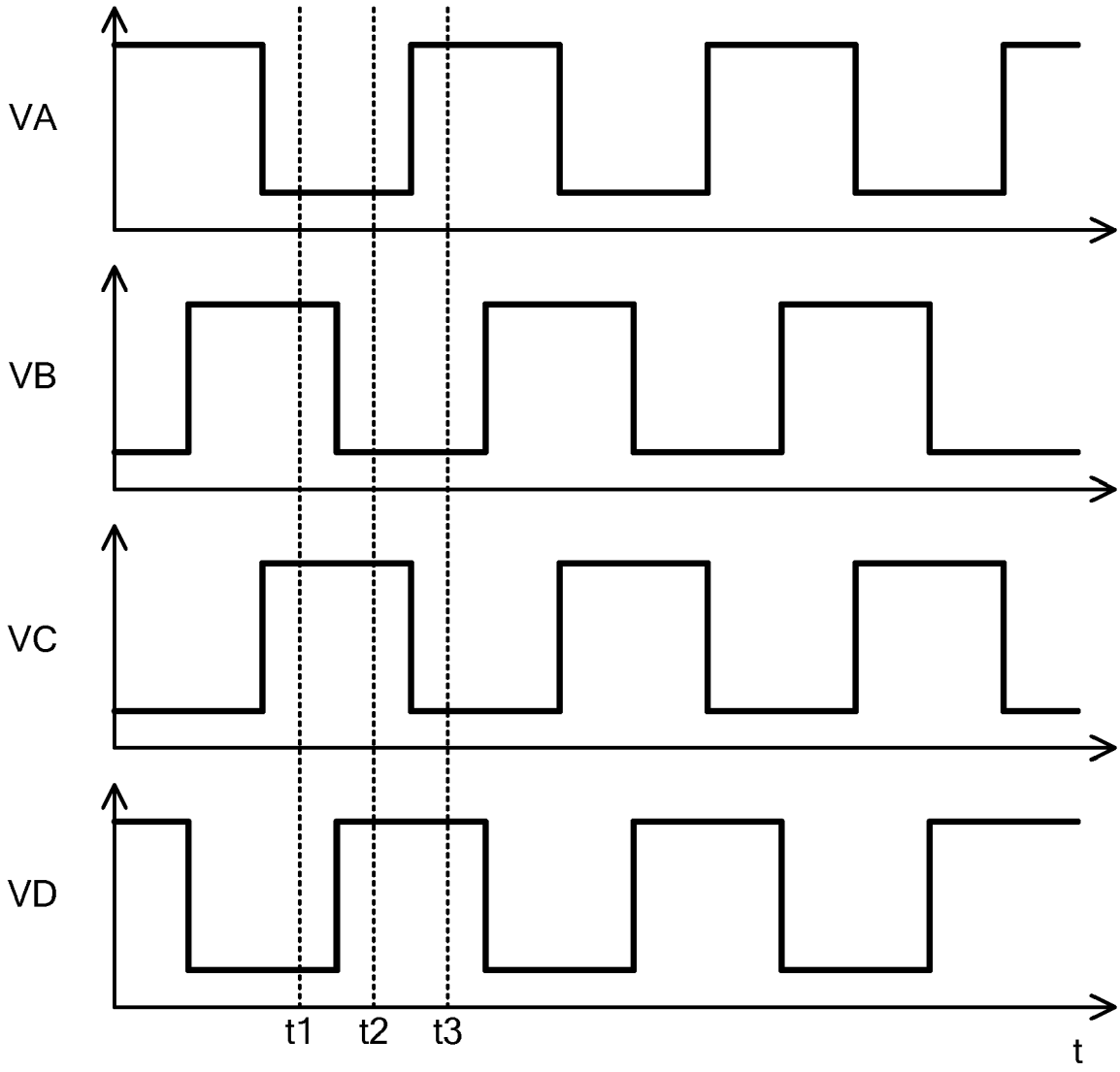
FIG. 4 is a diagram showing waveforms of voltages generated by power circuits shown in FIG. 2.
Figure 5:
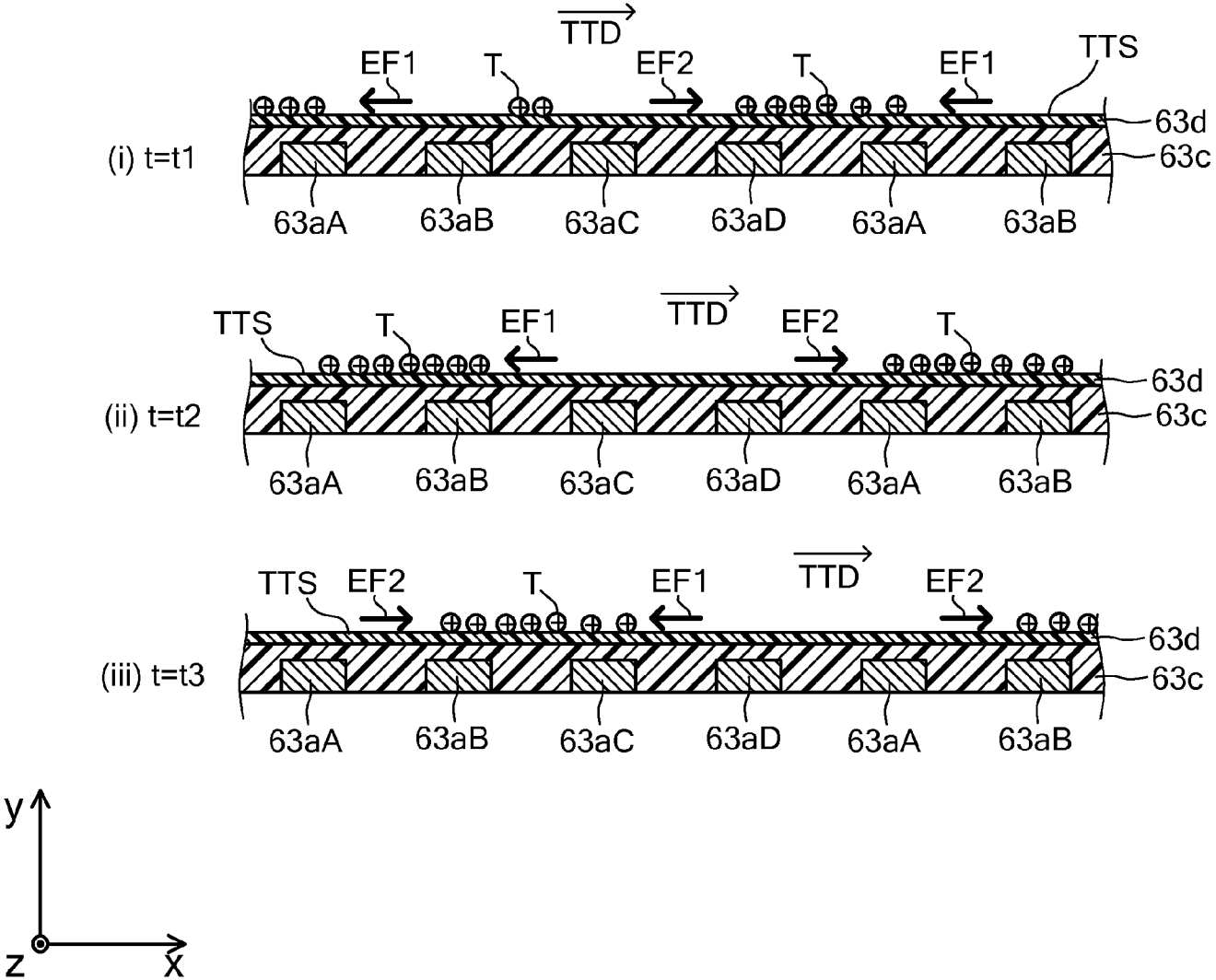
FIG. 5 is a series of side sectional views showing, on an enlarged scale, the periphery of a toner transport surface shown in FIG. 2.

FIG. 4 is a diagram showing waveforms of voltages generated by the power circuits VA to VD shown in FIG. 2. FIG. 5 is a series of side sectional views showing, on an enlarged scale, the periphery of the toner transport surface TTS shown in FIG. 2. In FIG. 5, the transport electrodes 63*a* which are connected to the power circuit VA in FIG. 3 are referred to as the transport electrodes 63*a*A. The same convention also applies to the transport electrodes 63*a*B to 63*a*D.

How the positively charged toner T is transported on the toner transport surface TTS along the toner transport direction TTD will be described below with reference to FIGS. 4 and 5.

As shown in FIG. 4, the power circuits VA to VD output AC voltages having the substantially same waveform in such a manner that, in the sequence of the power circuits VA to VD, the phase of voltage delays in increments of 90°.

At time t1 in FIG. 4, an electric field EF1 directed opposite the toner transport direction TTD (directed opposite the x-axis direction in FIG. 5) is formed in a section AB between the transport electrode 63*a*A and the transport electrode 63*a*B.

Meanwhile, an electric field EF2 directed in the toner transport direction TTD (x-axis direction in FIG. 5) is formed in a section CD between the transport electrode 63*a*C and the transport electrode 63*a*D.

No electric field directed along the toner transport direction TTD is formed in a BC section between the transport electrode 63*a*B and the transport electrode 63*a*C and in a DA section between the transport electrode 63*a*D and the transport electrode 63*a*A.

That is, at time t1, the positively charged toner T in the sections AB is subjected to electrostatic force directed opposite the toner transport direction TTD.

The positively charged toner T in the sections BC and DA is hardly subjected to electrostatic force directed along the toner transport direction TTD.

The positively charged toner T in the CD sections is subjected to electrostatic force directed in the toner transport direction TTD.

Thus, at time t1, the positively charged toner T is collected in the DA sections. Similarly, at time t2, as shown in FIG. 5(ii), the positively charged toner T is collected in the sections AB. When time t3 is reached, as shown in FIG. 5(iii), the positively charged toner T is collected in the sections BC.

That is, areas where the toner T is collected move with time on the toner transport surface TTS along the toner transport direction TTD.

In this manner, by means of voltages shown in FIG. 4 being applied to the transport electrodes 63*a*, traveling wave electric fields are formed on the toner transport surface TTS.

Thus, the positively charged toner T is transported along the toner transport direction TTD while hopping in the y-axis direction in FIG. 5.

Referring to FIG. 2, transport of the toner T by means of the counter wiring substrate 65 is similar to that by means of the transport wiring substrate 63 as mentioned above.

FIGS. 6 to 12 show the results of computer simulations of electric field strength and toner behavior in relation to relative dielectric constant of the transport electrode overcoating layer 63*d*.

Figure 6:
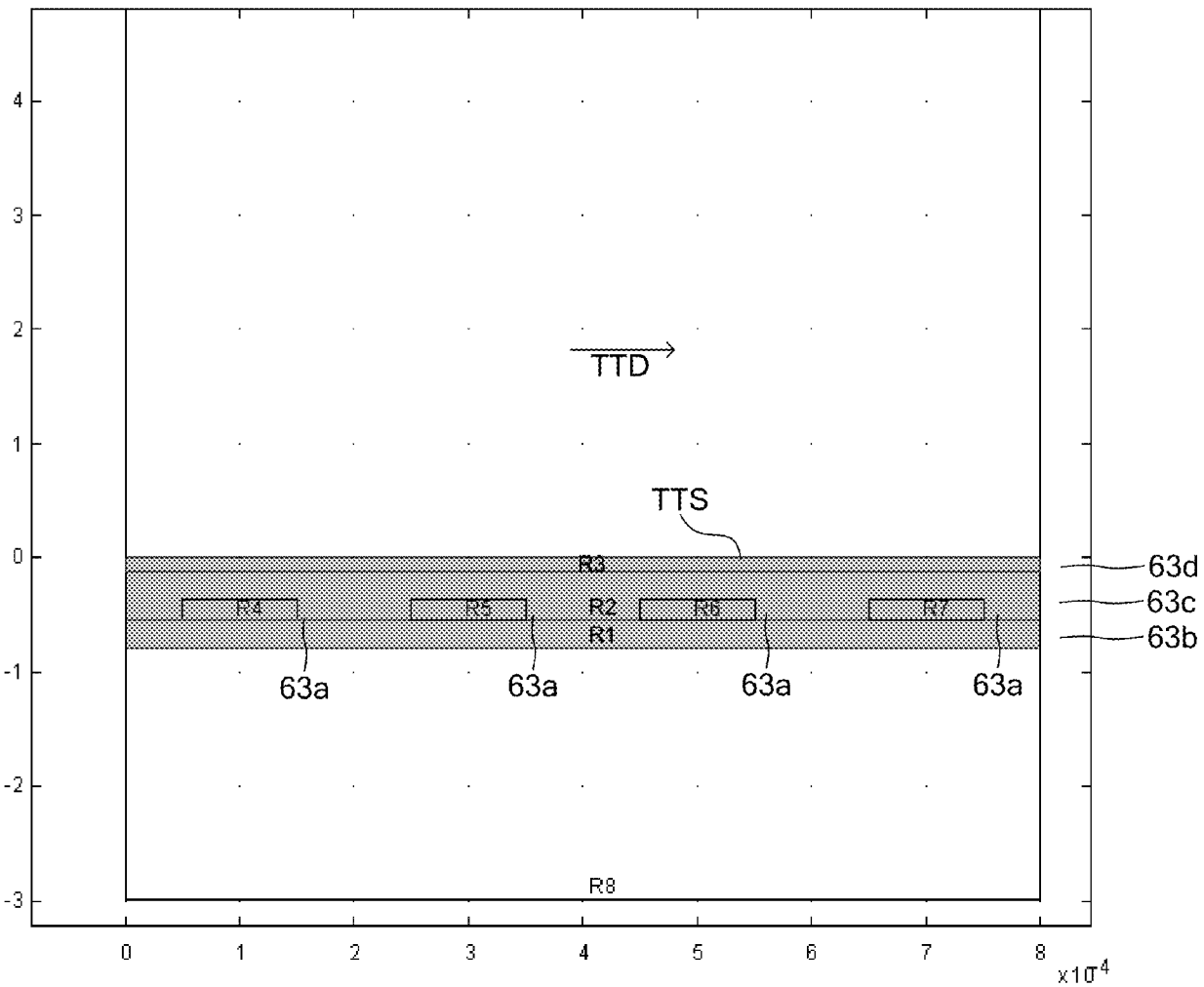
FIG. 6 is a side sectional view showing, on a further enlarged scale, a transport wiring substrate shown in FIG. 3.

FIG. 6 is a side sectional view showing, on a further enlarged scale, the transport wiring substrate 63 shown in FIG. 3. In FIG. 6, the vertical axis and the horizontal axis represent position (distance) in a unit of $10^{-4}$ m.

The dimensions of the transport electrode 63*a* was 18 μm in thickness and 100 μm in electrode width (width along the sub-scanning direction). A pitch between the transport electrodes 63*a* was 100 μm.

The transport electrode support film 63*b* had a thickness of 25 μm and a relative dielectric constant of 5.

The transport electrode coating layer 63*c* had a maximum thickness (thickness of a portion where the transport electrodes 63*a* are not provided) of 43 μm and a relative dielectric constant of 2.3.

The transport electrode overcoating layer 63*d* had a thickness of 12.5 μm and a relative dielectric constant of 4 or 300.

Under the above-mentioned conditions, electric field analysis was conducted by a finite-element method, and particle behavior analysis was conducted by a distinct-element method.

Figure 7:
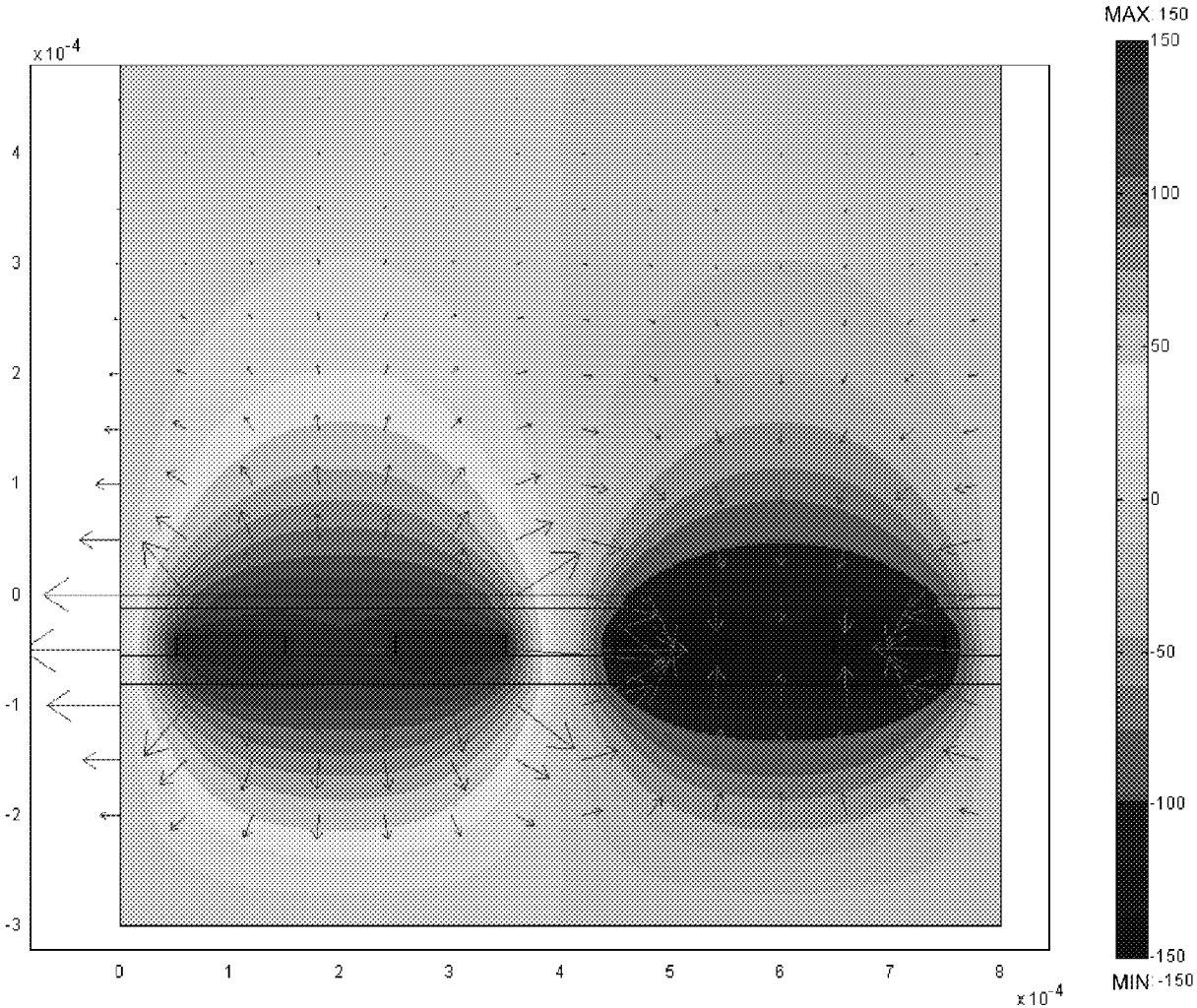
FIG. 7 is a view showing the results of analysis of electric potential distribution, electric field direction, and electric field strength by a finite-element method under the condition that, in FIG. 6, two leftmost transport electrodes have an electric potential of +150 V, and two rightmost transport electrodes have an electric potential of −150V in the case where a transport electrode overcoating layer in FIG. 6 has a relative dielectric constant of 4.
Figure 8:
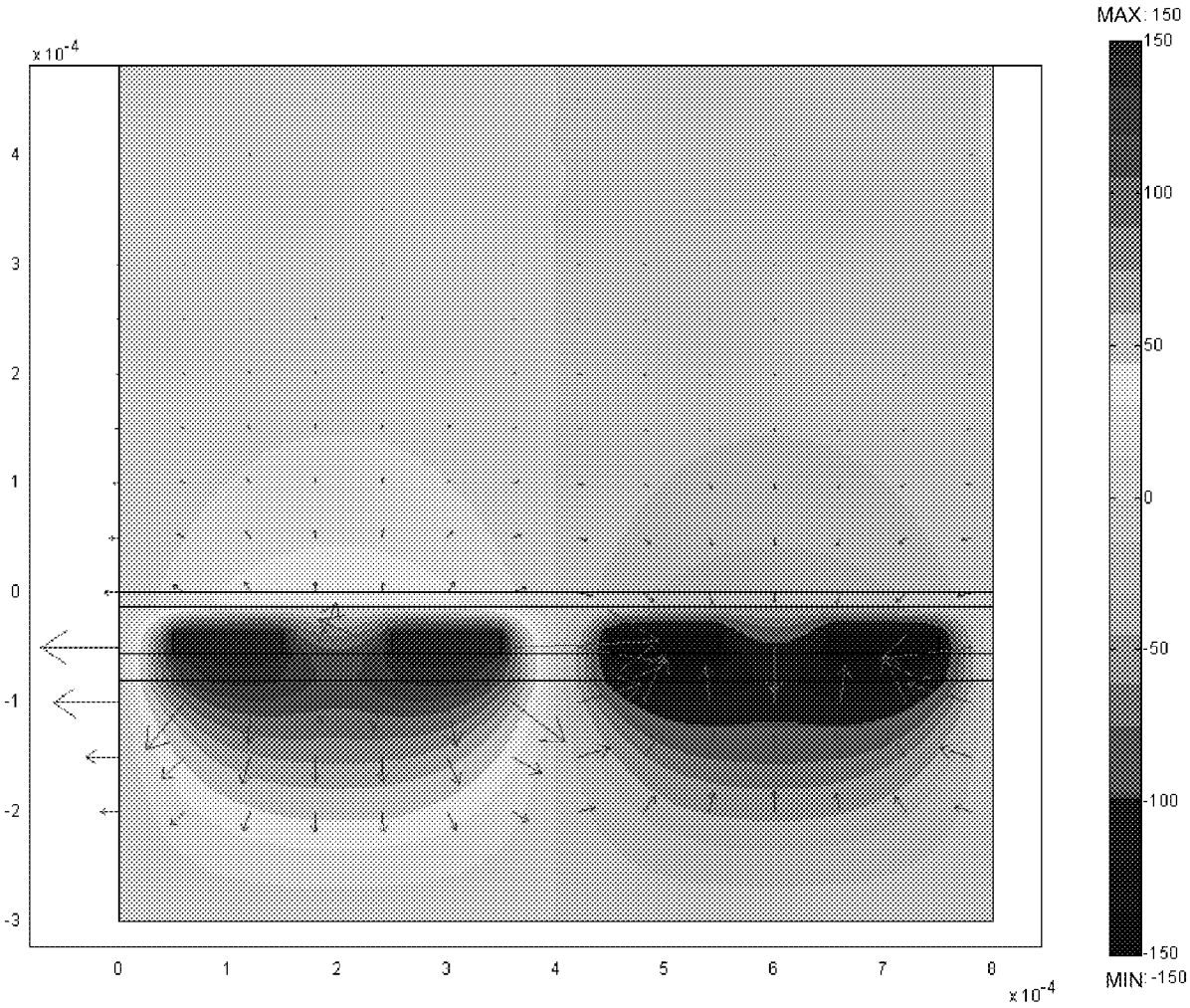
FIG. 8 is a view showing the results of analysis of electric potential distribution, electric field direction, and electric field strength by the finite-element method under the condition that, in FIG. 6, two leftmost transport electrodes have an electric potential of +150 V, and two rightmost transport electrodes have an electric potential of −150V in the case where the transport electrode overcoating layer in FIG. 6 has a relative dielectric constant of 300.

FIGS. 7 and 8 show the results of analysis of electric potential distribution, electric field direction, and electric field strength by the finite-element method under the condition that, in FIG. 6, the two leftmost transport electrodes 63*a* had an electric potential of +150 V, and the two rightmost transport electrodes 63*a* had an electric potential of −150V. Electric potential distribution is represented by darkness of color (the darker the color, the greater an absolute value of electric field); an electric field direction is represented by the direction of an arrow; and electric field strength is represented by the length of an arrow.

FIG. 7 shows the case where the transport electrode overcoating layer 63*d* in FIG. 6 has a relative dielectric constant of 4. FIG. 8 shows the case where the transport electrode overcoating layer 63*d* in FIG. 6 has a relative dielectric constant of 300.

As is apparent from FIGS. 6 to 8, the case of the transport electrode overcoating layer 63*d* having the higher relative dielectric constant is lower in electric field strength on the toner transport surface TTS with respect to the toner transport direction TTD and the height direction.

Figure 9:
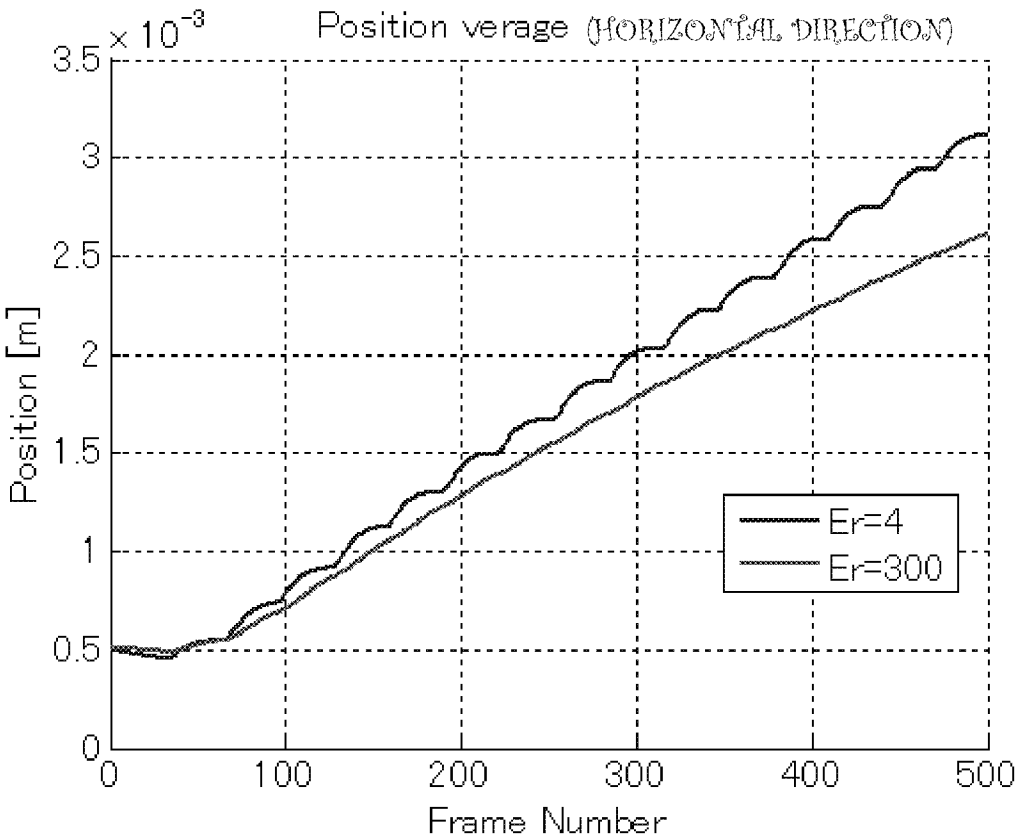
FIG. 9 is a graph showing the results of analysis of toner position along a toner transport direction (horizontal direction) by a distinct-element method in the case where traveling wave voltages are applied to the plurality of transport electrodes in FIG. 6.
Figure 10:
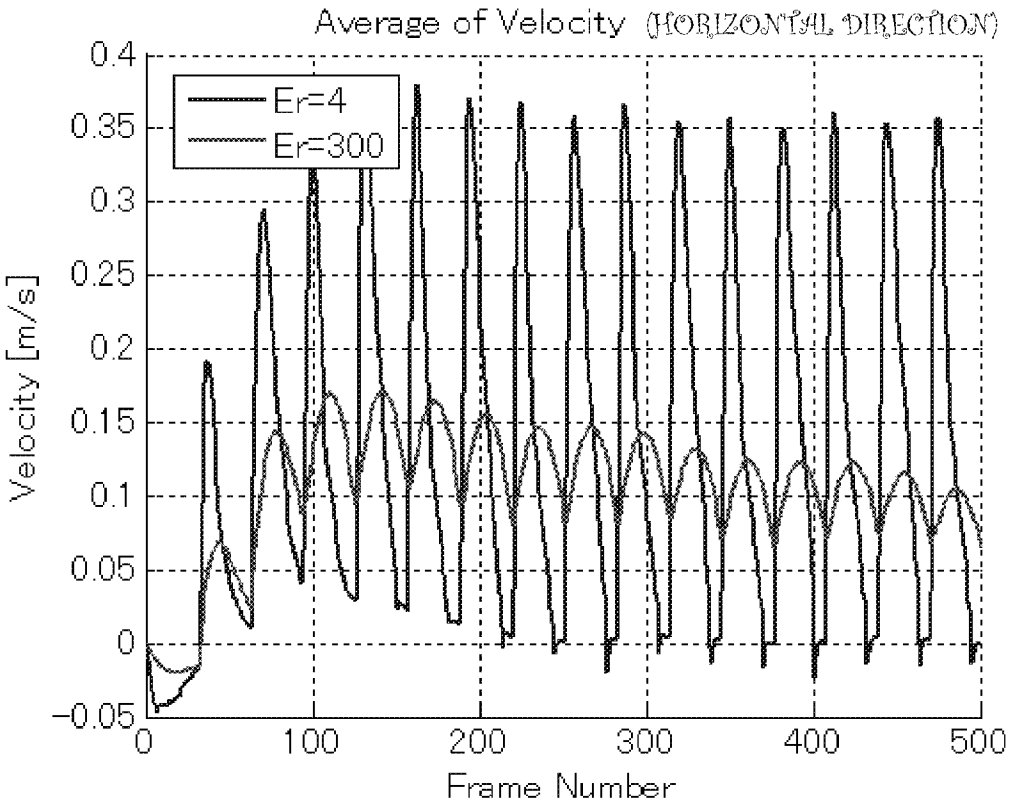
FIG. 10 is a graph showing the results of analysis of toner velocity along the toner transport direction (horizontal direction) by the distinct-element method in the case where traveling wave voltages are applied to the plurality of transport electrodes in FIG. 6.

FIG. 9 is a graph showing the results of analysis of toner position along the toner transport direction TTD (horizontal direction) by the distinct-element method in the case where traveling wave voltages were applied to the plurality of transport electrodes 63*a* in FIG. 6. FIG. 10 is a graph showing the results of analysis of toner velocity along the toner transport direction TTD (horizontal direction) by the distinct-element method in the case where traveling wave voltages were applied to the plurality of transport electrodes 63*a* in FIG. 6.

Figure 11:
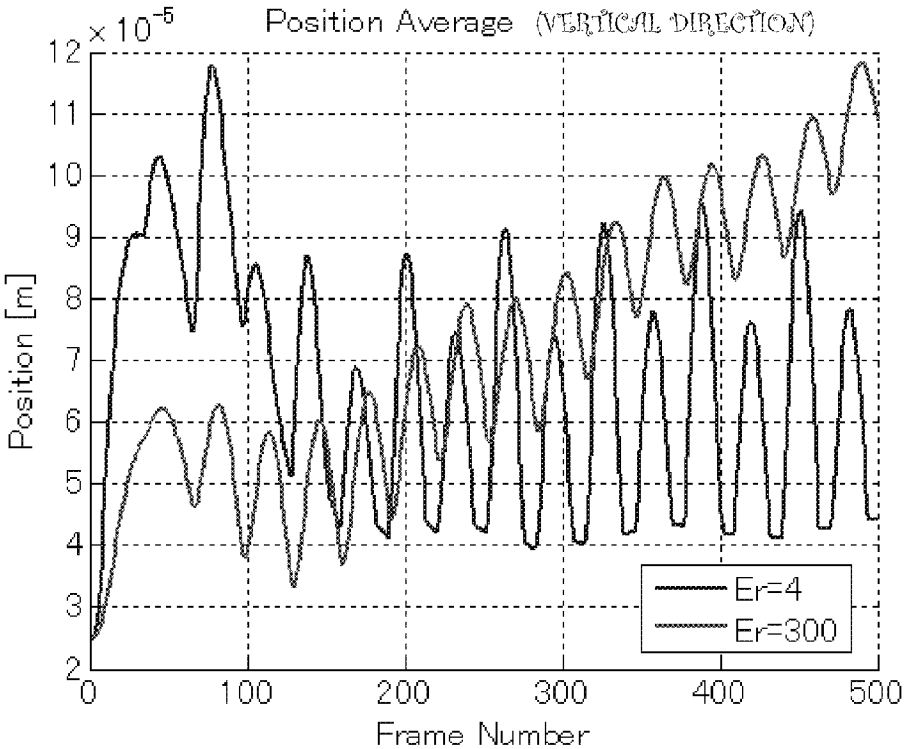
FIG. 11 is a graph showing the results of analysis of toner position along a height direction by the distinct-element method in the case where traveling wave voltages are applied to the plurality of transport electrodes in FIG. 6.
Figure 12:
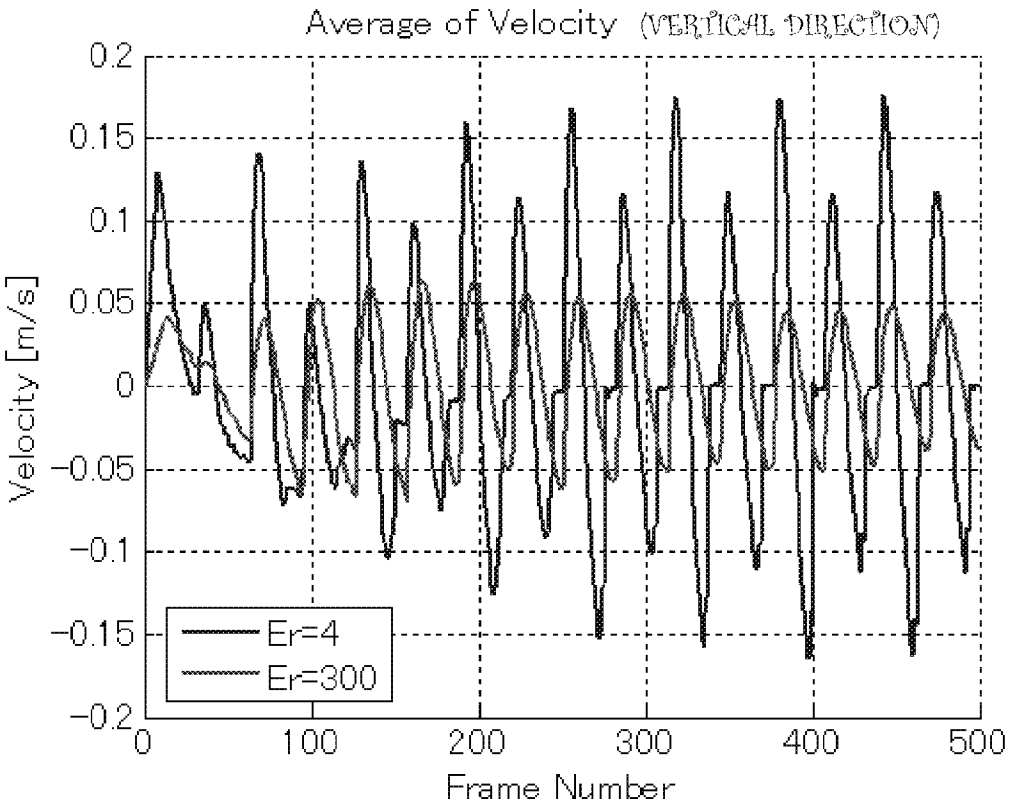
FIG. 12 is a graph showing the results of analysis of toner velocity along the height direction by the distinct-element method in the case where traveling wave voltages were applied to the plurality of transport electrodes in FIG. 6.

FIG. 11 is a graph showing the results of analysis of toner position along the height direction by the distinct-element method in the case where traveling wave voltages were applied to the plurality of transport electrodes 63*a* in FIG. 6. FIG. 12 is a graph showing the results of analysis of toner velocity along the height direction by the distinct-element method in the case where traveling wave voltages were applied to the plurality of transport electrodes 63*a* in FIG. 6.

In FIGS. 9 to 12, the horizontal axis, which represents "Frame Number," corresponds to a time axis (1 Frame is equivalent to 40 μsec).

In the simulations whose results are shown in FIGS. 9 to 12, in an initial state in which 300 spherical toner particles (100 particles×1 row×3 layers) each having a radius of 10 μm were laid on the toner transport surface TTS within a width of 1 mm along the toner transport direction TTD, the average position and the average velocity of the 300 toner particles were obtained (thus, at a Frame Number of 0, Position is 0.5 mm in FIG. 9 and about 25 μm in FIG. 11).

Also, the density of toner was 1.2 g/cc, and the amount of charge of toner was 30 μC/g (the amount of charge per toner particle is $1.89\times10^{-14}$ C).

Furthermore, the frequency of transport voltage was 800 Hz.

As is apparent from FIGS. 6, 9, and 10, the case of the transport electrode overcoating layer 63*d* having the higher relative dielectric constant is lower in toner transport velocity in the toner transport direction TTD. Also, the case of the transport electrode overcoating layer 63*d* having the higher relative dielectric constant is smaller in variation of toner transport velocity in the toner transport direction TTD; i.e., the toner transport velocity is stabilized.

Also, as is apparent from FIGS. 6, 11, and 12, the case of the transport electrode overcoating layer 63*d* having the higher relative dielectric constant is higher in average position of toner in the height direction. That is, in the case of the transport electrode overcoating layer 63*d* having the higher relative dielectric constant, the toner can be brought into such a state as to float higher from the toner transport surface TTS.

Referring to FIG. 2, by the effect of traveling wave electric fields formed on the toner transport surface TTS as mentioned above, the positively charged toner T moves upward on the sloped toner transport surface TTS of the upstream component portion 62*b*. Then, the toner T reaches the central component portion 62*a*.

In addition to the above-mentioned traveling wave electric fields generated by the transport wiring substrate 63, traveling wave electric fields generated by the counter wiring substrate 65 also act on the toner T which has reached the central component portion 62*a*.

Referring to FIG. 3, the toner T which has reached the central component portion 62*a* is transported in the toner transport direction TTD and reaches a position corresponding to the counter area neighboring area CNA (a position just under the counter area neighboring area CNA).

A portion of the counter electrode overcoating layer 65*d* in the counter area neighboring area CNA (high relative dielectric constant portion 65*d*1) is higher in relative dielectric constant than a portion of the counter electrode overcoating layer 65*d* in the upstream area CUA (upstream low relative dielectric constant portion 65*d*2).

Thus, traveling wave electric field strength along the toner transport direction TTD as effected by the counter wiring substrate 65 is lower in the counter area neighboring area CNA than in the upstream area CUA. Accordingly, the velocity of transport of the toner T along the toner transport direction TTD is decelerated.

The toner T whose transport velocity has been decelerated in the counter area neighboring area CNA then reaches the counter area CA. In the counter area CA, the counter wiring substrate 65 is not provided. Accordingly, in the counter area CA, the toner T is transported solely by the effect of traveling wave electric fields generated by the transport wiring substrate 63.

A portion of the transport electrode overcoating layer 63*d* in the counter area CA (high relative dialectic constant portion 63*d*1) is higher in relative dielectric constant than a portion of the transport electrode overcoating layer 63*d* in the upstream area TUA (upstream low relative dielectric constant portion 63*d*2).

Thus, traveling wave electric field strength along the toner transport direction TTD as effected by the transport wiring substrate 63 is lower in the counter area CA than in the upstream area TUA. Accordingly, the velocity of transport of the toner T along the toner transport direction TTD is further decelerated.

The toner T which has passed the counter area CA then reaches a position corresponding to the counter area neighboring area CNA. At the position, traveling wave electric fields generated by the counter wiring substrate 65 also act again on the toner T.

The toner T which has passed the counter area CA reaches the downstream area TDA. A portion of the transport electrode overcoating layer 63*d* in the downstream area TDA (downstream low relative dielectric constant portion 63*d*3) is lower in relative dielectric constant than a portion of the transport electrode overcoating layer 63*d* in the counter area CA (high relative dielectric constant portion 63*d*1). Accordingly, traveling wave electric field strength along the toner transport direction TTD as effected by the transport wiring substrate 63 is higher in the downstream area TDA than in the counter area CA.

Thus, the velocity of transport of the toner T having passed the counter area CA is accelerated than in the counter area CA.

When the toner T is further transported in the toner transport direction TTD, the toner T reaches the downstream area CDA.

A portion of the counter electrode overcoating layer 65*d* in the downstream area CDA (downstream low relative dielectric constant portion 65*d*3) is lower in relative dielectric constant than a portion of the counter electrode overcoating layer 65*d* in the counter area neighboring area CNA (high relative dielectric constant portion 65*d*1).

Thus, traveling wave electric field strength along the toner transport direction TTD as effected by the counter wiring substrate 65 is higher in the downstream area CDA than in the counter area neighboring area CNA. Accordingly, the velocity of transport of the toner T along the toner transport direction TTD is accelerated.

Referring to FIG. 2, the toner T which has passed the counter area CA is transported from the central component portion 62*a* toward the downstream component portion 62*c*. Then, the toner T drops from the downstream component portion 62*c* and thus returns to a bottom portion of the toner box 61.

<<<Development of Electrostatic Latent Image>>>

Referring to FIG. 3, the positively charged toner T which has been transported to the counter area CA as mentioned above is supplied to the developing position DP.

In the vicinity of the developing position DP, the electrostatic latent image LI formed on the latent image forming surface LS is developed with the toner T. That is, the toner T adheres to portions of the electrostatic latent image LI on the latent image forming surface LS at which positive charges are lost. Thus, an image in the toner T (hereinafter referred to as the "toner image") is carried on the latent image forming surface LS.

<<Transfer of Toner Image from Latent Image Forming Surface to Paper>>

Referring to FIG. 1, in association with rotation of the latent image forming surface LS in the direction (clockwise) indicated by the illustrated arrow, the toner image which has been carried on the latent image forming surface LS of the photoconductor drum 3 as mentioned above is transported toward the transfer position TP. At the transfer position TP, the toner image is transferred from the latent image forming surface LS onto the paper P.

<Actions and Effects of Configuration of First Embodiment>

Referring to FIGS. 2 and 3, in the configuration of the present embodiment, the transport electrode overcoating layer 63*d* is configured such that relative dielectric constant is lower in an area (upstream area TUA) located upstream of and an area (downstream area TDA) located downstream of the counter area CA with respect to the toner transport direction TTD than in the counter area CA.

Thus, when traveling wave transport voltages are applied to the transport electrodes 63*a*, as mentioned above, electric field strength in a space in the vicinity of the toner transport surface TTS is higher in the upstream area TUA and the downstream area TDA than in the counter area CA.

According to the above-mentioned configuration, strong electric fields are generated at the upstream component portion 62*b* (upstream area TUA) buried in the toner T contained in the toner box 61. The strong electric fields impose a high acceleration on the toner T which is located at an upper end portion of the toner T stock contained in the toner box 61 and at a position (hereinafter, referred to as the "toner transport start position") in the vicinity of the upstream component portion 62*b*.

Thus, a large force is applied in the toner transport direction TTD to the toner T which is almost motionless in the toner transport direction TTD and is located at the toner transport start position. Accordingly, the toner T can be transported in good condition from the toner transport start position in the toner transport direction TTD.

In the above-mentioned configuration, in the counter area CA, electric field strength lowers in a space in the vicinity of the toner transport surface TTS. Thus, leakage of the toner T from the toner passage hole 61*a*1 can be restrained. Accordingly, adhesion of the toner T to a white background (where pixels in the toner T are not formed) of the latent image forming surface LS of the photoconductor drum 3; i.e., "white background fogging," can be effectively restrained.

In the above-mentioned configuration, as mentioned previously, the toner T is in such a state as to slightly float from the toner transport surface TTS in the counter area CA. Accordingly, the force of attraction of the toner T to the toner transport surface TTS (adhesion force, such as image force or Van der Waals force) at the developing position DP can be well mitigated. Therefore, the toner T selectively adheres to the latent image forming surface LS according to a pattern of positive charges of the electrostatic latent image LI with good response.

Thus, according to the configuration of the present embodiment, at the developing position DP, adhesion of the toner T to the latent image forming surface LS (development of the electrostatic latent image LI with the toner T) can be carried out in good condition.

Furthermore, in the counter area CA, transport of the toner T can be decelerated. Thus, in the counter area CA, the density of the toner T increases. Therefore, non-uniform presence of the toner T along the toner transport direction TTD can be effectively restrained.

Also, according to the above-mentioned configuration, the toner T which has passed the counter area CA can be accelerated in a downstream direction along which the toner T is transported beyond the counter area CA. Thus, the stagnation of a large amount of the toner T in the counter area CA can be restrained. Accordingly, the above-mentioned "white background fogging" can be effectively restrained. Also, the toner T which has passed the counter area CA can promptly return to the interior of the toner box 61.

Thus, according to the above-mentioned configuration, the state of transport of the toner T in the toner transport direction TTD by means of the toner electric field transport body 62 can be appropriately set. Therefore, according to the above-mentioned configuration, the formation of an image in the toner T can be carried out in a better fashion.

Referring to FIGS. 2 and 3, in the configuration of the present embodiment, the counter electrode overcoating layer 65*d* is configured such that relative dielectric constant is lower in an area (upstream area CUA) located upstream of and an area (downstream area CDA) located downstream of the counter area neighboring area CNA with respect to the toner transport direction TTD than in the counter area neighboring area CNA.

Thus, when traveling wave transport voltages are applied to the counter electrodes 65*a*, as mentioned above, electric field strength in a space in the vicinity of the toner transport surface TTS is higher in the upstream area CUA and the downstream area CDA than in the counter area neighboring area CNA.

According to the above-mentioned configuration, the strength of the electric field in a space in the vicinity of the counter wiring substrate surface CS lowers in the counter area neighboring area CNA. Thus, in the counter area neighboring area CNA, transport of the toner T can be decelerated. Accordingly, in the counter area neighboring area CNA, the density of the toner T increases. Therefore, non-uniform presence of the toner T along the toner transport direction TTD can be effectively restrained.

Also, according to the above-mentioned configuration, the toner T which has passed the counter area neighboring area CNA can be accelerated in a downstream direction along which the toner T is transported beyond the counter area neighboring area CNA. Thus, the stagnation of a large amount of the toner T in the counter area neighboring area CNA can be restrained. Accordingly, the toner T which has passed the counter area neighboring area CNA can promptly return to the interior of the toner box 61.

Thus, according to the above-mentioned configuration, the state of transport of the toner T in the toner transport direction TTD by means of the counter wiring substrate 65 can be appropriately set. Therefore, according to the above-mentioned configuration, the formation of an image in the toner T can be carried out in a better fashion.

Referring to FIGS. 2 and 3, in the configuration of the present embodiment, the counter area neighboring areas CNA are respectively provided upstream of and downstream of the counter area CA with respect to the toner transport direction TTD. That is, the counter area CA is provided between the counter area neighboring area CNA located upstream of the toner passage hole 61*a*1 with respect to the toner transport direction TTD and the counter area neighboring area CNA located downstream of the toner passage hole 61*a*1 with respect to the toner transport direction TTD.

Thus, a region where the toner transport surface TTS of the toner electric field transport body 62 (central component portion 62*a*) and the counter wiring substrate surface CS of the counter wiring substrate 65 face each other with a predetermined gap therebetween is configured as follows.

(a) An area where the upstream area CUA (upstream low relative dielectric constant portion 65*d*2) of the counter wiring substrate 65 and the upstream area TUA (upstream low relative dielectric constant portion 63*d*2) of the toner electric field transport body 62 face each other, (b) an area where the counter area neighboring area CNA (high relative dielectric constant portion 65*d*1) of the counter wiring substrate 65 and the upstream area TUA (upstream low relative dielectric constant portion 63*d*2) of the toner electric field transport body 62 face each other, (c) an area where the toner passage hole 61*a*1 and the counter area CA (high relative dielectric constant portion 63*d*1) of the toner electric field transport body 62 face each other, (d) an area where the counter area neighboring area CNA (high relative dielectric constant portion 65*d*1) of the counter wiring substrate 65 and the downstream area TDA (downstream low relative dielectric constant portion 63*d*3) of the toner electric field transport body 62 face each other, and (e) an area where the downstream area CDA (downstream low relative dielectric constant portion 65*d*3) of the counter wiring substrate 65 and the downstream area TDA (downstream low relative dielectric constant portion 63*d*3) of the toner electric field transport body 62 face each other, can be arrayed in this order along the toner transport direction TTD.

In the above-mentioned configuration, electric field strength lowers in the order of (a), (b), and (c). Also, electric field strength increases in the order of (c), (d), and (e).

In the above-mentioned configuration, the toner T can be smoothly decelerated in the course of transport from (a) to (b) and then toward (c). Also, the toner T can be smoothly accelerated in the course of transport from (c) to (d) and then toward (e).

Second Embodiment of Toner Supply Apparatus

The configuration of a second embodiment of the present invention will be described with reference to FIG. 13.

In the following description of the second embodiment, members similar in structure and function to those used in the above-described embodiment can be denoted by the same reference numerals as those of the above-described embodiment. As for the description of these members, an associated description appearing in the description of the above embodiment can be cited, so long as no technical inconsistencies are involved (the same convention also applies to the third and subsequent embodiments to be described later).

Figure 13:
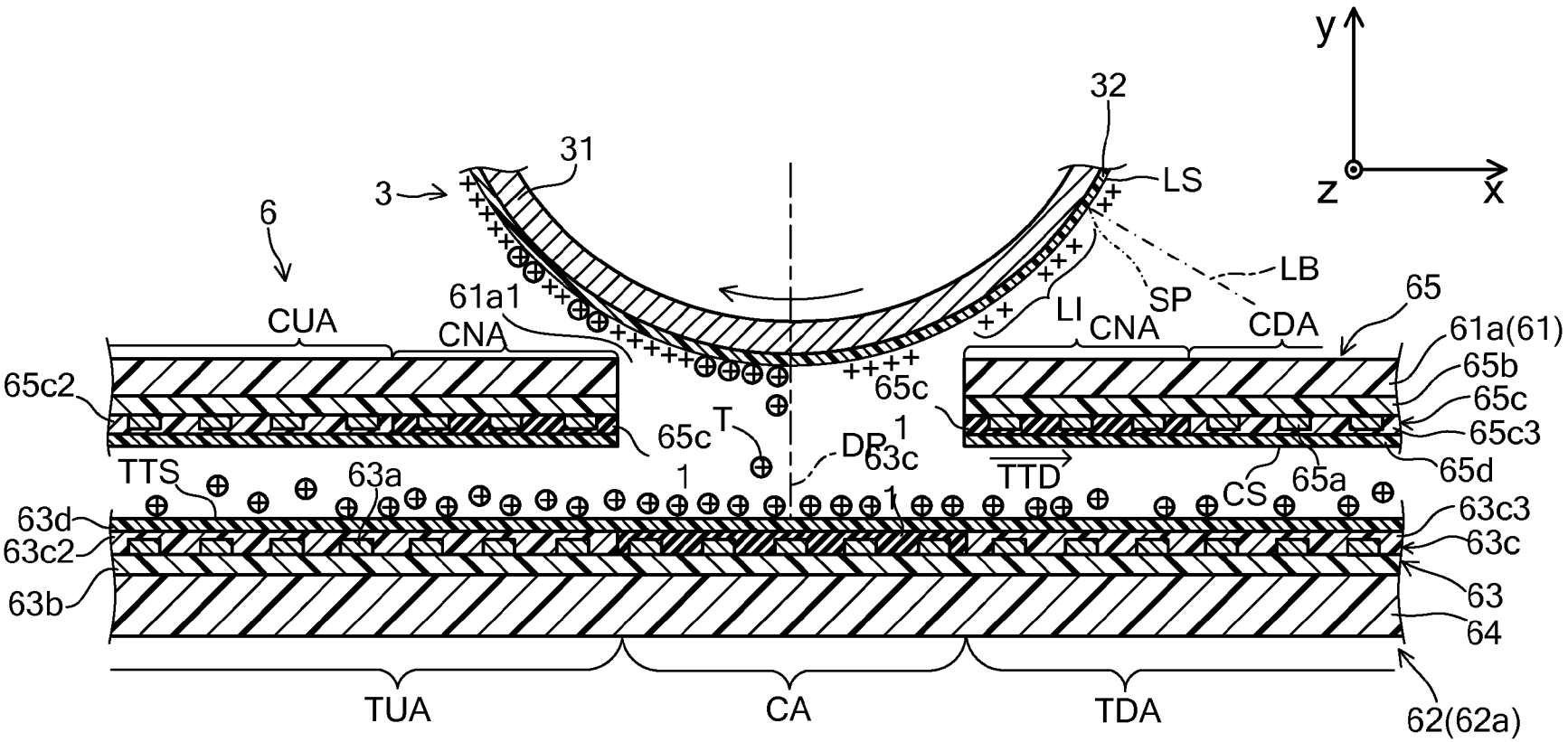
FIG. 13 is a side sectional view showing, on an enlarged scale, the periphery of the developing position in a second embodiment of the toner supply apparatus shown in FIG. 2.

FIG. 13 is a side sectional view showing, on an enlarged scale, the periphery of the developing position DP in the second embodiment of the toner supply apparatus 6 shown in FIG. 2.

Referring to FIG. 13, in the present embodiment, in place of the transport electrode overcoating layer 63*d*, the transport electrode coating layer 63*c* includes a high relative dielectric constant portion 63*c*1, an upstream low relative dielectric constant portion 63*c*2, and a downstream low relative dielectric constant portion 63*c*3.

The high relative dielectric constant portion 63*c*1 is provided at a position corresponding to the counter area CA. The upstream low relative dielectric constant portion 63*c*2 is provided at a position corresponding to the upstream area TUA. The downstream low relative dielectric constant portion 63*c*3 is provided at a position corresponding to the downstream area TDA.

The upstream low relative dielectric constant portion 63c2 is formed of a material lower in relative dielectric constant than the high relative dielectric constant portion 63c1. The downstream low relative dielectric constant portion 63c3 is formed of a material lower in relative dielectric constant than the high relative dielectric constant portion 63c1. That is, the transport electrode coating layer 63c is formed such that the upstream area TUA and the downstream area TDA are lower in relative dielectric constant than the counter area CA.

Also, in the present embodiment, in place of the counter electrode overcoating layer 65d, the counter electrode coating layer 65c includes a high relative dielectric constant portion 65c1, an upstream low relative dielectric constant portion 65c2, and a downstream low relative dielectric constant portion 65c3.

The high relative dielectric constant portion 65c1 is provided at a position corresponding to the counter area neighboring area CNA. The upstream low relative dielectric constant portion 65c2 is provided at a position corresponding to the upstream area CUA. The downstream low relative dielectric constant portion 65c3 is provided at a position corresponding to the downstream area CDA.

The upstream low relative dielectric constant portion 65c2 is formed of a material lower in relative dielectric constant than the counter area neighboring area CNA. The downstream low relative dielectric constant portion 65c3 is formed of a material lower in relative dielectric constant than the counter area neighboring area CNA. That is, the counter electrode overcoating layer 65c is formed such that the upstream area CUA and the downstream area CDA are lower in relative dielectric constant than the counter area neighboring area CNA.

Even the above-mentioned configuration yields actions and effects similar to those which the above-described first embodiment yields.

Third Embodiment of Toner Supply Apparatus

The configuration of a third embodiment of the present invention will be described with reference to FIG. 14.

Figure 14:
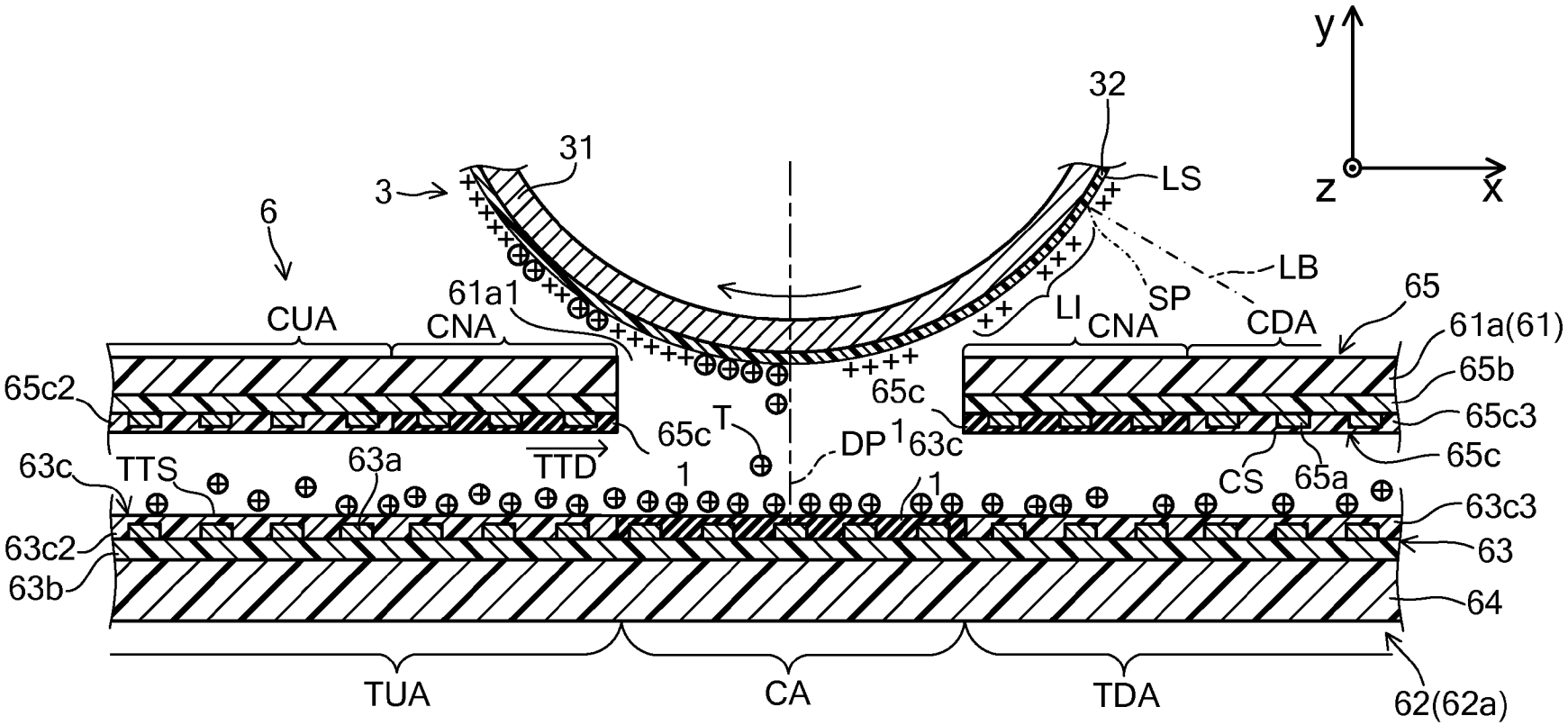
FIG. 14 is a side sectional view showing, on an enlarged scale, the periphery of the developing position in a third embodiment of the toner supply apparatus shown in FIG. 2.

FIG. 14 is a side sectional view showing, on an enlarged scale, the periphery of the developing position DP in the third embodiment of the toner supply apparatus 6 shown in FIG. 2.

Referring to FIG. 14, in the present embodiment, the transport electrode overcoating layer 63d (see FIG. 13) employed in the configuration of the above-described second embodiment is eliminated. That is, in the present embodiment, the transport electrode coating layer 63c serves as the transport electrode cover member of the present invention.

Also, in the present embodiment, the counter electrode overcoating layer 65d (see FIG. 13) employed in the configuration of the above-described second embodiment is eliminated. That is, in the present embodiment, the counter electrode coating layer 65c serves as the counter electrode cover member of the present invention.

Even the above-mentioned configuration yields actions and effects similar to those which the above-described embodiments yield.

Fourth Embodiment of Toner Supply Apparatus

The configuration of a fourth embodiment of the present invention will be described with reference to FIG. 15.

Figure 15:
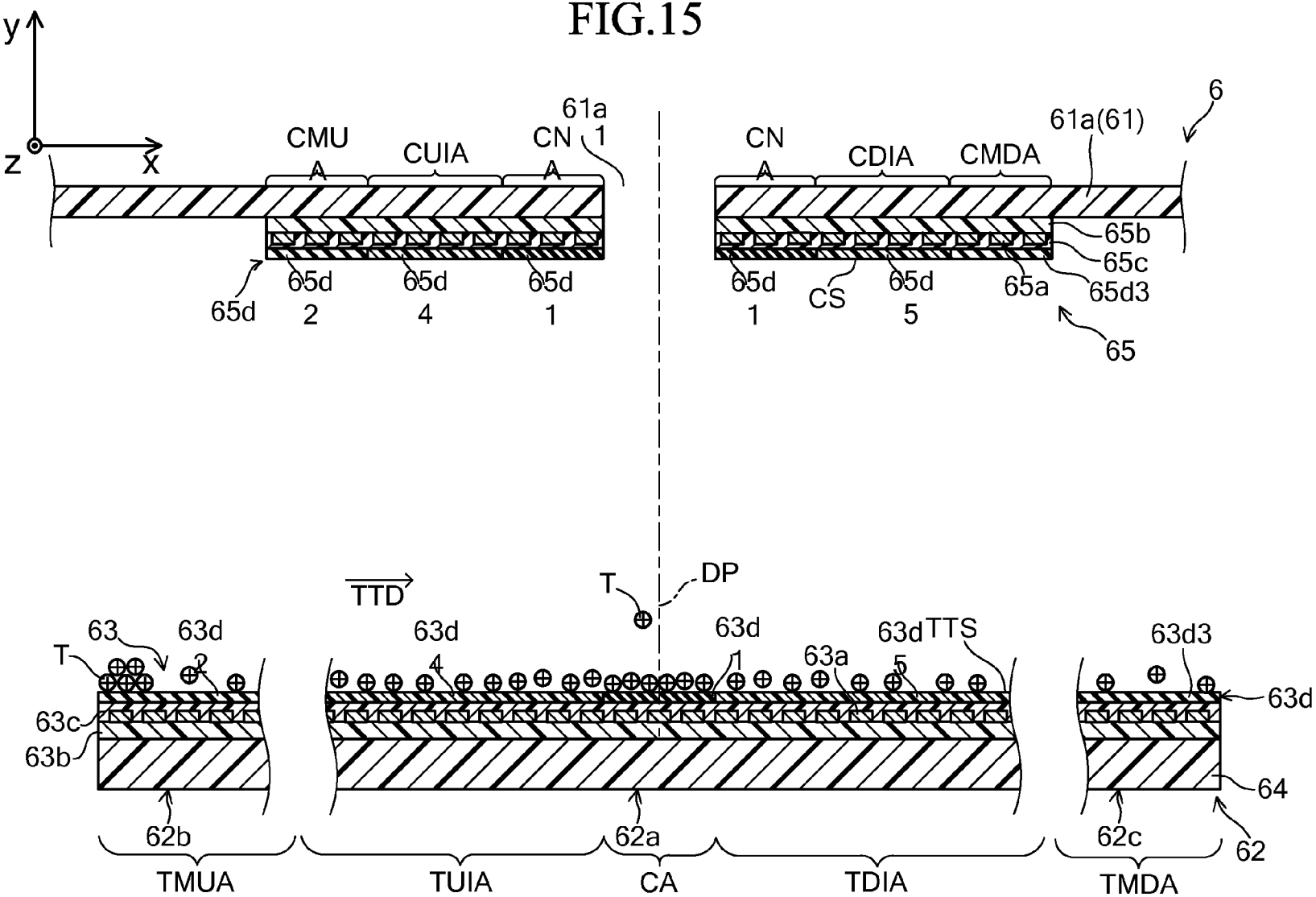
FIG. 15 is a side sectional view showing, on an enlarged scale, the transport wiring substrate and a counter wiring substrate in a fourth embodiment of the toner supply apparatus shown in FIG. 2.

FIG. 15 is a side sectional view showing, on an enlarged scale, the transport wiring substrate 63 and the counter wiring substrate 65 in the fourth embodiment of the toner supply apparatus 6 shown in FIG. 2.

Figure 16:
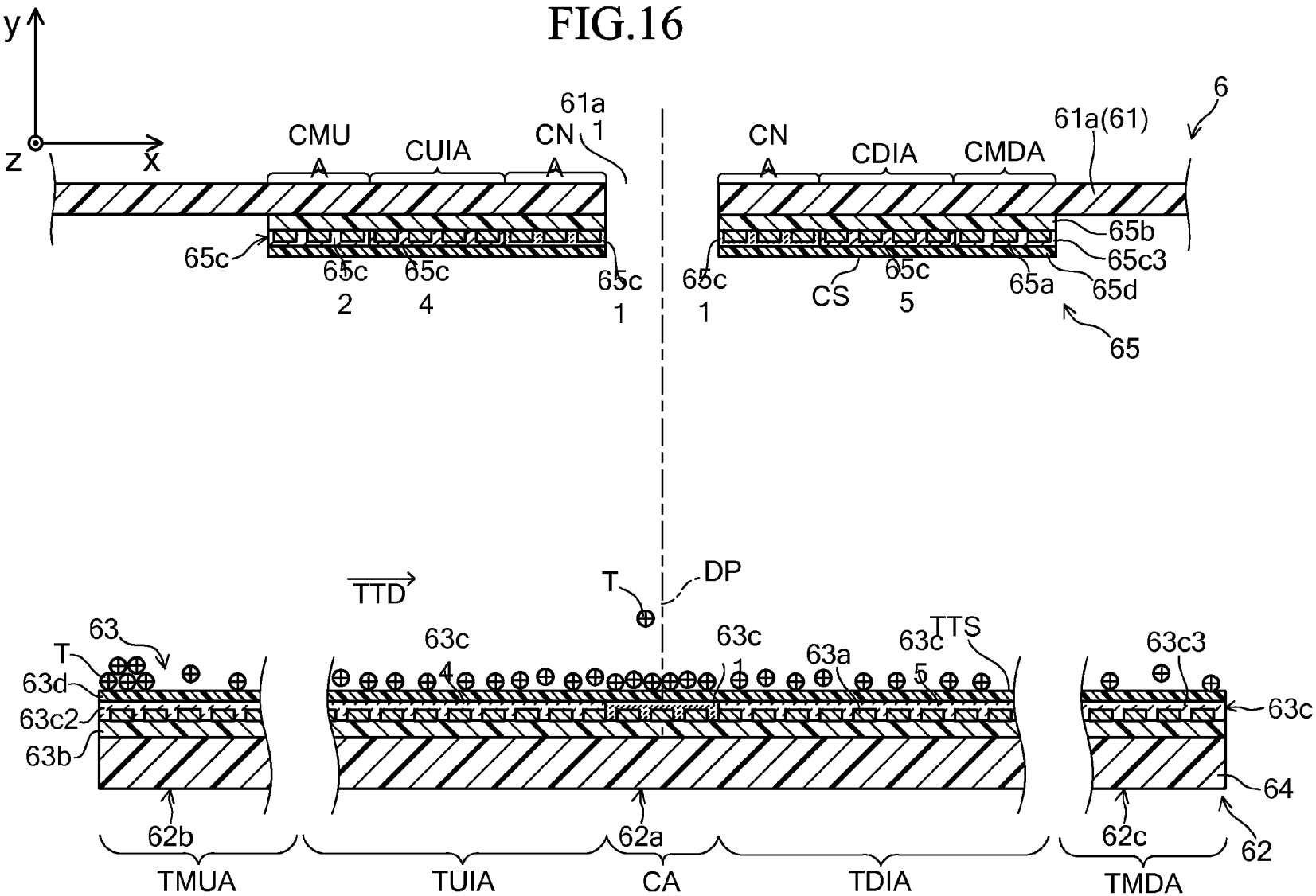
FIG. 16 is a side sectional view showing, on an enlarged scale, the transport wiring substrate and the counter wiring substrate in a fifth embodiment of the toner supply apparatus shown in FIG. 2.

In FIG. 15, for convenience of explanation, illustration of portions of the transport wiring substrate 63 is omitted, and the transport wiring substrate 63 is illustrated such that the central component portion 62a, the upstream component portion 62b, and the downstream component portion 62c are arrayed straight (the same convention also applies to FIG. 16 and subsequent relevant drawings).

Referring to FIG. 15, the transport electrode overcoating layer 63d of the present embodiment includes the high relative dielectric constant portion 63d1, the upstream low relative dielectric constant portion 63d2, the downstream low relative dielectric constant portion 63d3, an upstream intermediate relative dielectric constant portion 63d4, and a downstream intermediate relative dielectric constant portion 63d5.

The high relative dielectric constant portion 63d1 is provided at a position corresponding to the counter area CA.

The upstream low relative dielectric constant portion 63d2 is provided at a position corresponding to a most upstream area TMUA. The most upstream area TMUA is an area of the toner electric field transport body 62 located most upstream with respect to the toner transport direction TTD. That is, the most upstream area TMUA corresponds to a portion of the upstream component portion 62b which is located most upstream with respect to the toner transport direction TTD. The upstream low relative dielectric constant portion 63d2 is formed of a material lower in relative dielectric constant than the high relative dielectric constant portion 63d1.

The upstream intermediate relative dielectric constant portion 63d4 is provided at a position corresponding to an upstream intermediate area TUIA located between the most upstream area TMUA and the counter area CA. The upstream intermediate relative dielectric constant portion 63d4 is formed of a material whose relative dielectric constant falls between those of the high relative dielectric constant portion 63d1 and the upstream low relative dielectric constant portion 63d2.

The downstream low relative dielectric constant portion 63d3 is provided at a position corresponding to a most downstream area TMDA. The most downstream area TMDA is an area of the toner electric field transport body 62 located most downstream with respect to the toner transport direction TTD. That is, the most downstream area TMDA corresponds to a portion of the downstream component portion 62c which is located most downstream with respect to the toner transport direction TTD. The downstream low relative dielectric constant portion 63d3 is formed of a material lower in relative dielectric constant than the high relative dielectric constant portion 63d1.

The downstream intermediate relative dielectric constant portion 63d5 is provided at a position corresponding to a downstream intermediate area TDIA located between the most downstream area TMDA and the counter area CA. The downstream intermediate relative dielectric constant portion 63d5 is formed of a material whose relative dielectric constant falls between those of the high relative dielectric constant portion 63d1 and the downstream low relative dielectric constant portion 63d3.

That is, the transport electrode overcoating layer 63d is configured such that relative dielectric constant increases sequentially in the order of the most upstream area TMUA, the upstream intermediate area TUIA, and the counter area CA. Also, the transport electrode overcoating layer 63d is configured such that relative dielectric constant lowers sequentially in the order of the counter area CA, the downstream intermediate area TDIA, and the most downstream area TMDA.

Also, the counter electrode overcoating layer 65*d* of the present embodiment includes the high relative dielectric constant portion 65*d*1, the upstream low relative dielectric constant portion 65*d*2, the downstream low relative dielectric constant portion 65*d*3, an upstream intermediate relative dielectric constant portion 65*d*4, and a downstream intermediate relative dielectric constant portion 65*d*5.

The high relative dielectric constant portion 65*d*1 is provided at a position corresponding to the counter area neighboring area CNA.

The upstream low relative dielectric constant portion 65*d*2 is provided at a position corresponding to a most upstream area CMUA. The most upstream area CMUA is an area of the counter wiring substrate 65 located most upstream with respect to the toner transport direction TTD. The upstream low relative dielectric constant portion 65*d*2 is formed of a material lower in relative dielectric constant than the high relative dielectric constant portion 65*d*1.

The upstream intermediate relative dielectric constant portion 65*d*4 is provided at a position corresponding to an upstream intermediate area CUIA located between the most upstream area CMUA and the counter area neighboring area CNA. The upstream intermediate relative dielectric constant portion 65*d*4 is formed of a material whose relative dielectric constant falls between those of the high relative dielectric constant portion 65*d*1 and the upstream low relative dielectric constant portion 65*d*2.

The downstream low relative dielectric constant portion 65*d*3 is provided at a position corresponding to a most downstream area CMDA. The most downstream area CMDA is an area of the counter wiring substrate 65 located most downstream with respect to the toner transport direction TTD. The downstream low relative dielectric constant portion 65*d*3 is formed of a material lower in relative dielectric constant than the high relative dielectric constant portion 65*d*1.

The downstream intermediate relative dielectric constant portion 65*d*5 is provided at a position corresponding to a downstream intermediate area CDIA located between the most downstream area CMDA and the counter area neighboring area CNA. The downstream intermediate relative dielectric constant portion 65*d*5 is formed of a material whose relative dielectric constant falls between those of the high relative dielectric constant portion 65*d*1 and the downstream low relative dielectric constant portion 65*d*3.

That is, the counter electrode overcoating layer 65*d* is configured such that relative dielectric constant increases sequentially in the order of the most upstream area CMUA, the upstream intermediate area CUIA, and the counter area neighboring area CNA. Also, the counter electrode overcoating layer 65*d* is configured such that relative dielectric constant lowers sequentially in the order of the counter area neighboring area CNA, the downstream intermediate area CDIA, and the most downstream area CMDA.

According to the toner electric field transport body 62 (transport wiring substrate 63) of the present embodiment having the above-mentioned configuration, electric field strength lowers in the order of the most upstream area TMUA, the upstream intermediate area TUIA, and the counter area CA.

Thus, the toner T is accelerated in good condition in the most upstream area TMUA. Accordingly, the toner T can be supplied in good condition toward the counter area CA. Also, the toner T is smoothly decelerated in the course of transport from the most upstream area TMUA to the upstream intermediate area TUIA and then toward the counter area CA. Accordingly, in the counter area CA, the density of the toner T increases. Therefore, non-uniform presence of the toner T along the toner transport direction TTD can be effectively restrained.

Also, according to the toner electric field transport body 62 (transport wiring substrate 63) of the present embodiment having the above-mentioned configuration, electric field strength increases in the order of the counter area CA, the downstream intermediate area TDIA, and the most downstream area TMDA.

Thus, the toner T is smoothly accelerated in such a manner as to be transported beyond the counter area CA along the toner transport direction TTD. Accordingly, the stagnation of a large amount of the toner T in the counter area CA can be restrained. Also, the toner T which has passed the counter area CA can promptly return to the interior of the toner box 61.

According to the counter wiring substrate 65 of the present embodiment having the above-mentioned configuration, electric field strength lowers in the order of the most upstream area CMUA, the upstream intermediate area CUIA, and the counter area neighboring area CNA.

Thus, the toner T is accelerated in good condition in the most upstream area CMUA. Accordingly, the toner T can be supplied in good condition toward the counter area CA. Also, the toner T is smoothly decelerated in the course of transport from the most upstream area CMUA to the upstream intermediate area CUIA and then toward the counter area CA. Accordingly, in the counter area CA, the density of the toner T increases. Therefore, non-uniform presence of the toner T along the toner transport direction TTD can be effectively restrained.

Also, according to the counter wiring substrate 65 of the present embodiment having the above-mentioned configuration, electric field strength increases in the order of the counter area neighboring area CNA, the downstream intermediate area CDIA, and the most downstream area CMDA.

Thus, the toner T is smoothly accelerated in such a manner as to be transported beyond the counter area CA and the counter area neighboring area CNA along the toner transport direction TTD. Accordingly, the stagnation of a large amount of the toner T in the counter area CA and the counter area neighboring area CNA can be restrained. Also, the toner T which has passed the counter area CA can promptly return to the interior of the toner box 61.

According to the toner electric field transport body 62 (transport wiring substrate 63) and the counter wiring substrate 65 of the present embodiment having the above-mentioned configuration, the following areas (a) to (i) are arrayed in this order along the toner transport direction TTD.

(a) An area where the most upstream area CMUA (upstream low relative dielectric constant portion 65*d*2) of the counter wiring substrate 65 and the most upstream area TMUA (upstream low relative dielectric constant portion 63*d*2) of the toner electric field transport body 62 face each other.

(b) An area where the most upstream area CMUA (upstream low relative dielectric constant portion 65*d*2) of the counter wiring substrate 65 and the upstream intermediate area TUIA (upstream intermediate relative dielectric constant portion 63*d*4) of the toner electric field transport body 62 face each other.

(c) An area where the upstream intermediate area CUIA (upstream intermediate relative dielectric constant portion 65*d*4) of the counter wiring substrate 65 and the upstream intermediate area TUIA (upstream intermediate relative dielectric constant portion 63*d*4) of the toner electric field transport body 62 face each other.

(d) An area where the counter area neighboring area CNA (high relative dielectric constant portion 65*d*1) of the counter wiring substrate 65 and the upstream intermediate area TUIA (upstream intermediate relative dielectric constant portion 63*d*4) of the toner electric field transport body 62 face each other.

(e) An area where the toner passage hole 61*a*1 and the counter area CA (high relative dielectric constant portion 63*d*1) of the toner electric field transport body 62 face each other.

(f) An area where the counter area neighboring area CNA (high relative dielectric constant portion 65*d*1) of the counter wiring substrate 65 and the downstream intermediate area TDIA (downstream intermediate relative dielectric constant portion 63*d*5) of the toner electric field transport body 62 face each other.

(g) An area where the downstream intermediate area CDIA (downstream intermediate relative dielectric constant portion 65*d*5) of the counter wiring substrate 65 and the downstream intermediate area TDIA (downstream intermediate relative dielectric constant portion 63*d*5) of the toner electric field transport body 62 face each other.

(h) An area where the most downstream area CMDA (downstream low relative dielectric constant portion 65*d*3) of the counter wiring substrate 65 and the downstream intermediate area TDIA (downstream intermediate relative dielectric constant portion 63*d*5) of the toner electric field transport body 62 face each other.

(i) An area where the most downstream area CMDA (downstream low relative dielectric constant portion 65*d*3) of the counter wiring substrate 65 and the most downstream area TMDA (downstream low relative dielectric constant portion 63*d*3) of the toner electric field transport body 62 face each other.

In the above-mentioned configuration, electric field strength lowers in the order of (a) to (e). Also, electric field strength increases in the order of (e) to (i).

In the above-mentioned configuration, the toner T can be smoothly decelerated in the course of transport from (a) to (e). Also, the toner T can be smoothly accelerated in the course of transport from (e) to (i).

As mentioned above, by means of the toner electric field transport body 62 (transport wiring substrate 63) and the counter wiring substrate 65 of the present embodiment, the toner T can be accelerated and decelerated more smoothly.

Fifth Embodiment of Toner Supply Apparatus

The configuration of a fifth embodiment of the present invention will be described with reference to FIG. 16.

FIG. 16 is a side sectional view showing, on an enlarged scale, the transport wiring substrate 63 and the counter wiring substrate 65 in the fifth embodiment of the toner supply apparatus 6 shown in FIG. 2.

Referring to FIG. 16, in the present embodiment, in place of the transport electrode overcoating layer 63*d* in FIG. 15, the transport electrode coating layer 63*c* includes the high relative dielectric constant portion 63*c*1, the upstream low relative dielectric constant portion 63*c*2, the downstream low relative dielectric constant portion 63*c*3, an upstream intermediate relative dielectric constant portion 63*c*4, and a downstream intermediate relative dielectric constant portion 63*c*5.

The upstream low relative dielectric constant portion 63*c*2 is provided at a position corresponding to the most upstream area TMUA. The upstream low relative dielectric constant portion 63*c*2 is formed of a material lower in relative dielectric constant than the high relative dielectric constant portion 63*c*1.

The upstream intermediate relative dielectric constant portion 63*c*4 is provided at a position corresponding to the upstream intermediate area TUIA located between the most upstream area TMUA and the counter area CA. The upstream intermediate relative dielectric constant portion 63*c*4 is formed of a material whose relative dielectric constant falls between those of the high relative dielectric constant portion 63*c*1 and the upstream low relative dielectric constant portion 63*c*2.

The downstream low relative dielectric constant portion 63*c*3 is provided at a position corresponding to the most downstream area TMDA. The downstream low relative dielectric constant portion 63*c*3 is formed of a material lower in relative dielectric constant than the high relative dielectric constant portion 63*c*1.

The downstream intermediate relative dielectric constant portion 63*c*5 is provided at a position corresponding to the downstream intermediate area TDIA located between the most downstream area TMDA and the counter area CA. The downstream intermediate relative dielectric constant portion 63*c*5 is formed of a material whose relative dielectric constant falls between those of the high relative dielectric constant portion 63*c*1 and the downstream low relative dielectric constant portion 63*c*3.

That is, the transport electrode coating layer 63*c* is configured such that relative dielectric constant lowers in the order of the most upstream area TMUA, the upstream intermediate area TUIA, and the counter area CA. Also, the transport electrode coating layer 63*c* is configured such that relative dielectric constant increases in the order of the counter area CA, the downstream intermediate area TDIA, and the most downstream area TMDA.

Also, in the present embodiment, in place of the counter electrode overcoating layer 65*d* in FIG. 15, the counter electrode coating layer 65*c* includes the high relative dielectric constant portion 65*c*1, the upstream low relative dielectric constant portion 65*c*2, the downstream low relative dielectric constant portion 65*c*3, an upstream intermediate relative dielectric constant portion 65*c*4, and a downstream intermediate relative dielectric constant portion 65*c*5.

The high relative dielectric constant portion 65*c*1 is provided at a position corresponding to the counter area neighboring area CNA.

The upstream low relative dielectric constant portion 65*c*2 is provided at a position corresponding to the most upstream area CMUA. The upstream low relative dielectric constant portion 65*c*2 is formed of a material lower in relative dielectric constant than the high relative dielectric constant portion 65*c*1.

The upstream intermediate relative dielectric constant portion 65*c*4 is provided at a position corresponding to the upstream intermediate area CUIA located between the most upstream area CMUA and the counter area neighboring area CNA. The upstream intermediate relative dielectric constant portion 65*c*4 is formed of a material whose relative dielectric constant falls between those of the high relative dielectric constant portion 65*c*1 and the upstream low relative dielectric constant portion 65*c*2.

The downstream low relative dielectric constant portion 65*c*3 is provided at a position corresponding to the most downstream area CMDA. The downstream low relative dielectric constant portion 65*c*3 is formed of a material lower in relative dielectric constant than the high relative dielectric constant portion 65*c*1.

The downstream intermediate relative dielectric constant portion 65*c*5 is provided at a position corresponding to the downstream intermediate area CDIA located between the most downstream area CMDA and the counter area neighboring area CNA. The downstream intermediate relative dielectric constant portion 65*c*5 is formed of a material whose relative dielectric constant falls between those of the high relative dielectric constant portion 65*c*1 and the downstream low relative dielectric constant portion 65*c*3.

That is, the counter electrode coating layer 65*c* is configured such that relative dielectric constant increases sequentially in the order of the most upstream area CMUA, the upstream intermediate area CUIA, and the counter area neighboring area CNA. Also, the counter electrode coating layer 65*c* is configured such that relative dielectric constant lowers sequentially in the order of the counter area neighboring area CNA, the downstream intermediate area CDIA, and the most downstream area CMDA.

Even the above-mentioned configuration yields actions and effects similar to those which the above-described fourth embodiment yields.

Sixth Embodiment of Toner Supply Apparatus

The configuration of a sixth embodiment of the present invention will be described with reference to FIG. 17.

Figure 17:
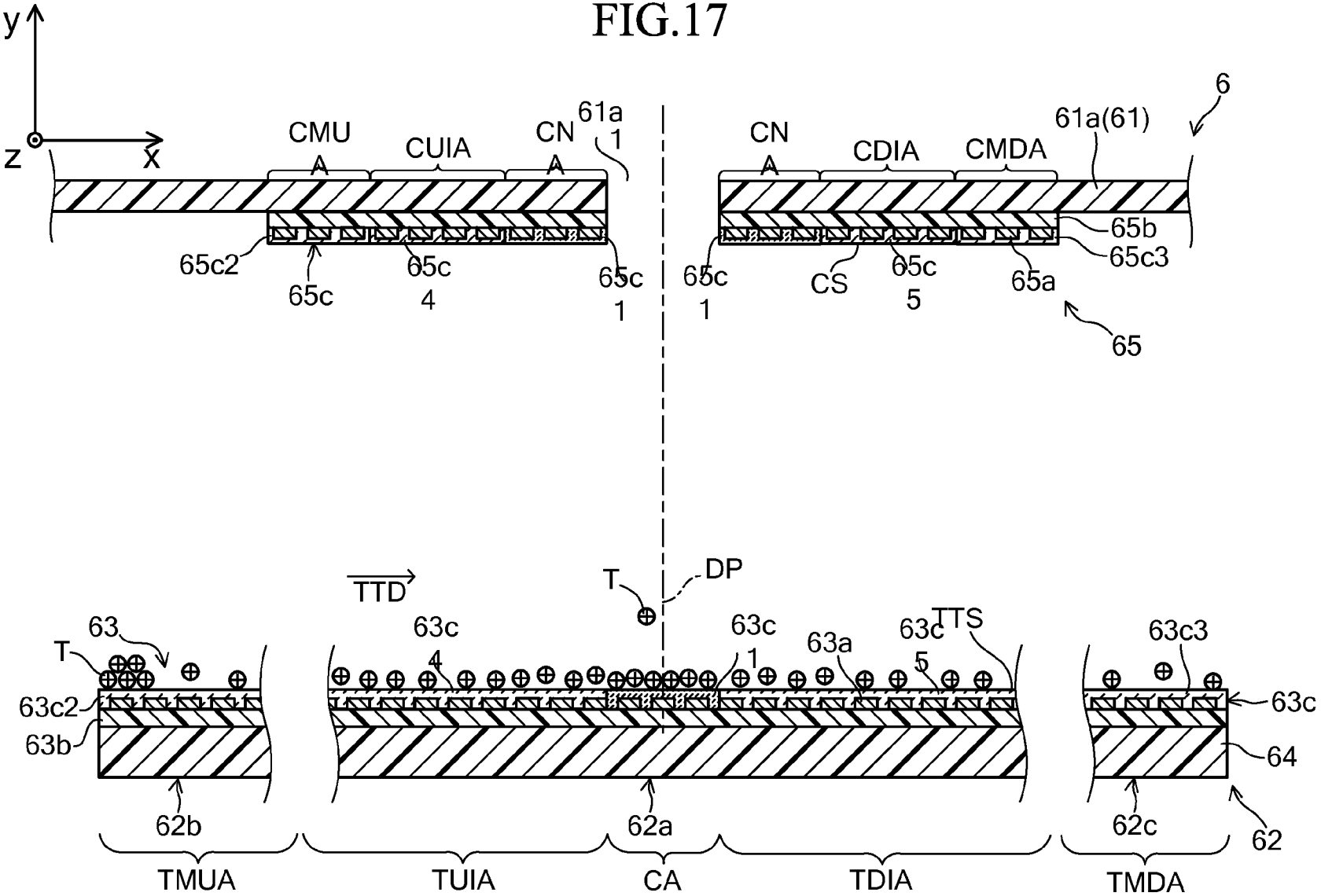
FIG. 17 is a side sectional view showing, on an enlarged scale, the transport wiring substrate and the counter wiring substrate in a sixth embodiment of the toner supply apparatus shown in FIG. 2.

FIG. 17 is a side sectional view showing, on an enlarged scale, the periphery of the developing position DP in the sixth embodiment of the toner supply apparatus 6 shown in FIG. 2.

Referring to FIG. 17, in the present embodiment, the transport electrode overcoating layer 63*d* (see FIG. 16) employed in the configuration of the above-described fifth embodiment is eliminated. That is, in the present embodiment, the transport electrode coating layer 63*c* serves as the transport electrode cover member of the present invention.

Also, in the present embodiment, the counter electrode overcoating layer 65*d* (see FIG. 16) employed in the configuration of the above-described fifth embodiment is eliminated. That is, in the present embodiment, the counter electrode coating layer 65*c* serves as the counter electrode cover member of the present invention.

Even the above-mentioned configuration yields actions and effects similar to those which the above-described fourth and fifth embodiments yield.

Seventh Embodiment of Toner Supply Apparatus

The configuration of a seventh embodiment of the present invention will be described with reference to FIG. 18.

Figure 18:
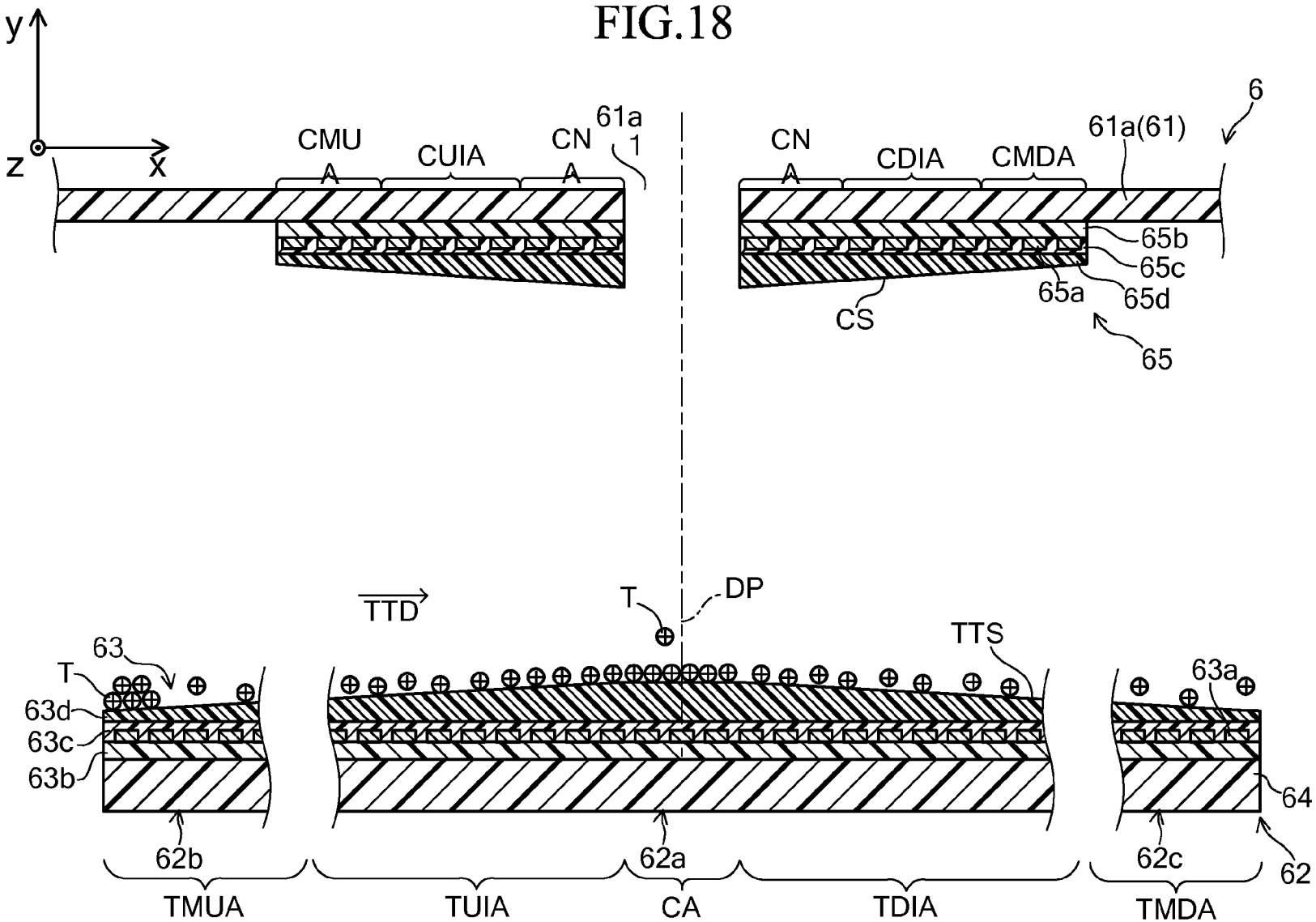
FIG. 18 is a side sectional view showing, on an enlarged scale, the transport wiring substrate and the counter wiring substrate in a seventh embodiment of the toner supply apparatus shown in FIG. 2.

FIG. 18 is a side sectional view showing, on an enlarged scale, the transport wiring substrate 63 and the counter wiring substrate 65 in the seventh embodiment of the toner supply apparatus 6 shown in FIG. 2.

Referring to FIG. 18, in the present embodiment, the transport electrode overcoating layer 63*d* is configured such that its thickness increases in the direction from the most upstream area TMUA to the upstream intermediate area TUIA and then toward the counter area CA. Also, the transport electrode overcoating layer 63*d* is configured such that its thickness reduces in the direction from the counter area CA to the downstream intermediate area TDIA and then toward the most downstream area TMDA.

Also, in the present embodiment, the counter electrode overcoating layer 65*d* is configured such that its thickness increases in the direction from the most upstream area CMUA to the upstream intermediate area CUIA and then toward the counter area neighboring area CNA. Also, the counter electrode overcoating layer 65*d* is configured such that its thickness reduces in the direction from the counter area neighboring area CNA to the downstream intermediate area CDIA and then toward the most downstream area CMDA.

According to the above-mentioned configuration, electric field strength on the toner transport surface TTS and that on the counter wiring substrate surface CS gradually varies in the toner transport direction TTD. Thus, similar to the above-described fourth to sixth embodiments, the toner T can be more smoothly accelerated and decelerated.

Eighth Embodiment of Toner Supply Apparatus

The configuration of an eighth embodiment of the present invention will be described with reference to FIG. 19.

Figure 19:
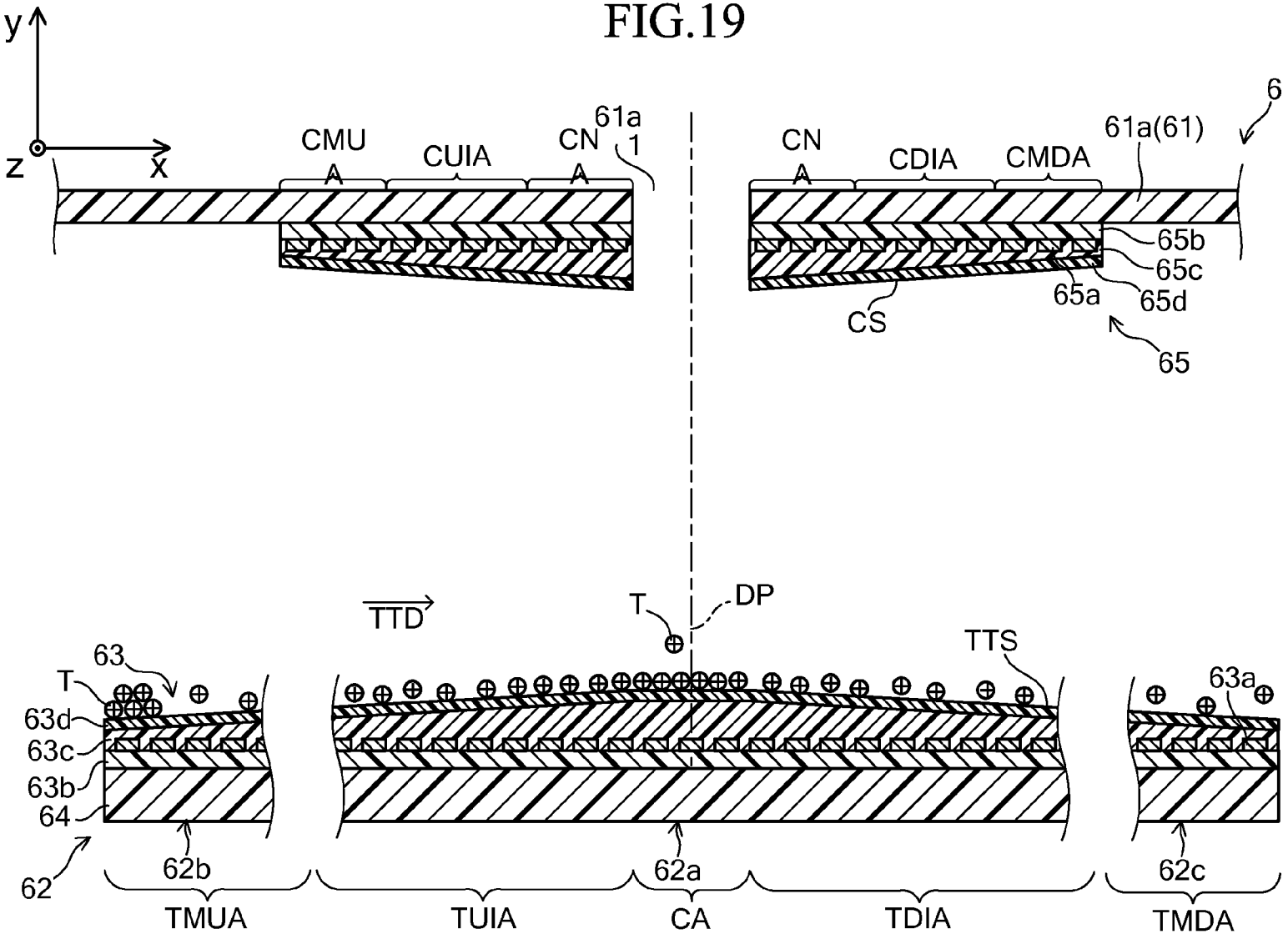
FIG. 19 is a side sectional view showing, on an enlarged scale, the transport wiring substrate and the counter wiring substrate in an eighth embodiment of the toner supply apparatus shown in FIG. 2.

FIG. 19 is a side sectional view showing, on an enlarged scale, the transport wiring substrate 63 and the counter wiring substrate 65 in the eighth embodiment of the toner supply apparatus 6 shown in FIG. 2.

Referring to FIG. 19, in the present embodiment, in place of the transport electrode overcoating layer 63*d* in FIG. 18, the transport electrode coating layer 63*c* is configured such that its thickness gradually varies in the toner transport direction TTD.

Specifically, the transport electrode coating layer 63*c* is configured such that its thickness increases in the direction from the most upstream area TMUA to the upstream intermediate area TUIA and then toward the counter area CA. Also, the transport electrode coating layer 63*c* is configured such that its thickness reduces in the direction from the counter area CA to the downstream intermediate area TDIA and then toward the most downstream area TMDA.

Also, in the present embodiment, in place of the counter electrode overcoating layer 65*d* in FIG. 18, the counter electrode coating layer 65*c* is configured such that its thickness gradually varies in the toner transport direction TTD.

Specifically, the counter electrode coating layer 65*c* is configured such that its thickness increases in the direction from the most upstream area CMUA to the upstream intermediate area CUIA and then toward the counter area neighboring area CNA. Also, the counter electrode coating layer 65*c* is configured such that its thickness reduces in the direction from the counter area neighboring area CNA to the downstream intermediate area CDIA and then toward the most downstream area CMDA.

According to the above-mentioned configuration, electric field strength on the toner transport surface TTS and that on the counter wiring substrate surface CS gradually varies in the toner transport direction TTD. Thus, similar to the above-described fourth to seventh embodiments, the toner T can be more smoothly accelerated and decelerated.

Ninth Embodiment of Toner Supply Apparatus

The configuration of a ninth embodiment of the present invention will be described with reference to FIG. 20.

Figure 20:
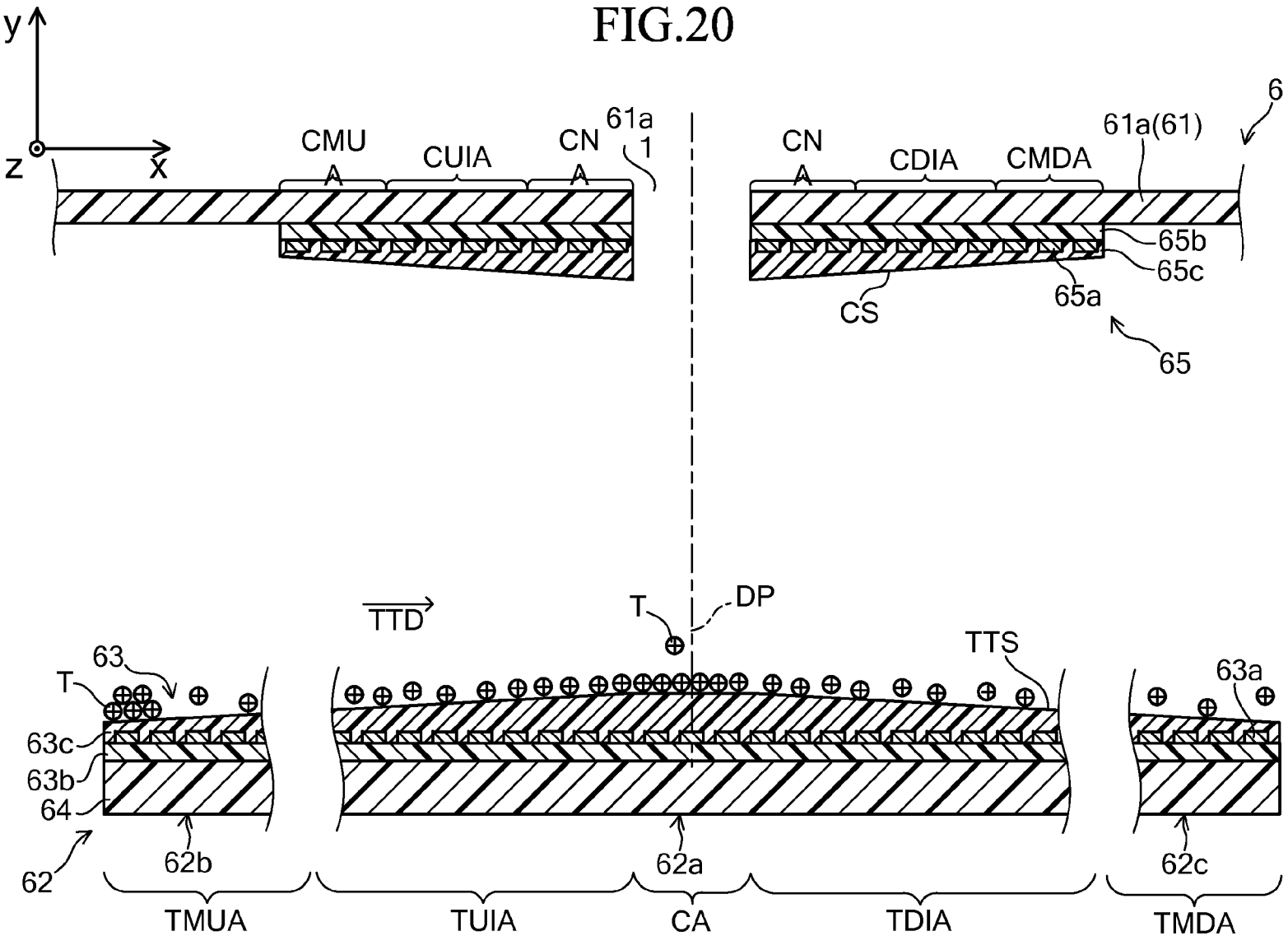
FIG. 20 is a side sectional view showing, on an enlarged scale, the transport wiring substrate and the counter wiring substrate in a ninth embodiment of the toner supply apparatus shown in FIG. 2.

FIG. 20 is a side sectional view showing, on an enlarged scale, the periphery of the developing position DP in the ninth embodiment of the toner supply apparatus 6 shown in FIG. 2.

Referring to FIG. 20, in the present embodiment, the transport electrode overcoating layer 63*d* (see FIG. 19) employed in the configuration of the above-described eighth embodiment is eliminated. That is, in the present embodiment, the transport electrode coating layer 63*c* serves as the transport electrode cover member of the present invention.

Also, in the present embodiment, the counter electrode overcoating layer 65*d* (see FIG. 19) employed in the configuration of the above-described eighth embodiment is eliminated. That is, in the present embodiment, the counter electrode coating layer 65*c* serves as the counter electrode cover member of the present invention.

Even the above-mentioned configuration yields actions and effects similar to those which the above-described eighth embodiment yields.

Tenth Embodiment of Toner Supply Apparatus

The configuration of a tenth embodiment of the present invention will be described with reference to FIG. 21.

Figure 21:
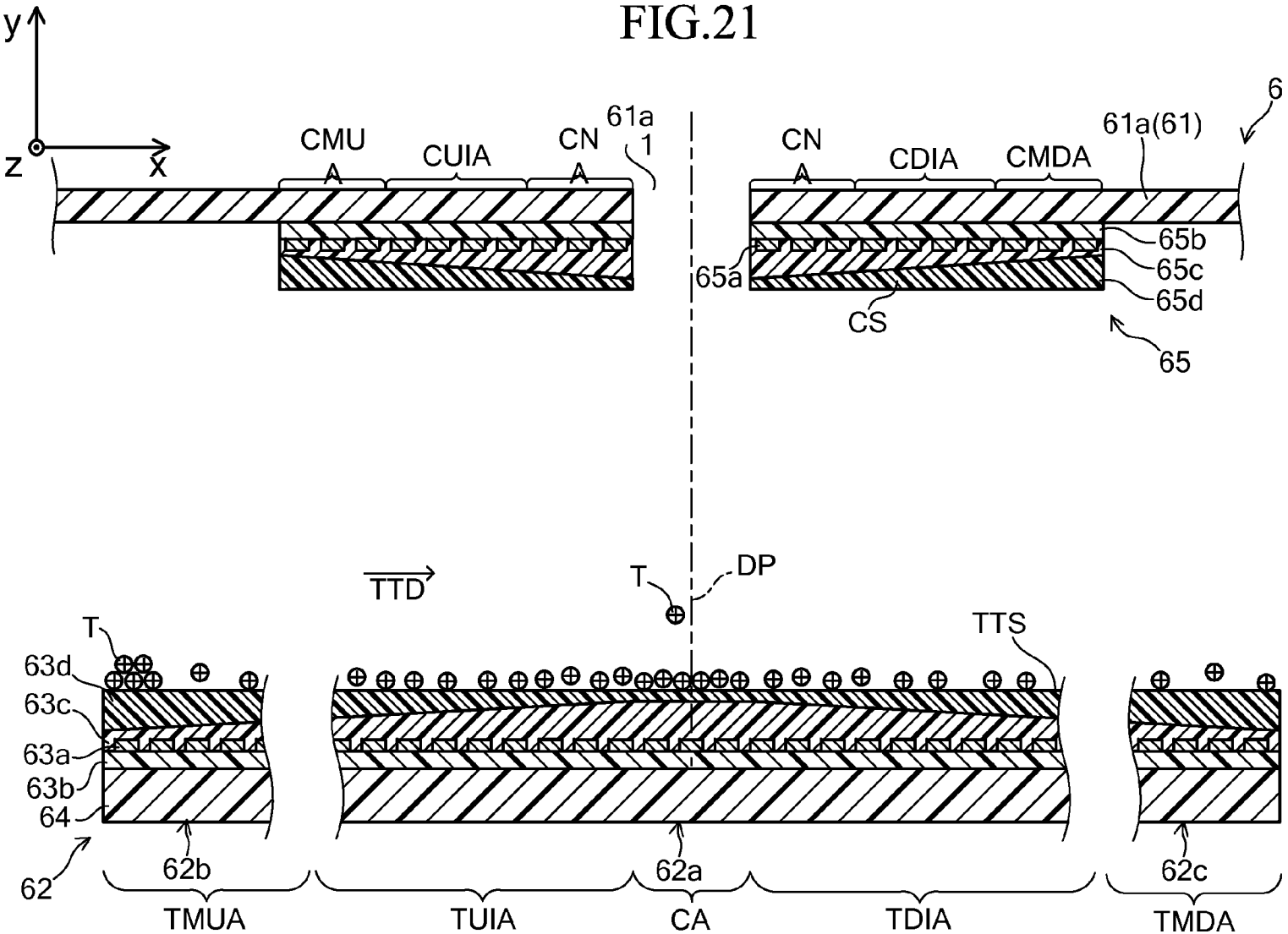
FIG. 21 is a side sectional view showing, on an enlarged scale, the transport wiring substrate and the counter wiring substrate in a tenth embodiment of the toner supply apparatus shown in FIG. 2.

FIG. 21 is a side sectional view showing, on an enlarged scale, the transport wiring substrate 63 and the counter wiring substrate 65 in the tenth embodiment of the toner supply apparatus 6 shown in FIG. 2.

Referring to FIG. 21, in the present embodiment, the transport electrode coating layer 63*c* is formed thinner in those areas which are located upstream of and downstream of the counter area CA with respect to the toner transport direction TTD, than in the counter area CA. That is, the transport electrode coating layer 63*c* is configured such that its thickness increases in the direction from the most upstream area TMUA to the upstream intermediate area TUIA and then toward the counter area CA. Also, the transport electrode coating layer 63*c* is configured such that its thickness reduces in the direction from the counter area CA to the downstream intermediate area TDIA and then toward the most downstream area TMDA.

Also, the transport electrode overcoating layer 63*d* is formed thicker in those areas which are located upstream of and downstream of the counter area CA with respect to the toner transport direction TTD, than in the counter area CA. That is, the transport electrode overcoating layer 63*d* is configured such that its thickness reduces in the direction from the most upstream area TMUA to the upstream intermediate area TUIA and then toward the counter area CA. Also, the transport electrode overcoating layer 63*d* is configured such that its thickness increases in the direction from the counter area CA to the downstream intermediate area TDIA and then toward the most downstream area TMDA.

A laminate of the transport electrode coating later 63*c* and the transport electrode overcoating layer 63*d* is formed into the form of a flat plate so as to have a substantially fixed thickness. Furthermore, the transport electrode overcoating layer 63*d* is formed of a material whose relative dielectric constant is lower than the transport electrode coating layer 63*c*.

Also, in the present embodiment, the counter electrode coating layer 65*c* is formed thinner in those areas which are located upstream of and downstream of the counter area neighboring area CNA with respect to the toner transport direction TTD, than in the counter area neighboring area CNA. That is, the counter electrode coating layer 65*c* is configured such that its thickness increases in the direction from the most upstream area CMUA to the upstream intermediate area CUIA and then toward the counter area CA. Also, the counter electrode coating layer 65*c* is configured such that its thickness reduces in the direction from the counter area CA to the downstream intermediate area CDIA and then toward the most downstream area CMDA.

Also, the counter electrode overcoating layer 65*d* is formed thicker in those areas which are located upstream of and downstream of the counter area neighboring area CNA with respect to the toner transport direction TTD, than in the counter area neighboring area CNA. That is, the counter electrode overcoating layer 65*d* is configured such that its thickness reduces in the direction from the most upstream area CMUA to the upstream intermediate area CUIA and then toward the counter area CA. Also, the counter electrode overcoating layer 65*d* is configured such that its thickness increases in the direction from the counter area CA to the downstream intermediate area CDIA and then toward the most downstream area CMDA.

A laminate of the counter electrode coating later 65*c* and the counter electrode overcoating layer 65*d* is formed into the form of a flat plate so as to have a substantially fixed thickness. Furthermore, the counter electrode overcoating layer 65*d* is formed of a material whose relative dielectric constant is lower than the counter electrode coating layer 65*c*.

In the toner electric field transport body 62 (transport wiring substrate 63) of the present embodiment having the above-mentioned configuration, the (combined) relative dielectric constant of the laminate of the transport electrode overcoating layer 63*d* and the transport electrode coating layer 63*c* is lower in those areas which are located upstream of and downstream of the counter area CA with respect to the toner transport direction TTD, than in the counter area CA. Thus, when traveling wave voltages are applied to the transport electrodes 63*a*, electric field strength is higher in the upstream and downstream areas with respect to the toner transport direction TTD than in the counter area CA.

Also, in the counter wiring substrate 65 of the present embodiment having the above-mentioned configuration, the (combined) relative dielectric constant of the laminate of the counter electrode overcoating layer 65*d* and the counter electrode coating layer 65*c* is lower in those areas which are located upstream of and downstream of the counter area neighboring area CNA with respect to the toner transport direction TTD, than in the counter area neighboring area CNA. Thus, when traveling wave voltages are applied to the counter electrodes 65*a*, electric field strength is higher in the upstream and downstream areas with respect to the toner transport direction TTD than in the counter area neighboring area CNA.

The above-mentioned configuration yields actions and effects similar to those which the above-described embodiments yield.

Eleventh Embodiment of Toner Supply Apparatus

The configuration of an eleventh embodiment of the present invention will be described with reference to FIG. 22.

Figure 22:
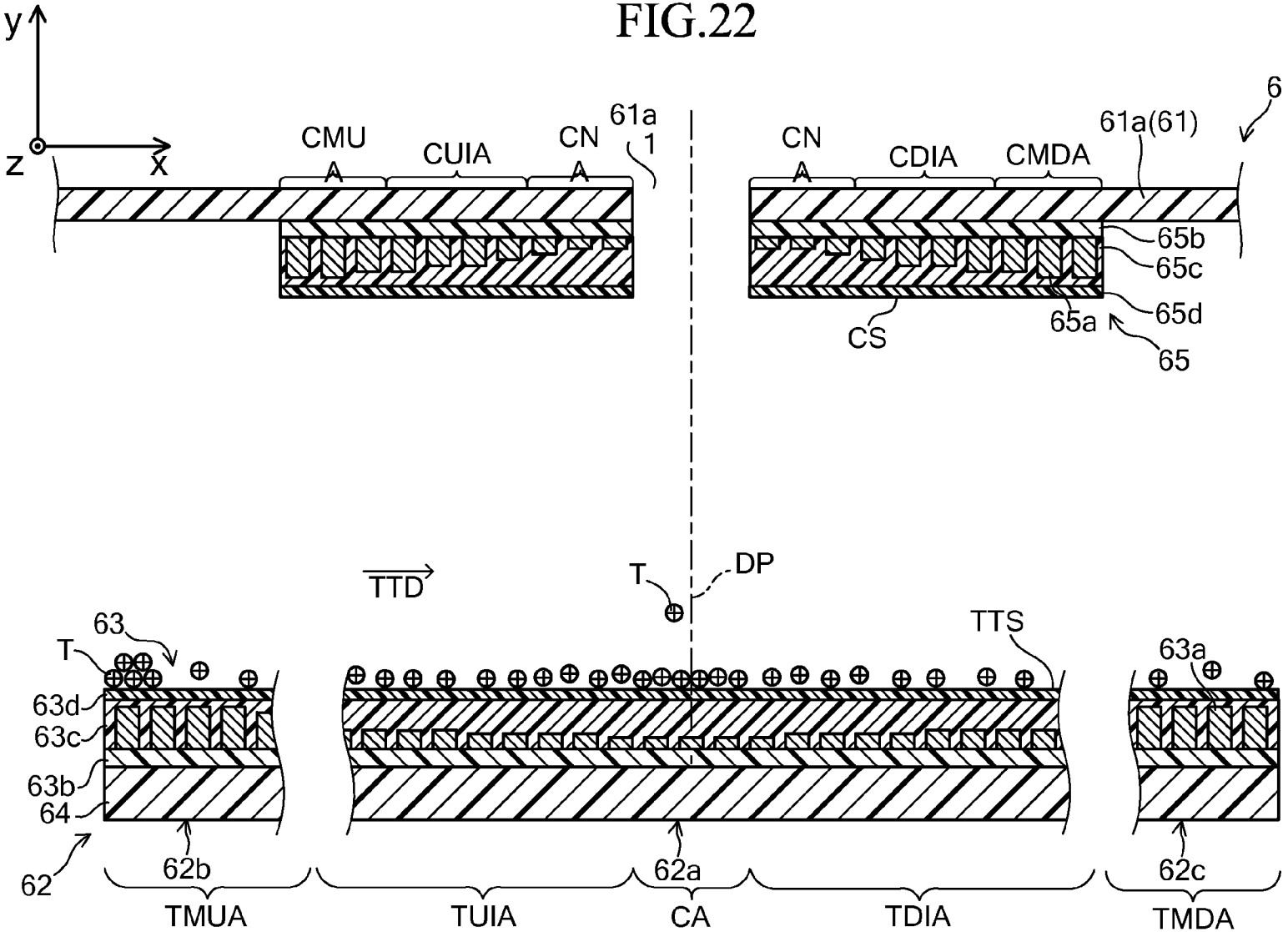
FIG. 22 is a side sectional view showing, on an enlarged scale, the transport wiring substrate and the counter wiring substrate in an eleventh embodiment of the toner supply apparatus shown in FIG. 2.

FIG. 22 is a side sectional view showing, on an enlarged scale, the transport wiring substrate 63 and the counter wiring substrate 65 in the eleventh embodiment of the toner supply apparatus 6 shown in FIG. 2.

Referring to FIG. 22, in the present embodiment, the transport electrodes 63*a* are configured such that their thickness gradually varies in the toner transport direction TTD.

Specifically, the transport electrodes 63*a* are configured such that their thickness gradually reduces in the direction from the most upstream area TMUA to the upstream intermediate area TUIA and then toward the counter area CA. Also, the transport electrodes 63*a* are configured such that their thickness increases in the direction from the counter area CA to the downstream intermediate area TDIA and then toward the most downstream area TMDA.

Also, in the present embodiment, the counter electrodes 65*a* are configured such that their thickness gradually varies in the toner transport direction TTD.

Specifically, the counter electrodes 65*a* are configured such that their thickness gradually reduces in the direction from the most upstream area CMUA to the upstream intermediate area CUIA and then toward the counter area neighboring area CNA. Also, the counter electrodes 65*a* are configured such that their thickness increases in the direction from the counter area neighboring area CNA to the downstream intermediate area CDIA and then toward the most downstream area CMDA.

According to the above-mentioned configuration, similar to the configuration of the above-described fourth embodiment, electric field strength on the toner transport surface TTS and that on the counter wiring substrate surface CS gradually varies in the toner transport direction TTD. Thus, similar to the above-described fourth to tenth embodiments, the toner T can be more smoothly accelerated and decelerated.

<Modifications of First Mode>

In the following description of modifications, members similar in structure and function to those used in the above-described mode and embodiments can be denoted by the same reference numerals as those of the above-described mode and embodiments. As for the description of these members, an associated description appearing in the description of the above mode and embodiments can be cited, so long as no technical inconsistencies are involved (the same convention also applies to a second mode to be described later).

(1) In the above-described embodiments, the transport wiring substrate 63 and the counter wiring substrate 65 can be used singly.

Also, the transport wiring substrate 63 and the counter wiring substrate 65 can be used in any combination.

For example, in place of the transport electrode coating layer 63*c* of the transport wiring substrate 63 in FIG. 3, the transport electrode coating layer 63*c* in FIG. 13 (the transport electrode coating layer 63*c* which includes the high relative dielectric constant portion 63*c*1, the upstream low relative dielectric constant portion 63*c*2, and the downstream low relative dielectric constant portion 63*c*3) can be applied.

Alternatively, the transport wiring substrate 63 in FIG. 3 and the counter wiring substrate 65 in FIG. 14 can be combined.

In order to avoid redundancy, all combinations cannot be illustrated, but, of course, other combinations are also possible and are encompassed in the technical scope of the present invention.

(2) In FIG. 3, the high relative dielectric constant portion 63*d*1 of the transport wiring substrate 63 may be provided in such a manner as to project from the upstream and/or downstream end of the counter area CA with respect to the toner transport direction TTD. That is, the high relative dielectric constant portion 63*d*1 of the transport wiring substrate 63 may face the high relative dielectric constant portion(s) 65*d*1 of the counter wiring substrate 65.

(3) In the above-described embodiments, variation of relative dielectric constant or thickness may be continuous or stepwise.

Also, in FIG. 14, etc., boundary positions of the upstream intermediate area CUIA, the downstream intermediate area CDIA, the upstream intermediate area TUIA, and the downstream intermediate area TDIA are not limited to those described and illustrated in the above description of the embodiments.

Furthermore, in FIG. 14, etc., each of the upstream intermediate area CUIA, the downstream intermediate area CDIA, the upstream intermediate area TUIA, and the downstream intermediate area TDIA can further be divided into a plurality of areas.

(4) In FIGS. 18 and 19, the counter wiring substrate surface CS may be formed as a plane parallel to the x-z plane.

Also, in FIGS. 18 and 19, the toner transport surface TTS of the central component portion 62*a* (at least a portion of the toner transport surface TTS which faces the counter wiring substrate surface CS) may be formed as a plane parallel to the x-z plane.

(5) In the tenth embodiment shown in FIG. 21, the relation between the transport electrode coating layer 63*c* and the transport electrode overcoating layer 63*d* with respect to the thickness and relative dielectric constant may be reversed.

Specifically, the following configuration may be employed: the transport electrode coating layer 63*c* is formed thicker in those areas which are located upstream of and downstream of the counter area CA with respect to the toner transport direction TTD, than in the counter area CA; the transport electrode overcoating layer 63*d* is formed thinner in those areas which are located upstream of and downstream of the counter area CA with respect to the toner transport direction TTD, than in the counter area CA; and the transport electrode overcoating layer 63*d* is formed of a material whose relative dielectric constant is higher than the transport electrode coating layer 63*c*.

[2] Next, a second mode for carrying out the present invention will be described.

<Configuration of Laser Printer>

The present mode has the same basic configuration (configuration shown in FIG. 1) as that of the first mode described above. Thus, while the above description of the basic configuration is cited, configurational features peculiar to the present mode will be described below.

<<Toner Supply Apparatus>>

The toner box 61, which serves as the casing of the toner supply apparatus 6, is a box-like member and is configured to be able to contain therein the toner T, which is a particulate dry developer. In the present mode, the toner T is a positively chargeable, non-magnetic one-component, black toner.

The top plate 61*a* of the toner box 61 is disposed in the vicinity of the photoconductor drum 3. The top plate 61*a* has the toner passage hole 61*a*1. The toner passage hole 61*a*1 is formed at a position where the top plate 61*a* and the photoconductive layer 32 are in the proximity to each other.

As viewed in plane, the toner passage hole 61*a*1 assumes the form of a rectangle whose long sides have substantially the same length as the width of the photoconductive layer 32 along the main scanning direction (z-axis direction in FIG. 2) and whose short sides are in parallel with the sub-scanning direction (x-axis direction in FIG. 2). The toner passage hole 61*a*1 is formed as a through-hole for allowing the toner T to move from the inside of the toner box 61 toward the photoconductive layer 32 along the y-axis direction in FIG. 2.

<<<Schematic Configuration of Toner Transport Body>>>

The toner box 61 houses the toner electric field transport body 62, which serves as the developer electric field transport apparatus of the present invention.

Figure 23:
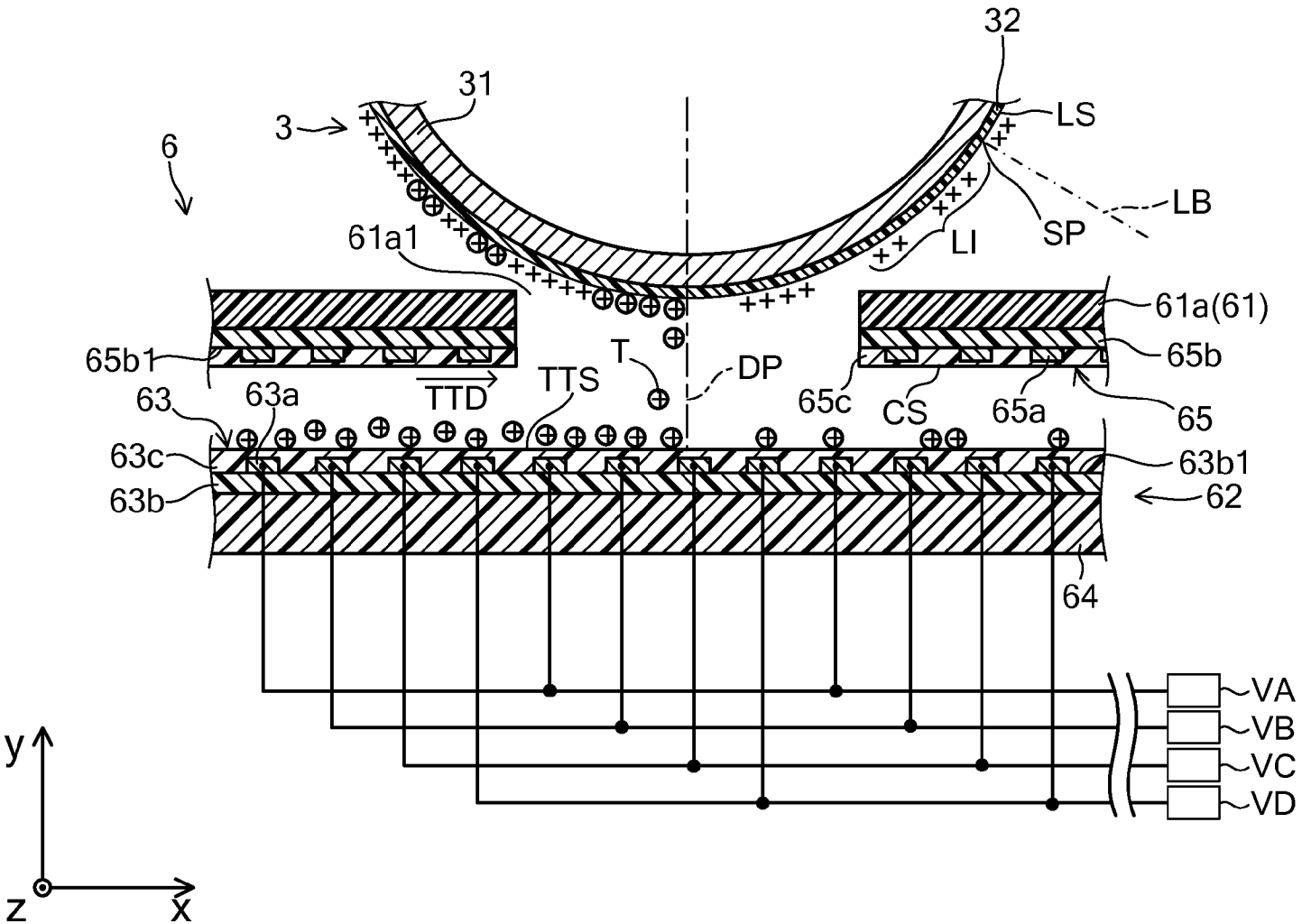
FIG. 23 is a side sectional view showing, on an enlarged scale, a region where a photoconductor drum and a toner supply apparatus in a second mode of the laser printer shown in FIG. 1 face each other.

Referring to FIG. 23, the toner electric field transport body 62 includes the transport wiring substrate 63. The transport wiring substrate 63 is disposed in such a manner as to face the latent image forming surface LS with the top plate 61*a* and the toner passage hole 61*a*1 of the toner box 61 therebetween.

The toner transport surface TTS, which serves as the developer transport surface of the present invention, is formed in parallel with the main scanning direction (z-axis direction in FIG. 23). The toner transport surface TTS is provided in such a manner as to face the latent image forming surface LS of the photoconductor drum 3. Also, the developing position DP, which is a closest proximity position where the latent image forming surface LS and the toner transport surface TTS are in the closest proximity to each other, substantially coincides with the center of the toner passage hole 61*a*1 along the sub-scanning direction (x-axis direction in FIG. 23).

The transport wiring substrate 63 has a configuration similar to that of a flexible printed wiring substrate.

The plurality of transport electrodes 63*a* are formed on the surface (transport electrode support surface 63*b*1) of the transport electrode support film 63*b*, which serves as the transport electrode support member of the present invention. The transport electrodes 63*a* are formed of a copper foil having a thickness of several tens of micrometers. The transport electrode support film 63*b* is a flexible film and is formed of an electrically insulative synthetic resin, such as polyimide resin.

The plurality of transport electrodes 63*a* are in the form of a linear wiring pattern whose longitudinal direction is in parallel with the main scanning direction (the longitudinal direction is orthogonal to the sub-scanning direction). The plurality of transport electrodes 63*a* are disposed in parallel with one another. The transport electrodes 63*a* are arrayed along the sub-scanning direction.

A large number of the transport electrodes 63*a* arrayed along the sub-scanning direction are connected to power circuits such that every fourth transport electrode 63*a* is connected to the same power circuit.

Specifically, the transport electrode 63*a* connected to the power circuit VA, the transport electrode 63*a* connected to the power circuit VB, the transport electrode 63*a* connected to the power circuit VC, the transport electrode 63*a* connected to the power circuit VD, the transport electrode 63*a* connected to the power circuit VA, the transport electrode 63*a* connected to the power circuit VB, the transport electrode 63*a* connected to the power circuit VC . . . are sequentially arrayed along the sub-scanning direction.

The power circuits VA to VD are configured to be able to output AC voltages (transport voltages) of substantially the same waveform. Also, the power circuits VA to VD are configured such that the waveforms of voltages generated by the power circuits VA to VD shift 90° in phase from one another. That is, in the sequence of the power circuits VA to VD, the phase of voltage delays in increments of 90°.

The transport electrode coating layer 63*c*, which serves as an electrode coating layer of the present invention, is formed of an electrically insulative synthetic resin. The transport electrode coating layer 63*c* is provided in such a manner as to cover the transport electrodes 63*a* and a transport electrode support surface 63*b*1 of the transport electrode support film 63*b*.

The above-mentioned toner transport surface TTS is implemented by the surface of the transport electrode overcoating layer 63*c* generally parallel to the transport electrode support surface 63*b*1 and is formed as a smooth surface with much less pits and projections.

As mentioned above, in the present mode, the transport electrodes 63*a* are disposed along the toner transport surface TTS. That is, the transport electrodes 63*a* are disposed in the vicinity of the toner transport surface TTS.

The toner electric field transport body 62 also includes the transport substrate support member 64. The transport substrate support member 64 is formed of a plate material of a synthetic resin and is provided so as to support the transport wiring substrate 63 from underneath.

The toner electric field transport body 62 of the present mode is configured such that the toner transport direction TTD extends along the sub-scanning direction, along which the transport electrodes 63*a* are arrayed.

The toner electric field transport body 62 is configured as follows: the above-mentioned transport voltages are applied to the transport electrodes 63*a* of the transport wiring substrate 63 so as to generate traveling wave electric fields along the sub-scanning direction, whereby the positively charged toner T can be transported in the toner transport direction TTD.

<<<Counter Wiring Substrate>>>

Referring to FIG. 23, the counter wiring substrate 65 is attached to the inner surface of the top plate 61*a* of the toner box 61. The counter wiring substrate 65 is disposed in such a manner as to face the toner transport surface TTS with a predetermined gap therebetween.

The counter wiring substrate 65 has a configuration similar to that of the above-mentioned transport wiring substrate 63.

Specifically, the plurality of counter electrodes 65*a* are supported on the surface (counter electrode support surface 65*b*1) of the counter electrode support film 65*b*. The counter electrodes 65*a* are formed of a copper foil having a thickness of several tens of micrometers. The counter electrode support film 65*b* is a flexible film and is formed of an electrically insulative synthetic resin, such as polyimide resin.

The plurality of counter electrodes 65*a* are in the form of a linear wiring pattern whose longitudinal direction is in parallel with the main scanning direction (the longitudinal direction is orthogonal to the sub-scanning direction). The plurality of counter electrodes 65*a* are disposed in parallel with one another. The counter electrodes 65*a* are arrayed along the sub-scanning direction.

A large number of the counter electrodes 65*a* arrayed along the sub-scanning direction are connected to power circuits such that every fourth transport electrode 63*a* is connected to the same power circuit.

The counter electrode coating layer 65*c* is formed of an electrically insulative synthetic resin. The counter electrode coating layer 65*c* is provided in such a manner as to cover the counter electrodes 65*a* and the counter electrode support surface 65*b*1 of the counter electrode support film 65*b*.

The counter wiring substrate surface CS is implemented by the counter electrode coating layer 65*c* substantially in parallel with the counter electrode support surface 65*b*1 and is formed as a smooth surface with much less pits and projections.

As mentioned above, in the present mode, the counter electrodes 65*a* are disposed along the counter wiring substrate surface CS. That is, the counter electrodes 65*a* are disposed in the vicinity of the counter wiring substrate surface CS.

Similar to the above-mentioned transport wiring substrate 63, the counter wiring substrate 65 is configured as follows: predetermined voltages are applied to the plurality of counter electrodes 65*a* so as to generate traveling wave electric fields along the sub-scanning direction, whereby the positively charged toner T can be transported in the toner transport direction TTD.

<<Detailed Configuration of Transport Wiring Substrate of Present Mode>>

Figure 24:
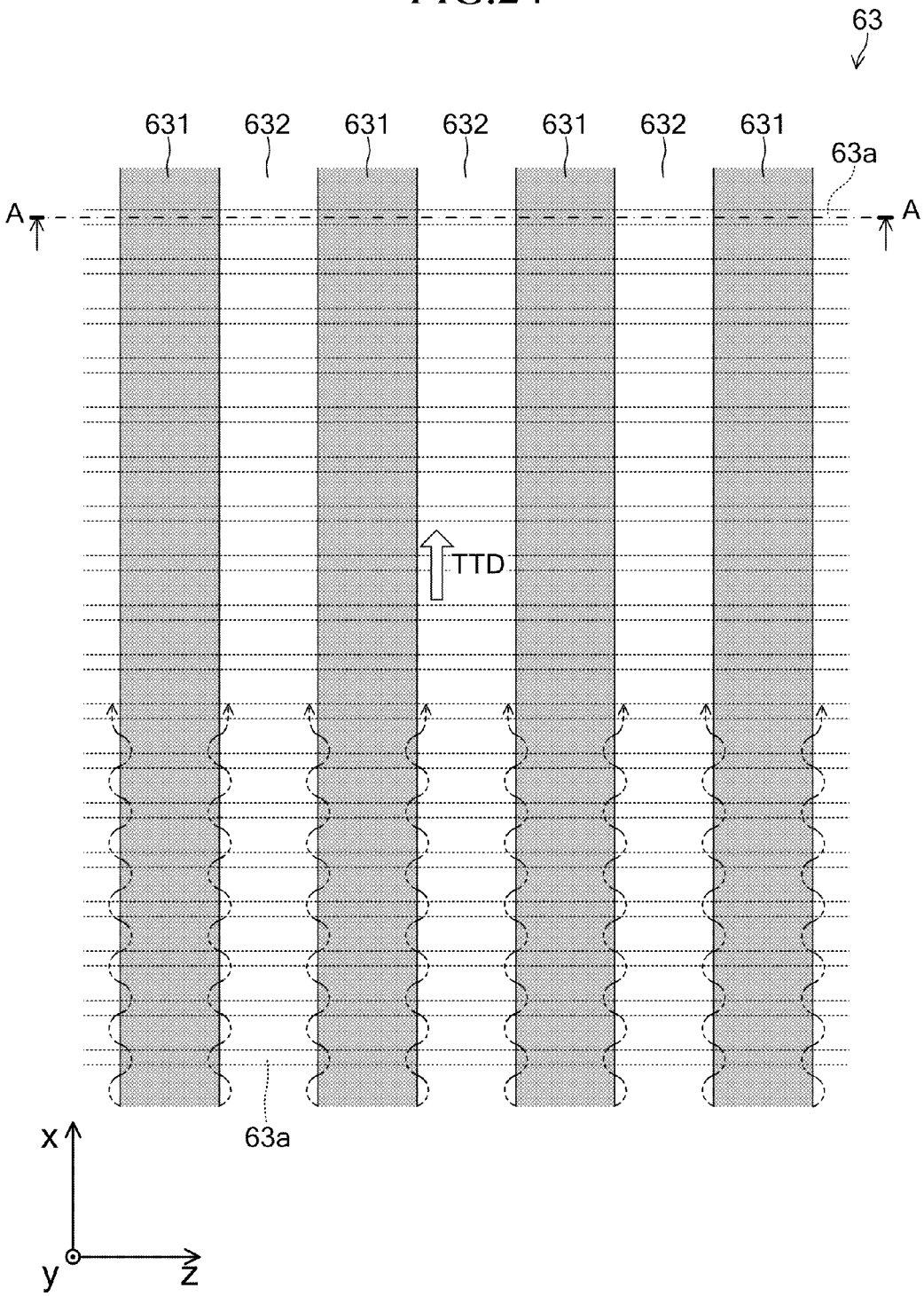
FIG. 24 is a plan view showing, on an enlarged scale, a portion of the transport wiring substrate shown in FIG. 23.

FIG. 24 is a plan view showing, on an enlarged scale, a portion of the transport wiring substrate 63 shown in FIG. 23. The detailed configuration of the transport wiring substrate 63 of the present mode will be described with reference to FIGS. 23 and 24.

Referring to FIG. 24, the transport wiring substrate 63 includes a plurality of first portions 631 and a plurality of second portions 632.

Referring to FIGS. 23 and 24, the first portions 631 and the second portions 632 are configured such that the first portions 631 differ from the second portions in structure between the transport electrode support surface 63b1 and the toner transport surface TTS (thickness and/or material, etc. of the transport electrodes 63a, the transport electrode coating layer 63c, etc.).

In the present mode, as viewed in plane, the first portions 631 and the second portions 632 assume the form of stripes (belts) each having a longitudinal direction parallel to the sub-scanning direction (x-axis direction in FIG. 24).

As shown in FIG. 24, the first portions 631 and the second portions 632 are arrayed along the longitudinal direction of the transport electrodes 63a. The transport wiring substrate 63 is configured such that the first portion 631 and the second portion 632 are disposed alternately.

<Operation of Laser Printer>

Next, the operation of the laser printer 1 having the above-described configuration will be described with reference to the relevant drawings.

<<Paper Feed Operation>>

First, referring to FIG. 1, the leading end of the paper P stacked on an unillustrated paper feed tray is sent to the resist rollers 21. The resist rollers 21 correct a skew of the paper P and adjust transport timing. Subsequently, the paper P is transported to the transfer position TP.

<<Carrying Toner Image on Latent Image Forming Surface>>

While the paper P is being transported toward the transfer position TP as described above, an image in the toner T is formed as described below on the latent image forming surface LS, which is the circumferential surface of the photoconductor drum 3.

<<Formation of Electrostatic Latent Image>>

First, the charger 4 uniformly charges a portion of the latent image forming surface LS of the photoconductor drum 3 to positive polarity.

In association with the rotation of the photoconductor drum 3 in the direction (clockwise) indicated by the arrow of FIG. 1, the portion of the latent image forming surface LS which has been charged by the charger 4 moves along the sub-scanning direction to the scanning position SP, where the portion of the latent image forming surface LS faces (faces straight toward) the scanner unit 5.

Referring to FIG. 23, at the scanning position SP, the charged portion of the latent image forming surface LS is irradiated with the laser beam LB which has been modulated on the basis of image information, while the laser beam LB sweeps along the main scanning direction. Certain positive charges are lost from the charged portion of the latent image forming surface LS according to a state of modulation of the laser beam LB. By this procedure, an electrostatic latent image LI in the form of a pattern (an imagewise distribution) of positive charges is formed on the latent image forming surface LS.

In association with the rotation of the photoconductor drum 3 in the direction (clockwise) indicated by the arrow of FIG. 23, the electrostatic latent image LI formed on the latent image forming surface LS moves toward the position where the electrostatic latent image LI faces the toner supply apparatus 6.

<<<Transport and Supply of Charged Toner>>>

Referring to FIG. 23, traveling wave transport voltages are applied to the plurality of transport electrodes 63a of the toner electric field transport body 62. Accordingly, predetermined traveling wave electric fields are formed on the toner transport surface TTS. By the effect of the traveling wave electric fields, the positively charged toner T is transported on the toner transport surface TTS along the toner transport direction TTD.

By means of voltages shown in FIG. 4 being applied to the transport electrodes 63a, traveling wave electric fields are formed on the toner transport surface TTS. Thus, the positively charged toner T is transported along the toner transport direction TTD while hopping in the y-axis direction in FIG. 23. The transport operation of the toner T by means of the counter wiring substrate 65 is similar to that by means of the transport wiring substrate 63.

<<<Development of Electrostatic Latent Image>>>

Referring to FIG. 23, the positively charged toner T is transported on the toner transport surface TTS in the toner transport direction TTD as mentioned above. By this procedure, the toner T is supplied to the developing position DP.

In the vicinity of the developing position DP, the electrostatic latent image LI formed on the latent image forming surface LS is developed with the toner T. That is, the toner T adheres to portions of the electrostatic latent image LI on the latent image forming surface LS at which positive charges are lost. Thus, an image in the toner T (hereinafter referred to as the "toner image") is carried on the latent image forming surface LS.

<<Transfer of Toner Image from Latent Image Forming Surface to Paper>>

Referring to FIG. 1, in association with rotation of the latent image forming surface LS in the direction (clockwise) indicated by the illustrated arrow, the toner image which has been carried on the latent image forming surface LS of the photoconductor drum 3 as mentioned above is transported toward the transfer position TP. At the transfer position TP, the toner image is transferred from the latent image forming surface LS onto the paper P.

<Actions and Effects of Configuration of the Present Mode>

In the configuration of the present mode, the first portions 631 and the second portions 632, which are arrayed along the longitudinal direction of the transport electrodes 63a (z-axis direction; i.e., the horizontal direction in FIG. 24), differ from each other in structure between the transport electrode support surface 63b1 and the toner transport surface TTS. Thus, on the toner transport surface TTS, the condition (strength and/or direction) of electric fields differs between the first portions 631 and the second portions 632.

Thus, in the vicinity of boundaries between the first portions 631 and the second portions 632, the above-mentioned traveling wave electric fields generated on the toner transport surface TTS can involve components directed along the longitudinal direction of the transport electrodes 63a (z-axis direction; i.e., the horizontal direction in FIG. 24). That is, the traveling wave electric fields generated on the toner transport surface TTS can involve components directed along the main scanning direction.

Accordingly, on the toner transport surface TTS, the charged toner T can also move along the above-mentioned longitudinal direction (the main scanning direction). That is, as shown in FIG. 24, the charged toner T can move in the x-axis direction while meandering, as indicated by lines made of one long dash alternating with two short dashes.

Meanwhile, for example, the toner T may aggregate within the toner box 61. Such aggregation of the toner T or the like may cause "variation" along the paper width direction in transport amount of the toner T (the amount of supply of the toner T to a most upstream portion, with respect to the toner transport direction TTD, of the toner transport surface TTS) at an early stage of toner transport.

However, according to the configuration of the present mode, as mentioned above, the toner T can meander. This effectively solves variation in transport amount which could otherwise arise along the paper width direction at the most upstream portion. That is, there can be effectively restrained variation along the paper width direction (the main scanning direction) in the amount of transport of the toner T effected by traveling wave electric fields on the toner transport surface TTS.

Thus, the positively charged toner T can be supplied to the developing position DP in a state in which variation in supply amount along the main scanning direction is restrained to the greatest possible extent. Therefore, for a toner image formed on the latent image forming surface LS, non-uniform density along the paper width direction (the main scanning direction) can be restrained to the greatest possible extent.

Embodiments of Configuration of Transport Wiring Substrate

Next, more specific configurations of the transport wiring substrate 63 of the above-described mode will be described with reference to the drawings.

First Embodiment

Figure 25:
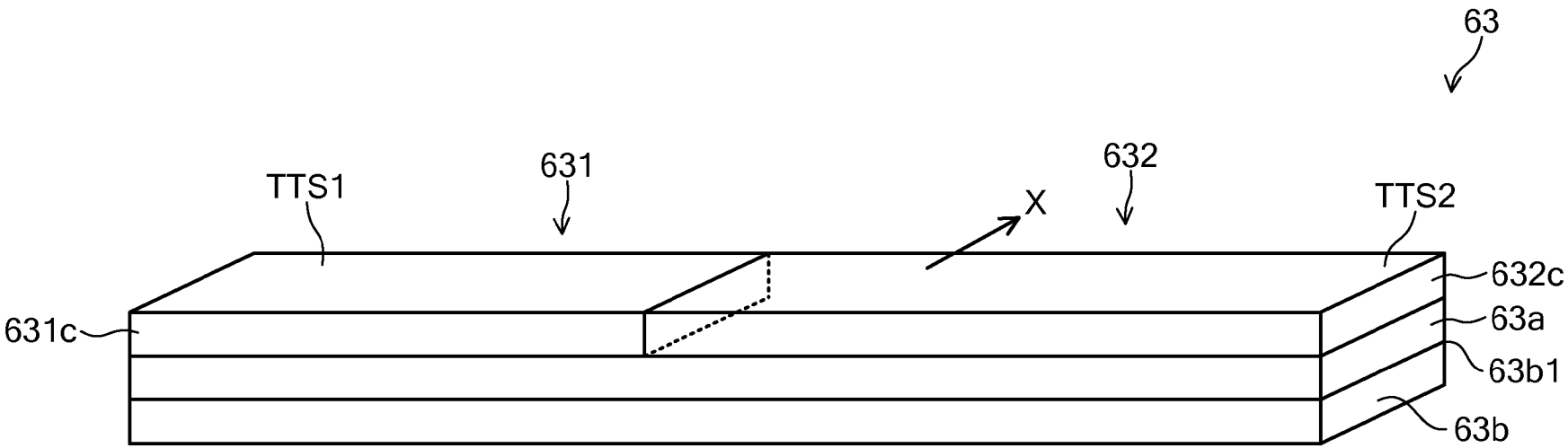
FIG. 25 is a sectional view showing the configuration of a first embodiment of a first portion and a second portion shown in FIG. 24 (a sectional view showing, on an enlarged scale, a portion of a section taken along line A-A of FIG. 24).

FIG. 25 is a sectional view showing the configuration of a first embodiment of the first portion 631 and the second portion 632 shown in FIG. 24. That is, FIG. 25 is a sectional view showing, on an enlarged scale, a portion of a section taken along line A-A of FIG. 24.

As shown in FIG. 25, the first portion 631 in the present embodiment includes a first transport electrode coating layer 631*c*. The first transport electrode coating layer 631*c* has a first toner transport surface TTS1.

Also, the second portion 632 in the present embodiment includes a second transport electrode coating layer 632*c*. The second transport electrode coating layer 632*c* has a second toner transport surface TTS2.

The first transport electrode coating layer 631*c* is formed of a material having a relative dielectric constant different from that of the second transport electrode coating layer 632*c* (notably, the first transport electrode coating layer 631*c* and the second transport electrode coating layer 632*c* have the same thickness).

That is, in the first portion 631, the structure between the first toner transport surface TTS1 and the transport electrode support surface 63*b*1 is a laminate of the transport electrode 63*a* formed of a metal film having a fixed thickness and the first transport electrode coating layer 631*c* formed of a dielectric film having a fixed thickness.

In the second portion 632, the structure between the second toner transport surface TTS2 and the transport electrode support surface 63*b*1 is a laminate of the transport electrode 63*a* formed of a metal film having a fixed thickness and the second transport electrode coating layer 632*c* formed of a dielectric film having a fixed thickness and a relative dielectric constant different from that of the first transport electrode coating layer 631*c*.

Actions and effects of the configuration of the first embodiment are similar to those of the configuration of a second embodiment described below. Thus, the configuration of the second embodiment and the actions and effects thereof will be described in detail below.

Second Embodiment

Figure 26:
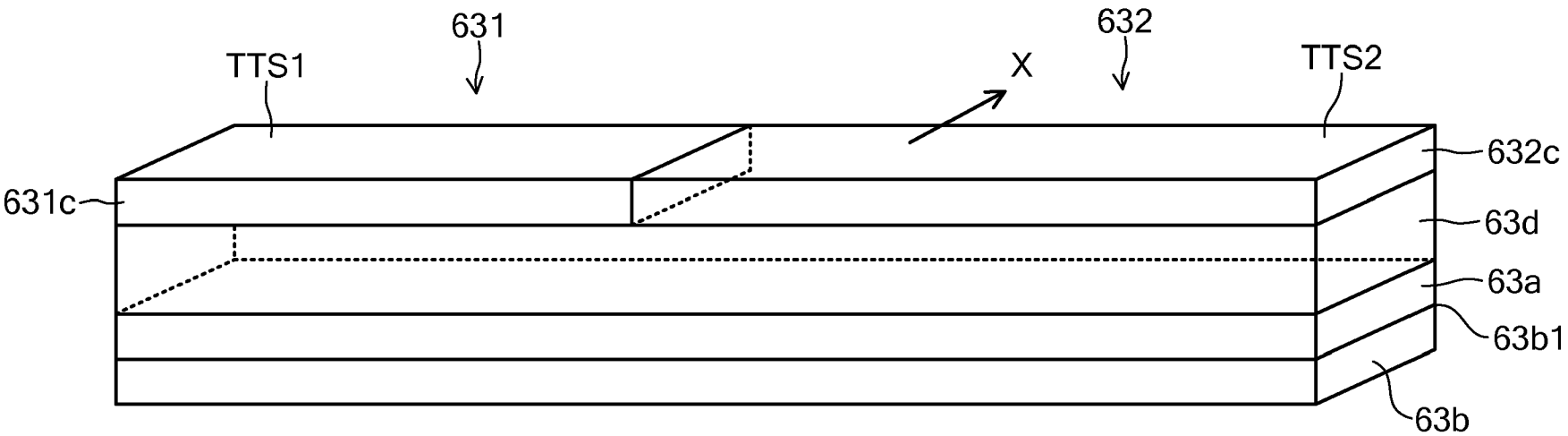
FIG. 26 is a sectional view showing the configuration of a second embodiment of the first portion and the second portion shown in FIG. 24.

FIG. 26 is a sectional view showing the configuration of the second embodiment of the first portion 631 and the second portion 632 shown in FIG. 24.

As shown in FIG. 26, also in the present embodiment, similar to the first embodiment described above, the first portion 631 includes the first transport electrode coating layer 631*c*, and the second portion 632 includes the second transport electrode coating layer 632*c*. The first transport electrode coating layer 631*c* is formed of a material having a relative dielectric constant different from that of the second transport electrode coating layer 632*c*.

Furthermore, in the present embodiment, an intermediate layer 63*d* is provided between the transport electrode 63*a* and each of the first transport electrode coating layer 631*c* and the second transport electrode coating layer 632*c*. In the present embodiment, the intermediate layer 63*d* has a substantially fixed thickness.

That is, in the first portion 631, the structure between the first toner transport surface TTS1 and the transport electrode support surface 63*b*1 is a laminate of the transport electrode 63*a* formed of a metal film having a fixed thickness, the intermediate layer 63*d* having a fixed thickness, and the first transport electrode coating layer 631*c* formed of a dielectric film having a fixed thickness.

In the second portion 632, the structure between the second toner transport surface TTS2 and the transport electrode support surface 63*b*1 is a laminate of the transport electrode 63*a* formed of a metal film having a fixed thickness, the intermediate layer 63*d* having a fixed thickness, and the second transport electrode coating layer 632*c* formed of a dielectric film having a fixed thickness and a relative dielectric constant different from that of the first transport electrode coating layer 631*c*.

Figure 27:
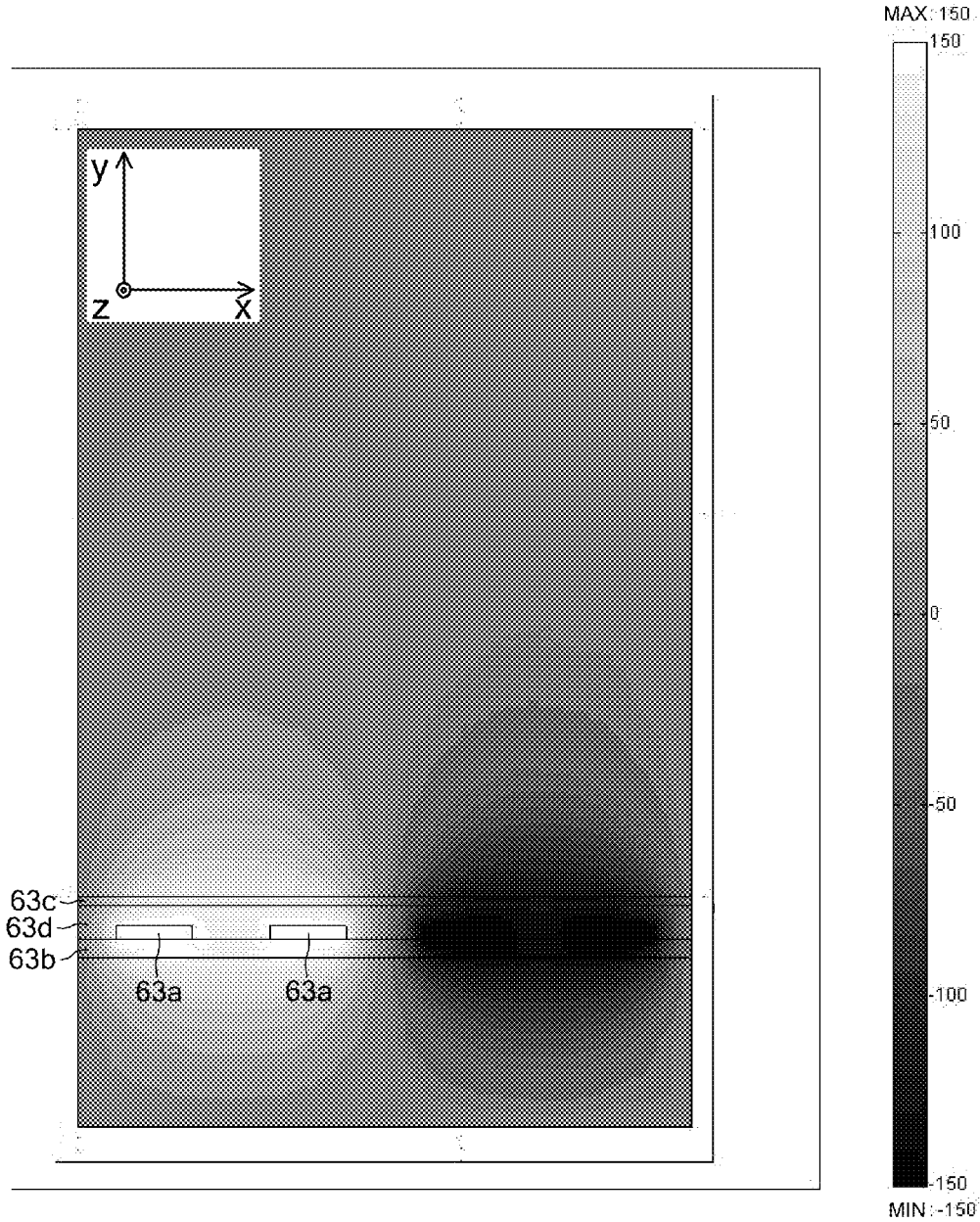
FIG. 27 is a view showing an electric potential distribution on an x-y plane of FIG. 24.
Figure 28:
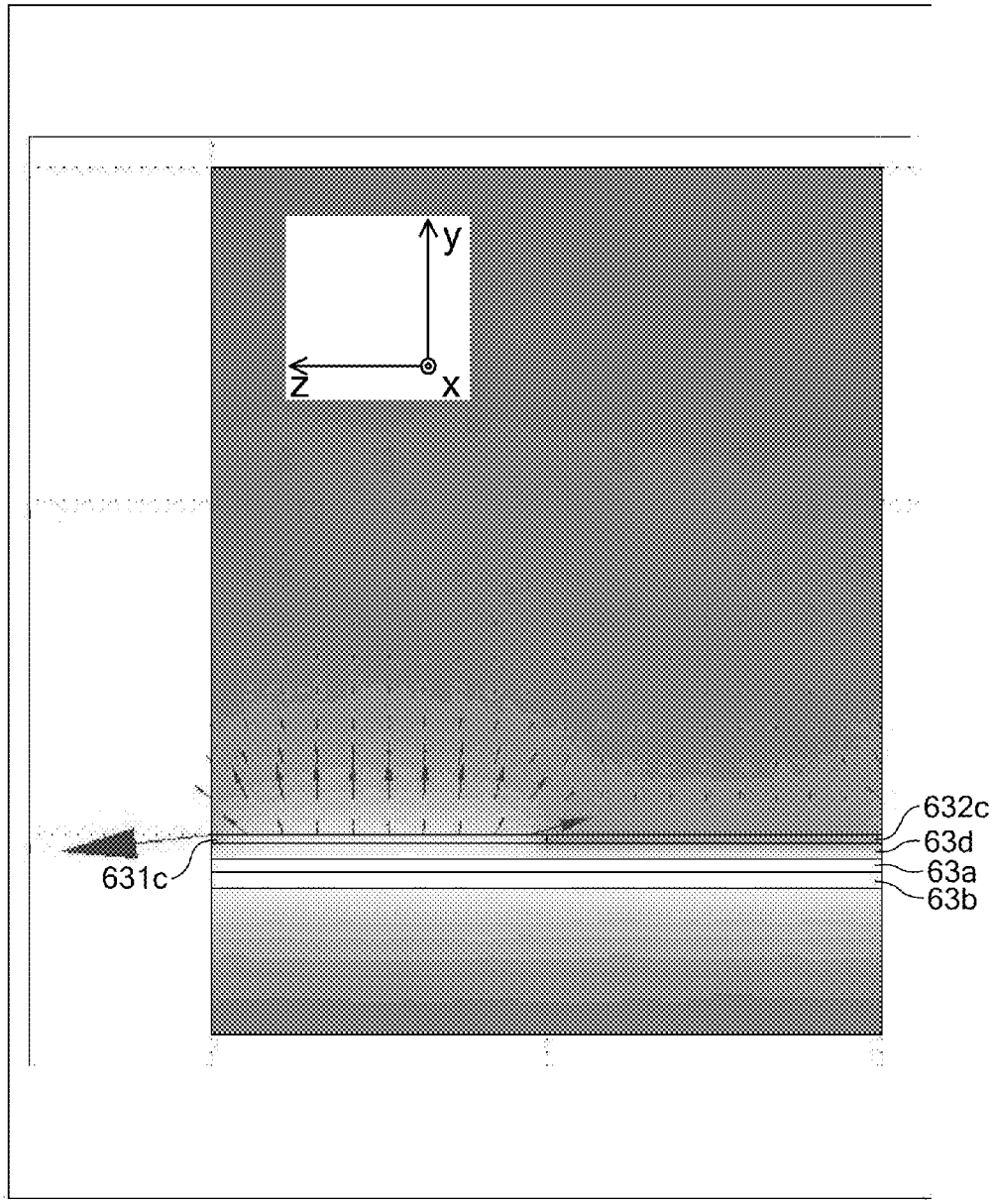
FIG. 28 is a view showing an electric potential distribution on the y-z plane of FIG. 24 and conditions of electric fields.

FIGS. 27 and 28 show the results of simulations by a finite-element method with respect to the configuration of the second embodiment. In the simulations whose results are shown in FIGS. 27 and 28, the electric potential of the transport electrodes 63*a* was +150 V or −150 V; the first transport electrode coating layer 631*c* and the intermediate layer 63*d* had a relative dielectric constant of 3; and the second transport electrode coating layer 632*c* has a relative dielectric constant of 400.

FIG. 27 shows electric potential distribution (the lower the electric potential, the darker the color) on the x-y plane of FIG. 24.

FIG. 28 shows electric potential distribution (the lower the electric potential, the darker the color) on the y-z plane of FIG. 24 and conditions of electric fields (an electric field direction is represented by the direction of an arrow, and the magnitude of an electric field is represented by the length of an arrow). FIG. 28 shows electric potential distribution and conditions of electric fields as viewed on a section of the second transport electrode 63*a* from the left in FIG. 27 taken by a plane parallel to the y-z plane substantially at the center with respect to the x-axis direction.

As shown in FIG. 28, in the configuration of the present embodiment, electric fields having components directed along the aforementioned paper width direction (z-axis direction) are generated in the vicinity of the boundaries between the first transport electrode coating layers 631*c* and the second transport electrode coating layers 632*c*, which are arrayed along the paper width direction (z-axis direction) and have mutually different relative dielectric constants.

Thus, as mentioned previously, the toner T (see FIG. 23) can meander on the first toner transport surface TTS1 and on the second toner transport surface TTS2.

Third Embodiment

Figure 29:
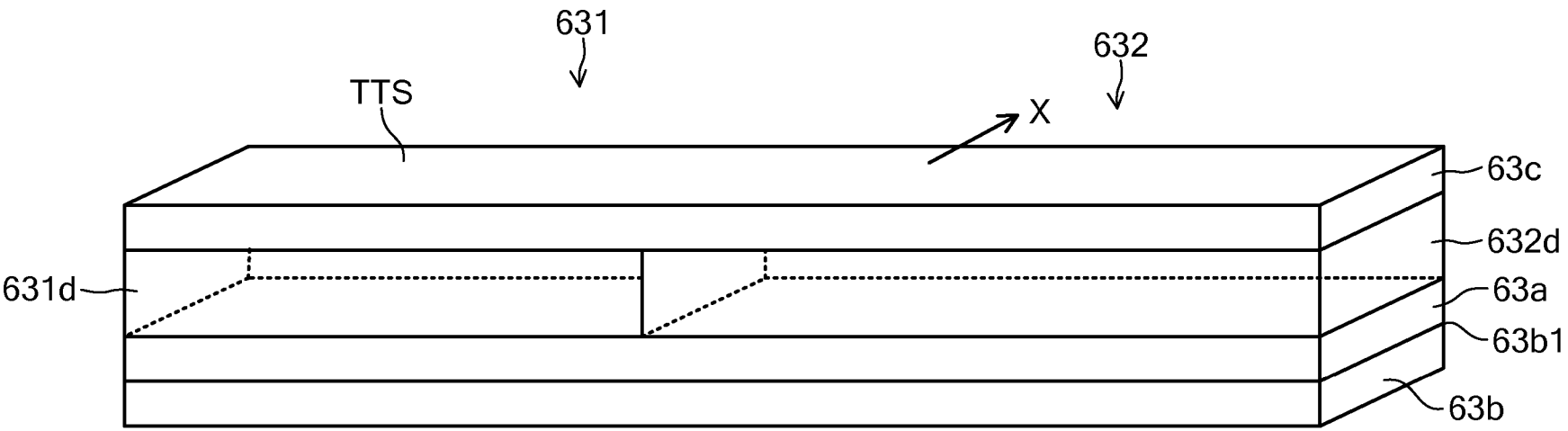
FIG. 29 is a sectional view showing the configuration of a third embodiment of the first portion and the second portion shown in FIG. 24.

FIG. 29 is a sectional view showing the configuration of a third embodiment of the first portion 631 and the second portion 632 shown in FIG. 24.

As shown in FIG. 29, the first portion 631 in the present embodiment includes a first intermediate layer 631*d*. Also, the second portion 632 in the present embodiment includes a second intermediate layer 632*d*.

The first intermediate layer 631*d* is formed of a material having a relative dielectric constant different from that of the second intermediate layer 632*d* (the first intermediate layer 631*d* and the second intermediate layer 632*d* have the same thickness).

That is, in the first portion 631, the structure between the toner transport surface TTS and the transport electrode support surface 63*b*1 is a laminate of the transport electrode 63*a* formed of a metal film having a fixed thickness, the first intermediate layer 631*d* formed of a dielectric layer having a fixed thickness, and the transport electrode coating layer 63*c* formed of a dielectric film having a fixed thickness.

In the second portion 632, the structure between the toner transport surface TTS and the transport electrode support surface 63*b*1 is a laminate of the transport electrode 63*a* formed of a metal film having a fixed thickness, the second intermediate layer 632*d* formed of a dielectric layer having a fixed thickness and a relative dielectric constant different from that of the first intermediate layer 631*d*, and the transport electrode coating layer 63*c* formed of a dielectric film having a fixed thickness.

Even through employment of the above-mentioned configuration, similar to the embodiments described above, electric fields having components directed along the aforementioned paper width direction (z-axis direction) are generated in the vicinity of the boundaries between the first portions 631 and the second portions 632.

Fourth Embodiment

Figure 30:
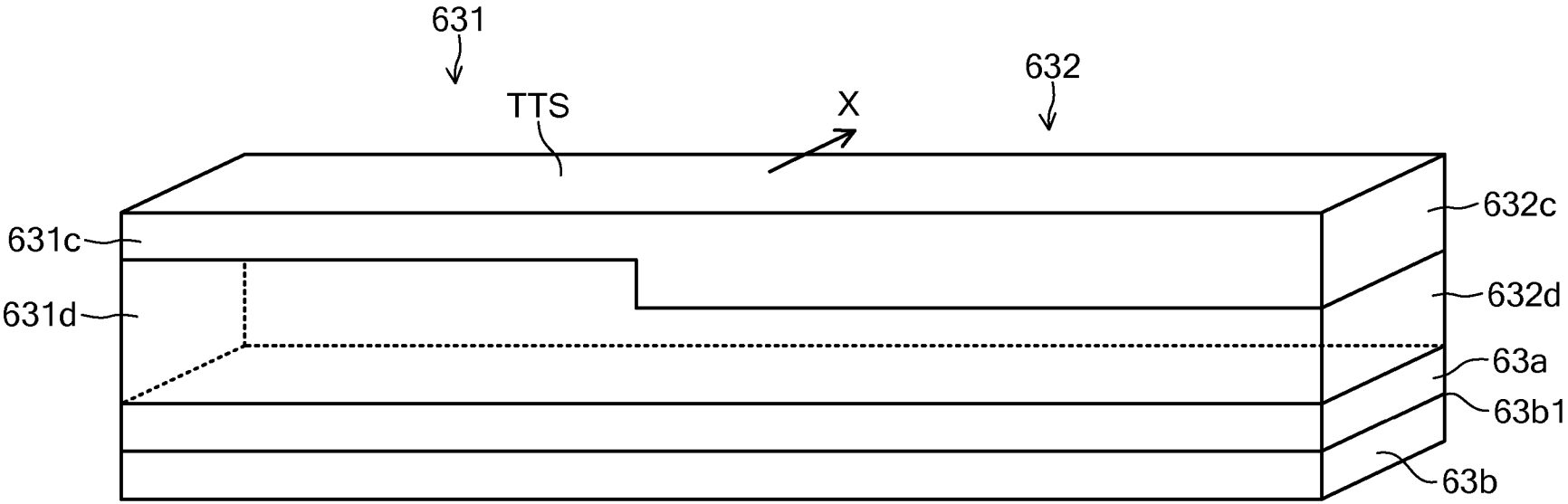
FIG. 30 is a sectional view showing the configuration of a fourth embodiment of the first portion and the second portion shown in FIG. 24.

FIG. 30 is a sectional view showing the configuration of a fourth embodiment of the first portion 631 and the second portion 632 shown in FIG. 24.

As shown in FIG. 30, the first portion 631 in the present embodiment includes the first transport electrode coating layer 631*c* and the first intermediate layer 631*d*. Also, the second portion 632 in the present embodiment includes the second transport electrode coating layer 632*c* and the second intermediate layer 632*d*.

In the present embodiment, the first transport electrode coating layer 631*c* and the second transport electrode coating layer 632*c* are formed integral with each other by use of the same material. That is, a material used to form the first transport electrode coating layer 631*c* and a material used to form the second transport electrode coating layer 632*c* have the same relative dielectric constant.

Similarly, in the present embodiment, the first intermediate layer 631*d* and the second intermediate layer 632*d* are formed integral with each other by use of the same material. That is, a material used to form the first intermediate layer 631*d* and a material used to form the second intermediate layer 632*d* have the same relative dielectric constant. Also, the material used to form the first intermediate layer 631*d* and the second intermediate layer 632*d* differs in relative dielectric constant from the material used to form the first transport electrode coating layer 631*c* and second transport electrode coating layer 632*c*.

In the present embodiment, the first intermediate layer 631*d* is formed thicker than the second intermediate layer 632*d*. By contrast, in the present embodiment, the first transport electrode coating layer 631*c* is formed thinner than the second transport electrode coating layer 632*c*.

The first portion 631 and the second portion 632 are configured such that the total thickness of the first transport electrode coating layer 631*c* and the first intermediate layer 631*d* becomes equal to that of the second transport electrode coating layer 632*c* and the second intermediate layer 632*d*.

That is, in the first portion 631, the structure between the toner transport surface TTS and the transport electrode support surface 63*b*1 is a laminate of the transport electrode 63*a* formed of a metal film having a fixed thickness, the first intermediate layer 631*d* formed of a dielectric layer, and the first transport electrode coating layer 631*c* formed of a dielectric film having a relative dielectric constant different from that of the first intermediate layer 631*d*.

In the second portion 632, the structure between the toner transport surface TTS and the transport electrode support surface 63*b*1 is a laminate of the transport electrode 63*a* formed of a metal film having a fixed thickness, the second intermediate layer 632*d* formed of a dielectric layer which is of the same material as that of the first intermediate layer 631*d* and which differs in thickness from the first intermediate layer 631*d*, and the second transport electrode coating layer 632*c* formed of a dielectric film which has a relative dielectric constant different from that of the second intermediate layer 632*d*, which is of the same material as that of the first transport electrode coating layer 631*c*, and which differs in thickness from the first transport electrode coating layer 631*c*.

Even through employment of the above-mentioned configuration, similar to the embodiments described above, electric fields having components directed along the aforementioned paper width direction (z-axis direction) are generated in the vicinity of the boundaries between the first portions 631 and the second portions 632.

Fifth Embodiment

Figure 31:
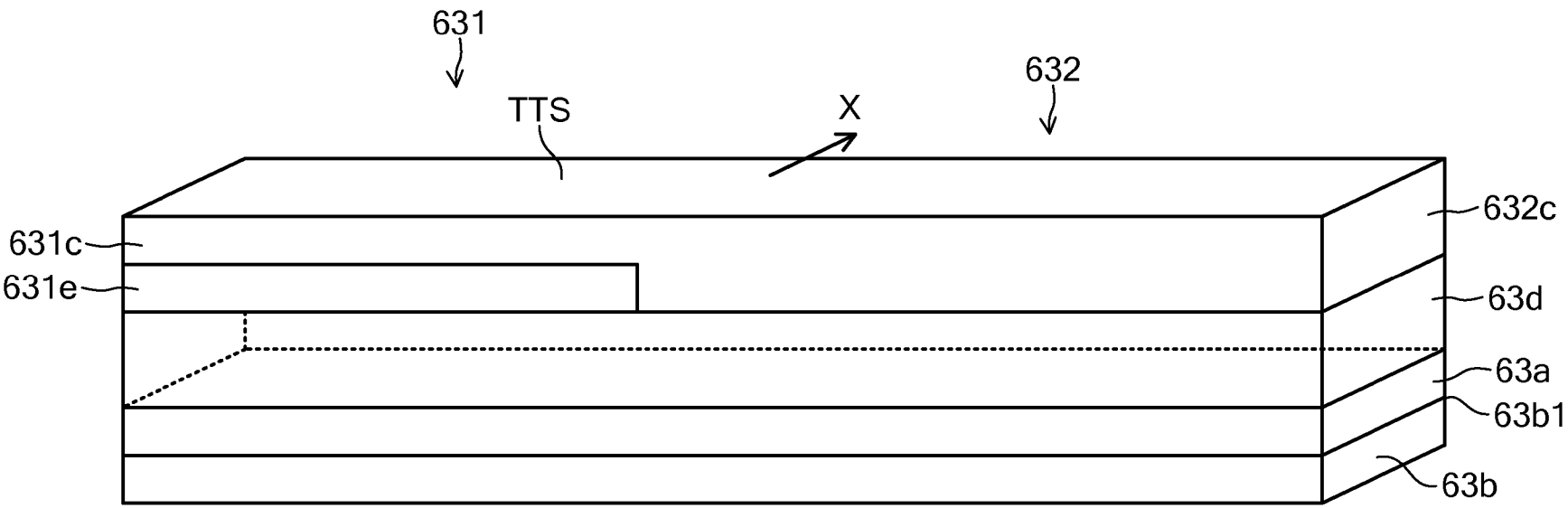
FIG. 31 is a sectional view showing the configuration of a fifth embodiment of the first portion and the second portion shown in FIG. 24.

FIG. 31 is a sectional view showing the configuration of a fifth embodiment of the first portion 631 and the second portion 632 shown in FIG. 24.

As shown in FIG. 31, the first portion 631 in the present embodiment includes the first transport electrode coating layer 631*c*, the intermediate layer 63*d*, and an auxiliary intermediate layer 631*e*. Also, the second portion 632 in the present embodiment includes the second transport electrode coating layer 632*c* and the intermediate layer 63*d*.

In the present embodiment, the first transport electrode coating layer 631*c* and the second transport electrode coating layer 632*c* are formed integral with each other by use of the same material. That is, a material used to form the first transport electrode coating layer 631*c* and a material used to form the second transport electrode coating layer 632*c* have the same relative dielectric constant. In the present embodiment, the first transport electrode coating layer 631*c* is formed thinner than the second transport electrode coating layer 632*c*.

Also, the first portion 631 and the second portion 632 are configured such that the total thickness of the first transport electrode coating layer 631*c* and the auxiliary intermediate layer 631*e* becomes equal to the thickness of the second transport electrode coating layer 632*c*.

The auxiliary intermediate layer 631*e* is formed of a material having a relative dielectric constant different from those of the first transport electrode coating layer 631*c*, the second transport electrode coating layer 632*c*, and the intermediate layer 63*d*.

Even through employment of the above-mentioned configuration, similar to the embodiments described above, electric fields having components directed along the aforementioned paper width direction (z-axis direction) are generated in the vicinity of the boundaries between the first portions 631 and the second portions 632.

Sixth Embodiment

Figure 32:
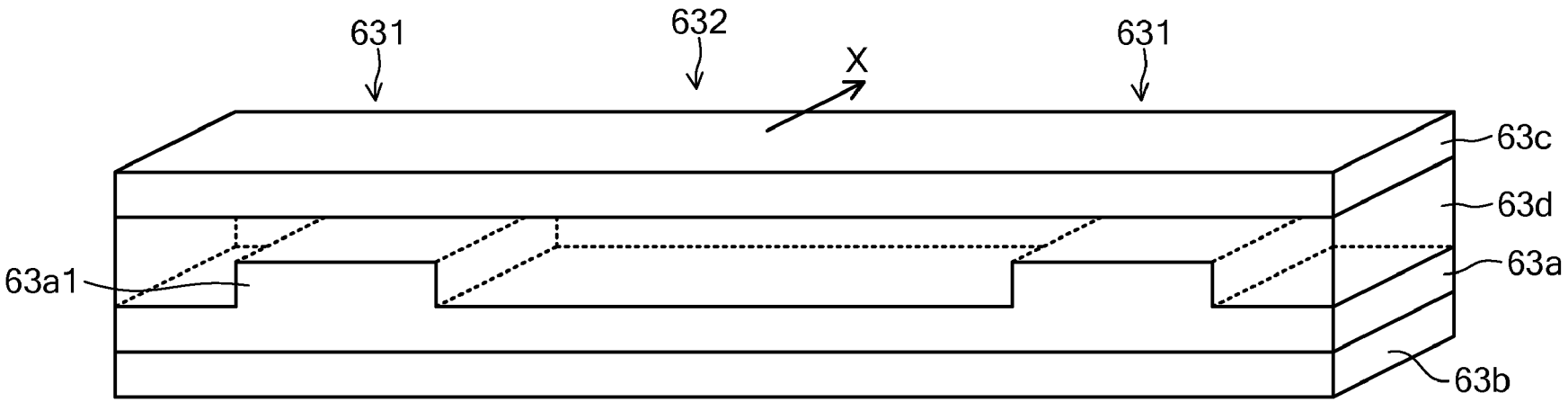
FIG. 32 is a sectional view showing the configuration of a sixth embodiment of the first portion and the second portion shown in FIG. 24.

FIG. 32 is a sectional view showing the configuration of a sixth embodiment of the first portion 631 and the second portion 632 shown in FIG. 24.

As shown in FIG. 32, the transport electrode 63*a* has projections 63*a*1 at positions corresponding to the first portions 631. That is, in the present embodiment, the first portion 631 and the second portion 632 are configured such that the thickness of the transport electrode 63*a* differs therebetween.

No particular limitation is imposed on the shape of the projection 63*a*1. For example, the projection 63*a*1 may assume the form of a layer projection having the same thickness as that of a body portion (a thin portion other than the projection 63*a*1) of the transport electrode 63*a*. Alternatively, the projection 63*a*1 may be formed of electrically conductive particles.

The transport electrodes 63*a* having the above-mentioned projections 63*a*1 can be readily formed, for example, through application of metal paste by a screen printing process.

Even through employment of the above-mentioned configuration, similar to the embodiments described above, electric fields having components directed along the aforementioned paper width direction (z-axis direction) are generated in the vicinity of the boundaries between the first portions 631 and the second portions 632.

<Modifications of Second Mode>

(1) The embodiments described above can be mutually combined or can be appropriately modified.

For example, the intermediate layer 63*d*, the first intermediate layer 631*d*, and the second intermediate layer 632*d* in FIGS. 30 to 32 can be eliminated.

Alternatively, the transport electrode coating layer 63*c* in FIG. 29 can be replaced with the first transport electrode coating layer 631*c* and the second transport electrode coating layer 632*c* in FIG. 28 can be applied.

Alternatively, in FIGS. 30 and 31, the first transport electrode coating layer 631*c* and the second transport electrode coating layer 632*c* can differ in relative dielectric constant.

Alternatively, in FIGS. 30 and 31, the first intermediate layer 631*d* and the second intermediate layer 632*d* can differ in relative dielectric constant.

Alternatively, the transport electrode 63*a* in FIGS. 25, 26, 30, and 31 can be replaced with the transport electrode 63*a* in FIG. 32.

(2) The configuration of the transport wiring substrate 63 is not limited to that in which, as shown in FIG. 24, the first portions 631 and the second portions 632 form a large number of stripes (belts) arrayed along the sub-scanning direction as viewed in plane.

For example, the configuration may be as follows: the first portions 631 are formed only at opposite end portions with respect to the paper width direction, and the second portions 632 are formed between the paired first portions 631. Alternatively, the configuration may be as follows: the second portions 632 are formed only at opposite end portions with respect to the paper width direction, and the first portions 631 are formed between the paired second portions 632.

FIGS. 33 to 38 are plan views showing the configurations of modifications of the transport wiring substrate 63 shown in FIG. 24.

Figure 33:
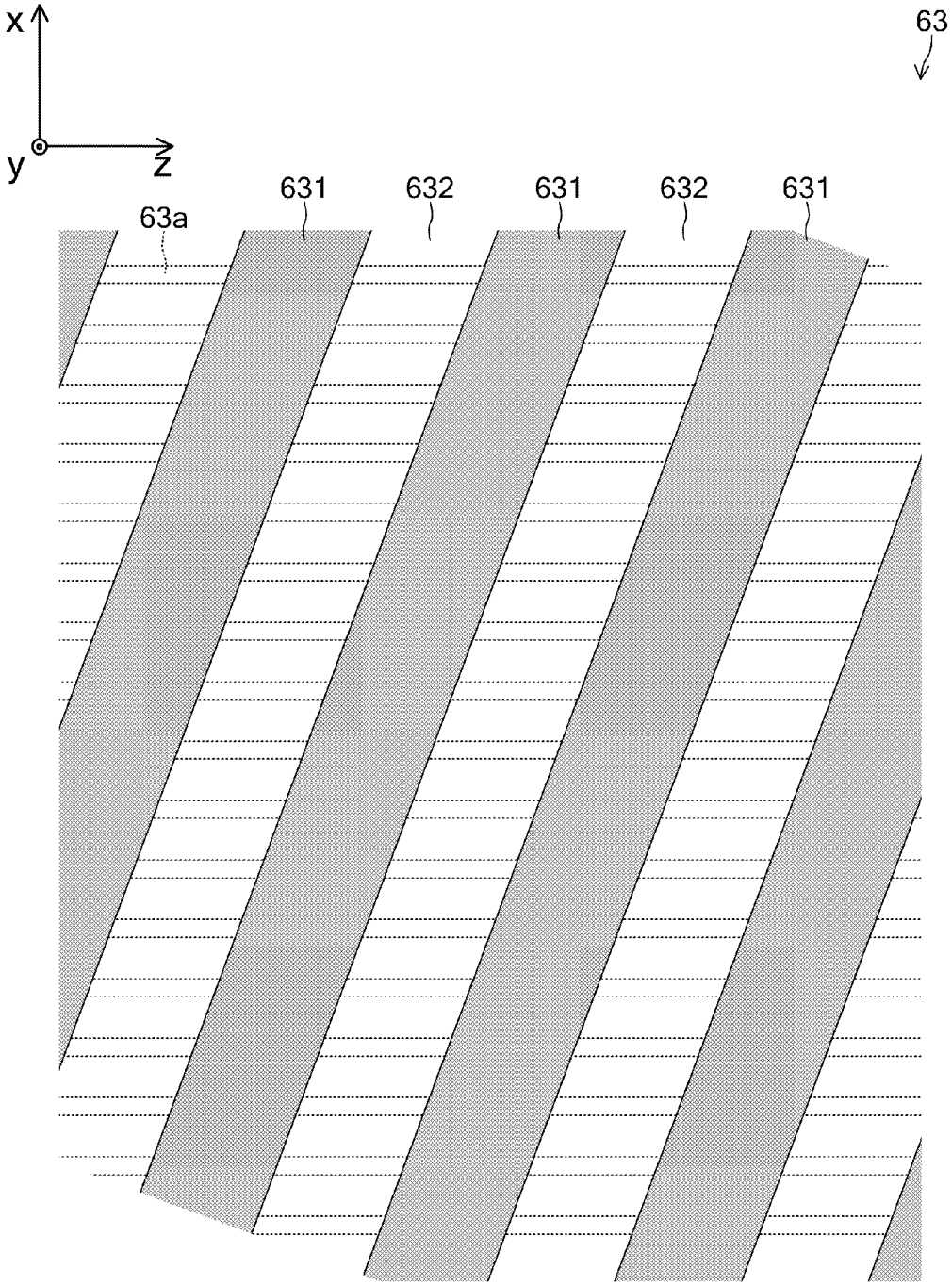
FIG. 33 is a plan view showing the configuration of a modification of the transport wiring substrate shown in FIG. 24.

For example, as shown in FIG. 33, the first portions 631 and the second portions 632 can form oblique stripes intersecting with the sub-scanning direction as viewed in plane.

Figure 34:
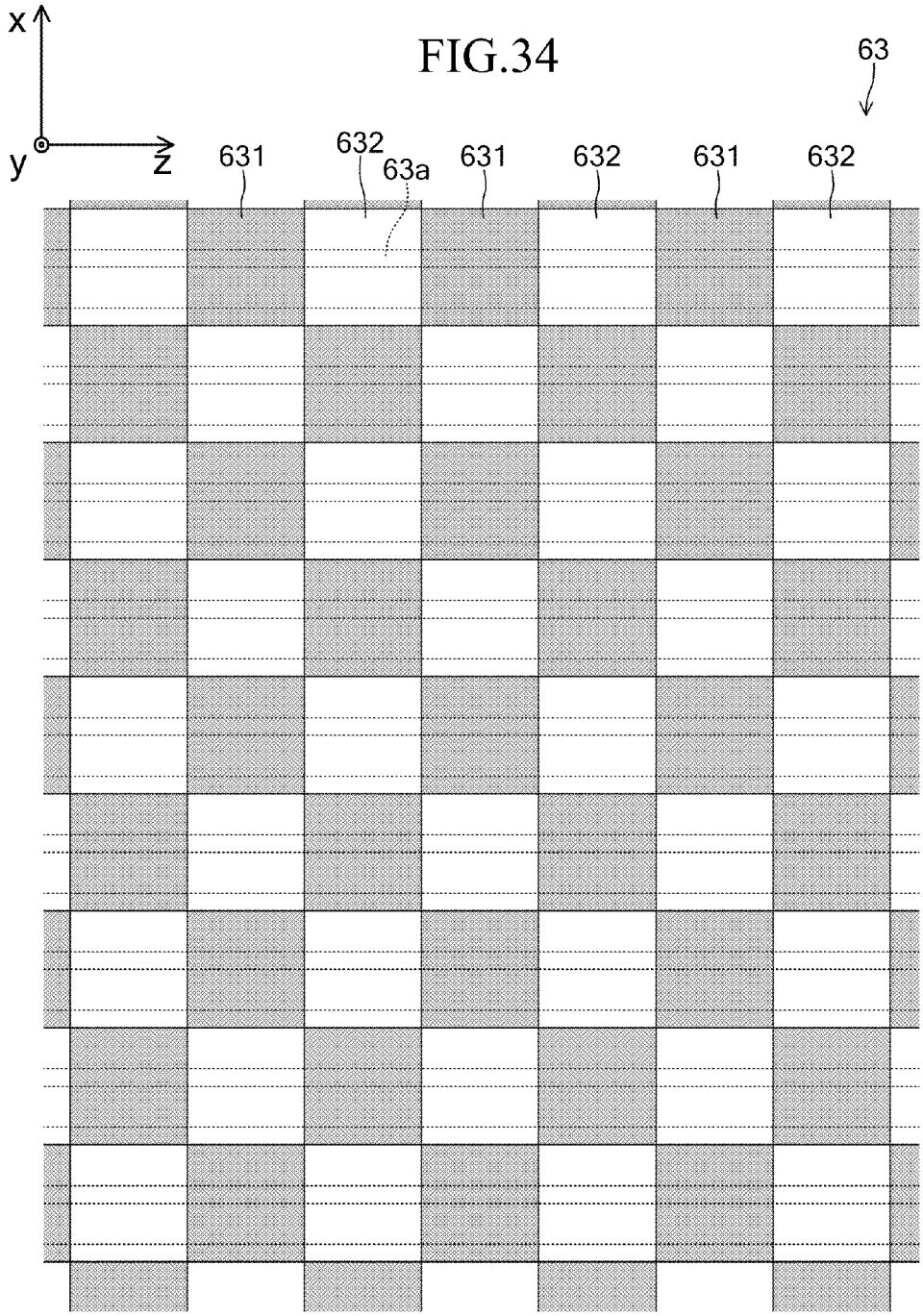
FIG. 34 is a plan view showing the configuration of a modification of the transport wiring substrate shown in FIG. 24.
Figure 35:
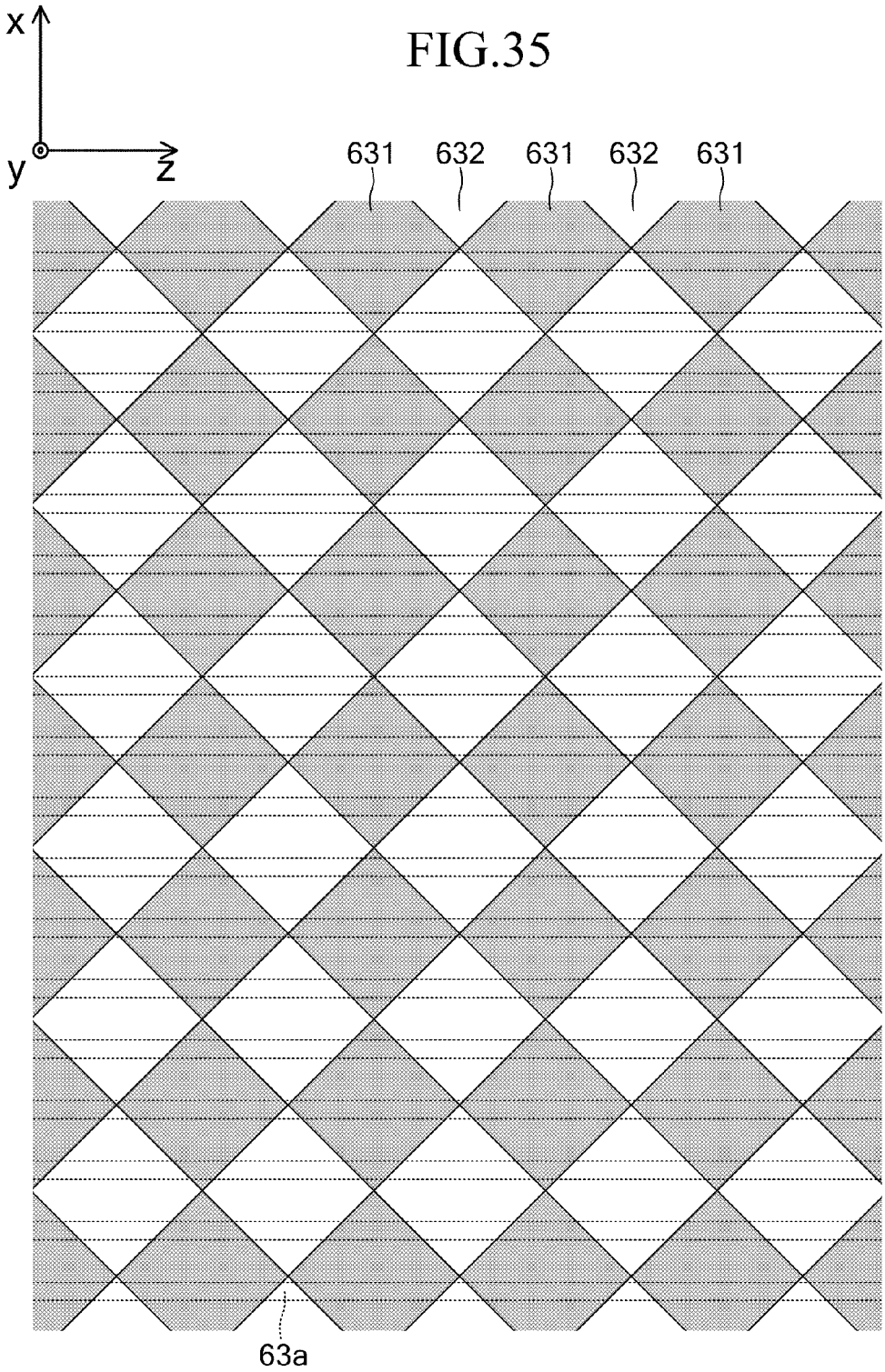
FIG. 35 is a plan view showing the configuration of a modification of the transport wiring substrate shown in FIG. 24.

Alternatively, as shown in FIGS. 34 and 35, the first portions 631 and the second portions 632 can form polygons (parallelograms) which are disposed adjacent to one another as viewed in plane.

As shown in FIG. 34, the first portions 631 and the second portions 632 may be alternately arrayed along the longitudinal direction of the transport electrodes 63*a*. Alternatively, as shown in FIG. 35, the first portions 631 and the second portions 632 may be arrayed along a direction intersecting with the longitudinal direction of the transport electrodes 63*a*.

Figure 36:
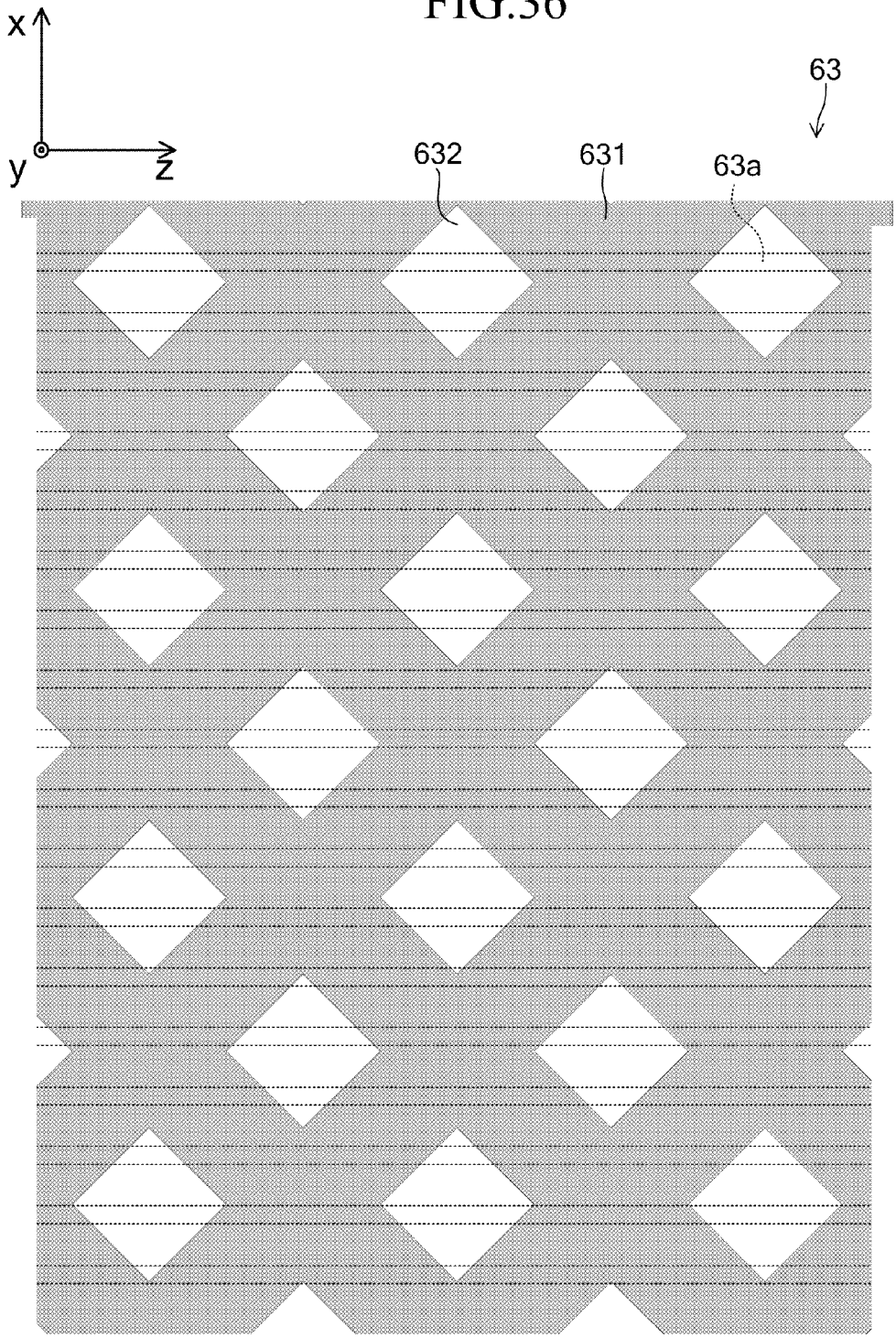
FIG. 36 is a plan view showing the configuration of a modification of the transport wiring substrate shown in FIG. 24.

Alternatively, as shown in FIG. 36, the first portions 631 can form first stripes and second stripes which intersect with each other as viewed in plane. In this case, the second portions 632 can be portions surrounded by the first portions 631; i.e., portions surrounded by the first and second stripes, as viewed in plane.

Figure 37:
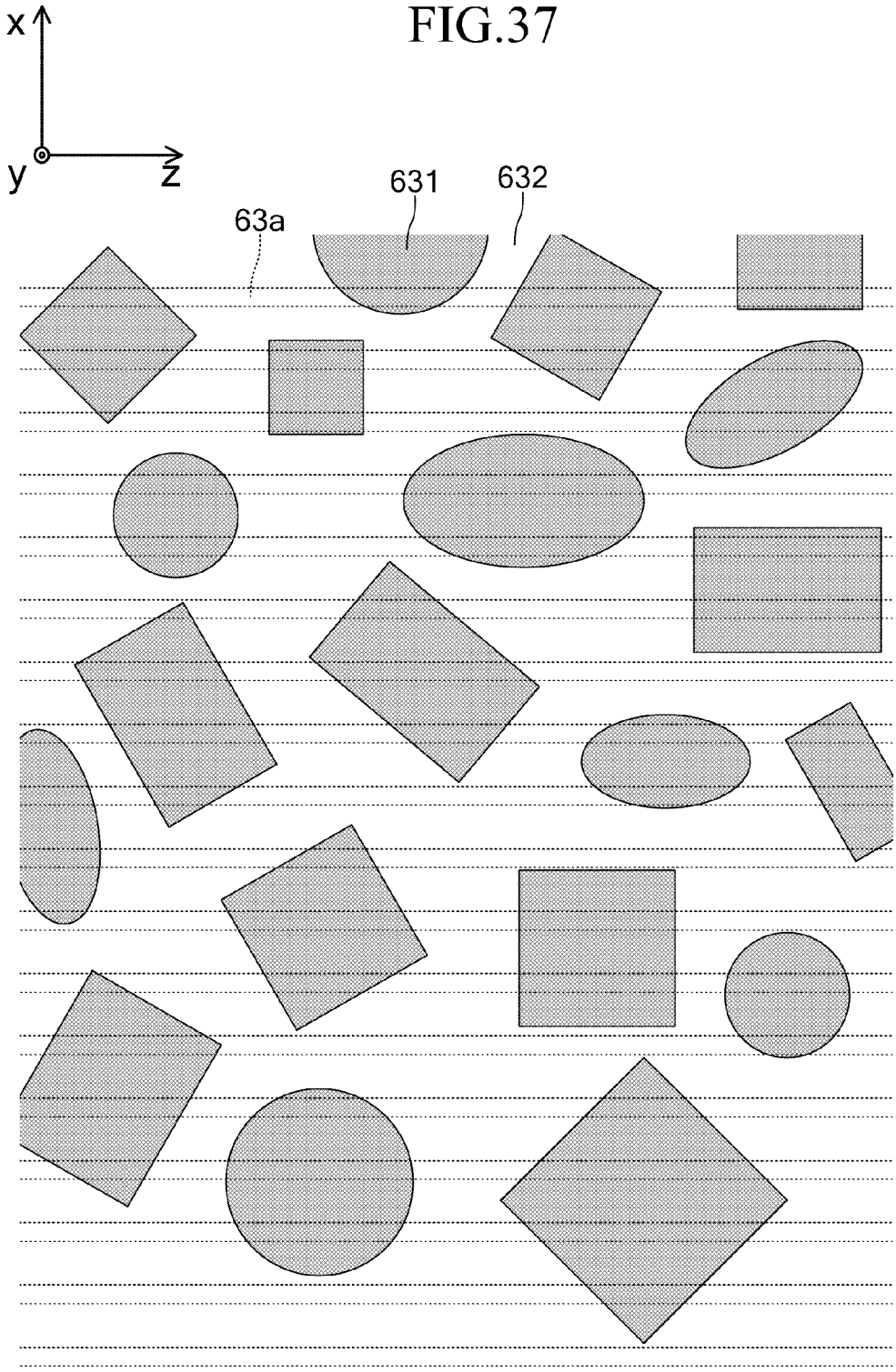
FIG. 37 is a plan view showing the configuration of a modification of the transport wiring substrate shown in FIG. 24.

Alternatively, as shown in FIG. 37, the first portions 631 and the second portions 632 can be arrayed at random. In this case, as viewed in plane, the first portions 631 and the second portions 632 can be formed in a plurality of different shapes.

Alternatively, the structure between the transport electrode support surface 63*b*1 and the toner transport surface TTS may be such that three or more different portions are arrayed mutually adjacent to one another.

Figure 38:
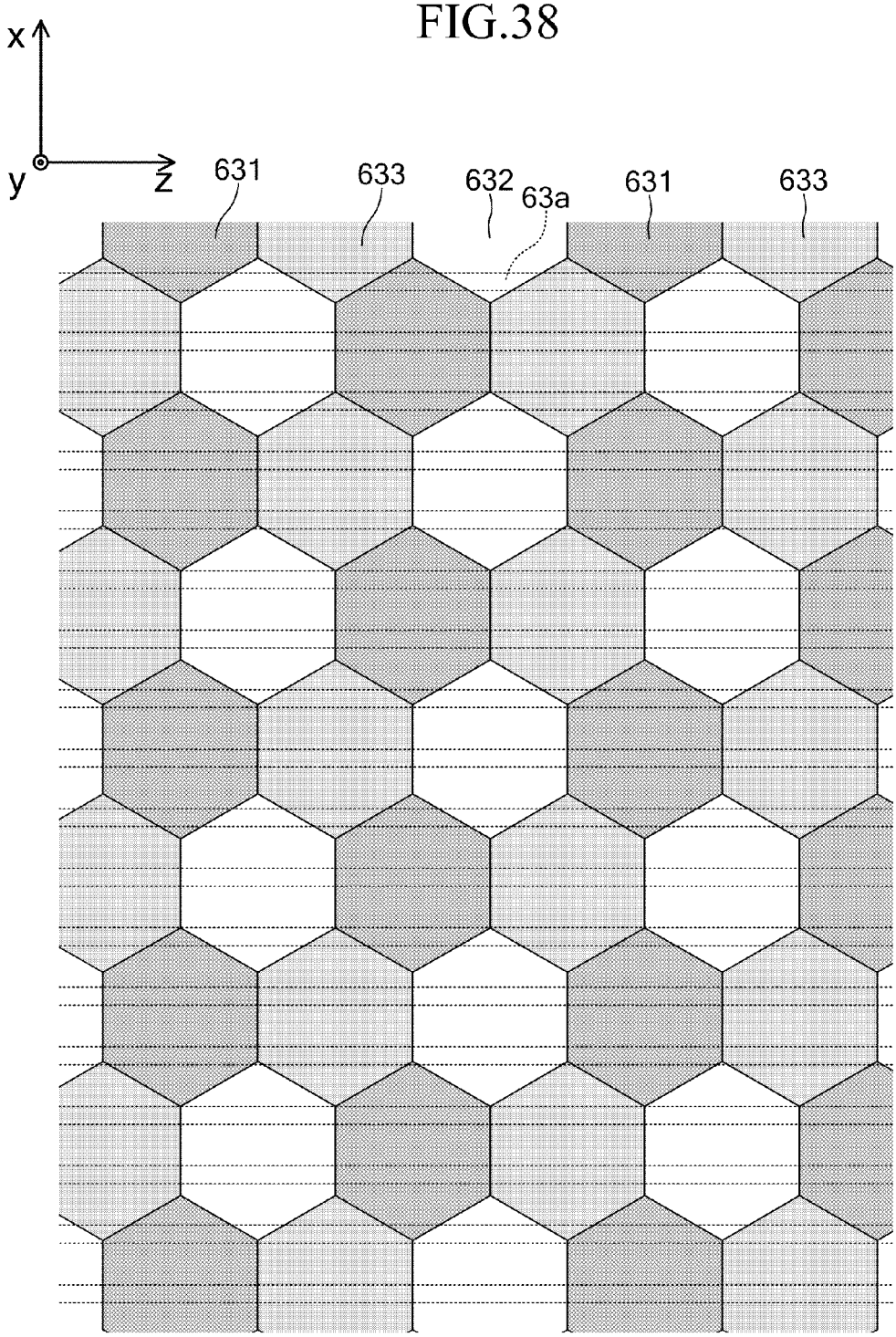
FIG. 38 is a plan view showing the configuration of a modification of the transport wiring substrate shown in FIG. 24.

Specifically, for example, as shown in FIG. 38, as viewed in plane, the first portions 631, the second portions 632, and third portions 633 can be arrayed in mutually adjacent hexagons.

<Suggestions on Modifications of First and Second Modes>

The above-described specific examples (which include the modes, the embodiments, and the individual modifications of the modes and embodiments; the same convention also applies to the following description) are, as mentioned previously, mere typical examples which the applicant of the present invention contemplated as the best at the time of filing the present application. Thus, the present invention is not limited to the specific configurations of the specific examples described above. Various modifications to the specific examples described above are possible so long as the invention is not modified in essence.

Several typical modifications will be cited below. Needless to say, even modifications are not limited to those cited below. Also, a plurality of embodiments and modifications can be combined as appropriate so long as no technical inconsistencies are involved.

The above-described specific examples and the following modifications should not be construed as limiting the present invention (particularly, those components which partially constitute means for solving the problems to be solved by the invention and are illustrated with respect to operations and functions). Such limiting construal is impermissible, since it unfairly impairs the interests of an applicant (who is motivated to file as quickly as possible under the first-to-file system) and unfairly benefits imitators, and is adverse to the purpose of the Patent Law of protecting and utilizing inventions.

(1) Application of the present invention is not limited to a monochromatic laser printer. For example, the present invention can be preferably applied to so-called electrophotographic image forming apparatus, such as color laser printers and monochromatic and color copying machines. At this time, the shape of a photoconductor is not limited to a drum shape as in the specific examples described above. For example, the photoconductor may assume the form of a flat plate or an endless belt.

Also, the present invention can be preferably applied to image forming apparatus of other than the above-mentioned electrophotographic system (for example, image forming systems which do not use photoconductor, such as a toner jet system, an ion flow system, and a multistylus electrode system).

(2) In the specific examples described above, voltages generated by the power circuits VA to VD are of rectangular waveforms. However, the voltages may be of other waveforms, such as sine waveforms and triangular waveforms.

The specific examples described above employ four power circuits VA to VD and are configured such that voltages generated by the power circuits VA to VD shift 90° in phase from one another. However, three power circuits may be provided such that voltages generated by the power circuits shift 120° in phase from one another.

(3) The counter wiring substrate 65 can have a configuration similar to that of the transport wiring substrate 63 of the specific examples described above. Alternatively, the counter wiring substrate 65 can be omitted partially or entirely.

(4) Although they are not mentioned specifically, variations other than those mentioned above are possible without departing from the gist of the present invention.

Those components which partially constitute means for solving the problems to be solved by the invention and are illustrated with respect to operations and functions encompass not only the specific structures disclosed above in the description of the specific examples but also any other structures that can implement the operations and functions.

The invention claimed is:

1. An image forming apparatus comprising:

an electrostatic latent image carrying body having a latent image forming surface formed in parallel with a predetermined main scanning direction and configured to be able to form an electrostatic latent image thereon by means of electric potential distribution, and configured such that the latent image forming surface can move along a sub-scanning direction orthogonal to the main scanning direction and a developer supply apparatus disposed in such a manner as to face the electrostatic latent image carrying body and configured to be able to supply a developer in a charged state to the latent image forming surface, wherein the developer supply apparatus comprises:

a plurality of transport electrodes arrayed along the sub-scanning direction and configured to be able to transport the developer in a predetermined developer transport direction through application of traveling wave voltages thereto;

a transport electrode support member configured to support the transport electrodes on its surface; and a transport electrode cover member formed in such a manner as to cover the surface of the transport electrode support member and the transport electrodes and having a developer transport surface which is in parallel with the main scanning direction and faces the latent image forming surface, wherein the transport electrode cover member is configured such that relative dielectric constant of the transport electrode cover member is lower in those areas which are located upstream of and downstream of, with respect to the developer transport direction, a counter area where the latent image forming surface and the developer transport surface face each other, than in the counter area.

2. An image forming apparatus according to claim 1, wherein the transport electrode cover member comprises an upstream intermediate portion which is located between a most upstream area and the counter area with respect to the developer transport direction and whose relative dielectric constant falls between that in the most upstream area and that in the counter area.

3. An image forming apparatus according to claim 2, wherein the transport electrode cover member comprises a downstream intermediate portion which is located between a most downstream area and the counter area with respect to the developer transport direction and whose relative dielectric constant falls between that in the most downstream area and that in the counter area.

4. An image forming apparatus according to claim 1, wherein the transport electrode cover member comprises a downstream intermediate portion which is located between a most downstream area and the counter area with respect to the developer transport direction and whose relative dielectric constant falls between that in the most downstream area and that in the counter area.

5. An image forming apparatus comprising:

an electrostatic latent image carrying body having a latent image forming surface formed in parallel with a predetermined main scanning direction and configured to be able to form an electrostatic latent image thereon by means of electric potential distribution, and configured such that the latent image forming surface can move along a sub-scanning direction orthogonal to the main scanning direction and a developer supply apparatus disposed in such a manner as to face the electrostatic latent image carrying body and configured to be able to supply a developer in a charged state to the latent image forming surface, wherein the developer supply apparatus comprises:

a plurality of transport electrodes arrayed along the sub-scanning direction, having a longitudinal direction intersecting with the sub-scanning direction, and configured to be able to transport the developer in a predetermined developer transport direction through application of traveling wave voltages thereto;

an electrode support member configured to support the transport electrodes on its surface; and an electrode cover member formed in such a manner as to cover the surface of the electrode support member and the transport electrodes and having a developer transport surface which is in parallel with the main scanning direction and faces the latent image forming surface, wherein first portions and second portions which differ in structure between the surface of the electrode support member and the developer transport surface are arrayed along the longitudinal direction of the transport electrodes.

6. An image forming apparatus according to claim 5, wherein the electrode cover member is formed such that its relative dielectric constant differs between the first portions and the second portions.

7. An image forming apparatus according to claim 6, wherein the electrode cover member is formed such that its thickness differs between the first portions and the second portions.

8. An image forming apparatus according to claim 5, wherein the electrode cover member is formed such that its thickness differs between the first portions and the second portions.

9. An image forming apparatus according to claim 8, wherein an intermediate layer is provided between the transport electrodes and a thin portion of the electrode cover member, and the intermediate layer differs from the electrode cover member in relative dielectric constant.

10. An image forming apparatus according to claim 5, wherein an intermediate layer is provided between the electrode cover member and the transport electrodes, and the intermediate layer is formed such that its relative dielectric constant differs between the first portions and the second portions.

11. An image forming apparatus according to claim 5, wherein, the first portions and the second portions form stripes which are arrayed along the sub-scanning direction as viewed in plane.

12. An image forming apparatus according to claim 5, wherein the first portions and the second portions form polygons which are disposed adjacent to one another as viewed in plane.

13. An image forming apparatus according to claim 5, wherein the first portions and the second portions form oblique stripes intersecting with the sub-scanning direction as viewed in plane.

14. An image forming apparatus according to claim 5, wherein:

the first portions or the second portions form first stripes and second stripes which intersect with each other as viewed in plane, and the first portions or the second portions which do not form the first stripes and the second stripes are portions surrounded by the first stripes and the second stripes as viewed in plane.

15. An image forming apparatus according to claim 5, wherein the first portions and the second portions are arrayed at random.

16. An image forming apparatus according to claim 5, wherein portions of the transport electrodes corresponding to the first portions and portions of the transport electrodes corresponding to the second portions differ in thickness.

17. An image forming apparatus according to claim 5, wherein the transport electrodes has projections at positions corresponding to the first portions.

* * * * *